US008851945B2

(12) United States Patent
Harada et al.

(10) Patent No.: US 8,851,945 B2
(45) Date of Patent: Oct. 7, 2014

(54) OUTBOARD ENGINE UNIT

(71) Applicant: Honda Motor Co., Ltd., Tokyo (JP)

(72) Inventors: Yoshihiro Harada, Saitama (JP); Masashi Kai, Saitama (JP); Kunihiko Ishizuka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 116 days.

(21) Appl. No.: 13/667,800

(22) Filed: Nov. 2, 2012

(65) Prior Publication Data

US 2013/0109256 A1 May 2, 2013

(30) Foreign Application Priority Data

Nov. 2, 2011 (JP) ..... 2011-241369
Nov. 2, 2011 (JP) ..... 2011-241437
Nov. 2, 2011 (JP) ..... 2011-241485

(51) Int. Cl.
*B63H 21/36* (2006.01)
*F02B 61/04* (2006.01)

(52) U.S. Cl.
CPC ..... *F02B 61/045* (2013.01)
USPC ..... 440/77

(58) Field of Classification Search
USPC ..... 440/77
IPC ..... F02B 61/045
See application file for complete search history.

(56) References Cited

U.S. PATENT DOCUMENTS

| | | | | |
|---|---|---|---|---|
| 4,379,702 | A * | 4/1983 | Takada et al. | 440/77 |
| 7,118,432 | B2 * | 10/2006 | Katayama | 440/77 |
| 7,425,163 | B2 * | 9/2008 | Murai et al. | 440/77 |
| 2005/0079775 | A1 * | 4/2005 | Katayama | 440/77 |
| 2006/0286876 | A1 * | 12/2006 | Kimura et al. | 440/77 |

FOREIGN PATENT DOCUMENTS

| | | |
|---|---|---|
| JP | 09-280129 | 10/1997 |
| JP | 11-198893 | 7/1999 |
| JP | 2002-235621 A | 8/2002 |

* cited by examiner

*Primary Examiner* — Stephen Villa
(74) *Attorney, Agent, or Firm* — Rankin, Hill & Clark LLP

(57) ABSTRACT

An outboard engine unit capable of efficiently cooling the interior of an engine cover is disclosed. The outboard engine unit includes a cooling opening capable of guiding air to an interior from an upper part of the engine cover, a first intake channel having a first outlet open to an upper front end and communicating with the opening, a partition wall disposed so as to be oriented substantially in a perpendicular direction below the first outlet; and a second intake channel extending substantially in the perpendicular direction along a rear wall of the engine cover rearward of the partition wall. The outboard engine unit is configured so that air directed from the cooling opening to the interior of the engine cover is directed to the throttle unit via the second cooling air intake channel.

8 Claims, 35 Drawing Sheets

10
50
51
52
35
4
4
7
7
24
41
37
38
23
39
27
36
12
21
18
17
33
16
15
14
28
34
32
29
31

$A_L$
226(226B)
261
24
266
$B_L$
$B_R$
226(226A)
271
(271B)
264
$A_R$
265
271
(271A)
23

281b
$D_L$
289
$C_L$
281
284b
271
(271B)
$C_L$
287
281a
$C_R$
$D_R$
$C_R$
288
271
(271A)

OUTBOARD ENGINE UNIT

FIELD OF THE INVENTION

The present invention relates to an outboard engine unit for directing air into a combustion chamber via a throttle unit provided to the upstream side of an engine (combustion chamber) disposed inside an engine cover.

BACKGROUND OF THE INVENTION

Among known outboard engine units are those including an air induction port disposed in the upper rear of the engine cover, an electrical box disposed in the upper front inside the engine cover, and an engine air intake port disposed in the vicinity of the electrical box (i.e., the upper front inside the engine cover). An example thereof is disclosed in Japanese Patent No. 4,005,198.

In the outboard engine unit disclosed in the above publication, air (from the exterior) is taken into the engine cover from the air induction port, and the air taken into the engine cover is directed to the electrical box via an upper space inside the engine cover. The air directed to the electrical box cools the electrical components inside the electrical box, and the air that has cooled the electrical components is taken into the throttle unit via the air intake port of the engine.

However, the outboard engine unit disclosed in Japanese Patent No. 4,005,198 has the air induction port, the electrical box, and/or the air intake port of the engine disposed in upper part of the engine cover. Therefore, the air taken into the engine cover from the air induction port is taken into the air intake port of the engine via the upper space inside the engine cover. In other words, it is difficult for the air taken in from the air induction port to circulate to the entire area inside the engine cover. Accordingly, there is a need to provide an arrangement that cools the entire area inside the engine cover with air taken into the engine cover from the air induction port, i.e., an arrangement that cools the entire engine with air.

Also known among outboard engine units is one having an air intake duct provided to the engine cover for covering the area above the engine, the inlet to the air intake duct opens to an air intake chamber, and the outlet of the air intake duct opens to an air induction pipe, as disclosed in Japanese Patent No. 3,608,637. The air intake chamber is in communication with the exterior of the engine cover via the air intake port of the engine cover. The air induction pipe is in communication with the throttle unit (throttle valve).

In the outboard engine unit disclosed in Japanese Patent No. 3,608,637, air is taken into the air intake chamber from the air intake port of the engine cover, and the air taken into the air intake chamber can be taken into the air intake duct from the inlet. The air taken into the air intake duct is taken into the air induction pipe via the outlet of the air intake duct, and the air taken into the air induction pipe is introduced to the throttle unit.

The outboard engine unit disclosed in Japanese Patent No. 3,608,637 has the air intake port of the engine cover disposed facing sideways when the outboard engine unit is mounted on a hull. Therefore, when air intake noise is generated in accompaniment with air intake pulsation or shockwaves when the engine is driven, the generated air intake noise is transmitted laterally from the air intake port of the engine cover via the air intake duct. Thus, air intake noise is transmitted laterally, whereby air intake noise can be made less likely to be transmitted to the hull side. However, it is difficult to sufficiently reduce air intake noise using a method that transmits air intake noise laterally.

Furthermore, in an outboard engine unit, ordinarily, the engine is covered by an engine cover, an opening for air intake is provided to the engine cover, and this opening is in communication with the throttle unit via the internal space of the engine cover. Among such outboard engine units are those provided with a silencer on the upstream side of the throttle unit so that air intake noise of the engine is reduced by the silencer. An example thereof is disclosed in Japanese Patent Application Laid-Open Publication No. 2002-235621.

When a silencer is provided to the outboard engine unit, the air directed to the internal space of the engine cover from the opening in the engine cover is directed to the silencer. The air directed to the silencer is taken into the throttle unit, and the air taken into the throttle unit is directed to the combustion chamber of the engine.

Ordinarily, in an outboard engine unit, it is known that air intake noise is generated in accompaniment with air intake pulsation or shockwaves when the engine is driven, and the generated air intake noise is transmitted to the exterior of the engine cover via the throttle unit or the like. In view of the above, the silencer is disposed upstream from the throttle unit, whereby air is made to expand in the silencer to reduce the air intake noise (i.e., sound pressure).

There are also outboard engine units configured so that the opening for air intake is in communication with the throttle unit via an intake channel inside the engine cover. In this air intake structure, the throttle unit (i.e., engine) is in direct communication with the opening for air intake via the intake channel. Accordingly, the air intake noise generated in accompaniment with air intake pulsation or shockwaves of the engine is readily transmitted to the exterior of the engine cover via the intake channel and the opening. For this reason, there is a need to develop a feature that further reduces the air intake noise generated in accompaniment with air intake pulsation or shockwaves of the engine.

In addition, in the case that the opening for air intake is placed in communication with the throttle unit via the intake channel, it is possible to consider directing water into the intake channel together with air when air is directed into the intake channel from the opening. For this reason, water directed into the intake channel tends to enter into the throttle unit via the intake channel, and there is a need to develop a feature that reduces the likelihood that water will enter into the throttle unit.

SUMMARY OF THE INVENTION

An object of the present invention is to provide an outboard engine unit capable of cooling the entire area inside the engine cover.

Another object of the present invention is to provide an outboard engine unit that can sufficiently reduce air intake noise, and that can minimize entry of water into the throttle unit.

In a first aspect of the present invention, there is provided an outboard engine unit having an engine, an engine cover for covering the engine, and a throttle unit being in communication with an upper space in a rear-side interior of the engine cover, wherein the outboard engine unit comprises: an opening for cooling, the cooling opening being adapted for guiding air to an interior of the engine cover and disposed in an upper part of the engine cover; a first intake channel having a first outlet open to an upper front end of the engine cover, the first intake channel communicating with the opening and extending to the upper front end of the engine cover along an upper-side interior of the engine cover; a partition wall for guiding air directed out from the first outlet to below the engine cover, the partition wall being disposed so as to be oriented substantially in a vertical direction below the first outlet; and a second intake channel for communicating a second outlet at an upper end with the upper space, the second intake channel extending substantially in the vertical direction along a rear wall of the engine cover rearward of the partition wall.

In the outboard engine unit described above, air inside the engine cover is taken in from the throttle unit by driving the engine. The air inside the engine cover is taken into the throttle unit, whereby air (outside air) is taken into the first intake channel from the opening for air intake. The air taken into the first intake channel is directed out from the first outlet to the upper front end side of the engine cover. The air directed out to the upper front end side is guided by the partition wall to below the engine cover. The air guided below the engine cover is directed rearward to the second intake channel side and drawn to the throttle unit via the second intake channel.

The second intake channel extends substantially vertically along the rear wall of the engine cover and the second outlet is in communication with the upper space. The throttle unit is in communication with the upper space of the rear-side interior of the engine cover. Accordingly, the air guided below the engine cover can be directed below the rear-side interior of the engine cover, and air directed below the rear-side interior can be directed to the upper space via the second intake channel. The air taken into the engine cover from the air intake openings is guided from the upper front end to below the engine cover, and the air guided below is directed from below to the upper space via the area below the rear-side interior. In other words, circulating air taken in from the air intake openings around the entire area in the engine cover allows the air inside the engine cover to be stirred around all areas. Therefore, the temperature of the air in all areas inside the engine cover is averaged out and the engine and other components inside the engine cover can be efficiently cooled.

Furthermore, cooling the engine and the like inside the engine cover with good efficiency can inhibit an increase in the temperature of the air intake directed to the combustion chambers via the throttle unit. In this manner, inhibiting an increase in the temperature of the air intake directed to the combustion chambers allows the engine output to be improved.

In addition, a cooling fan can be made obviated because air is taken inside the engine cover using air taken into the engine (combustion chambers), and the interior of the engine cover can be efficiently cooled using the air thus taken in. The interior of the engine cover can thereby be cooled with a simple configuration.

Preferably, the second intake channel communicates a second inlet in a lower end part with a lower-side interior adjacent to the rear wall of the engine cover. The first outlet for introducing air taken into the engine cover from the air intake openings is disposed near the upper front end of the engine cover. Accordingly, the second inlet can be arranged substantially on the diagonal line to the first outlet. Air taken in from the air intake openings can thereby be adequately circulated around the entire area in the engine cover, and the entire area inside the engine cover, i.e., the entire engine, can be advantageously cooled by the circulated air.

Desirably, the outboard engine unit includes, in the interior of the engine cover: a power generator disposed in front of the partition wall and below the first outlet; and an electrical component disposed behind the power generator and vertically below the partition wall.

The air directed out from the first outlet to the upper front end of the engine cover is guided below the engine cover by the partition wall. Accordingly, the air directed out from the first outlet to the upper front end of the engine cover can be directed to the power generator. The power generator can thereby be cooled by air directed toward the power generator.

Furthermore, an electrical component is disposed behind the power generator and vertically below the partition wall. The second inlet of the second intake channel is in communication with the lower-side interior adjacent to the rear wall of the engine cover. Accordingly, the air which has cooled the power generator is directed rearward and below the engine cover toward the second inlet. The air which has cooled the power generator can thereby be directed toward the electrical component and the electrical component can be cooled by air directed to the electrical component.

In another aspect of the present invention, there is provided an outboard engine having an engine, an engine cover for covering the engine, an opening formed in the engine cover in order to introduce air into the engine cover, and a throttle unit into which air taken into the interior of the engine cover is introduced from the opening, the outboard engine unit comprising: an intake channel for guiding air directed from the opening to the throttle unit, the intake channel being disposed inside the engine cover; and an interference muffler for reducing air intake noise, the interference muffler being medially disposed in the intake channel, wherein the interference muffler is formed substantially in an L shape and is disposed above the throttle unit.

Thus, an opening is disposed in the engine cover, while an interference muffler (side branch) is medially disposed in the intake channel extending from the opening to the throttle unit. The interference muffler causes sound waves to branch out, the branched-out sound waves are made to interfere with the sound waves yet to be branched out, and the air intake noise is reduced. Therefore, a specific frequency band can be attenuated in accordance with the characteristics of the interference muffler. Accordingly, disposing an interference muffler in the intake channel allows the frequency band of the air intake noise generated by particularly high sound pressure in the exhaust noise to be attenuated by the interference muffler. Air intake noise can thereby be sufficiently reduced by the interference muffler when the air intake noise is generated in accompaniment with air intake pulsation or shockwaves of the engine.

The interference muffler (side branch) is a tube for branching sound waves and, in structural terms, can offer a high degree of freedom in shape selection. For example, the shape of the interference muffler can be a rectilinear shape, an L shape, or another shape that conforms to the arrangement location.

The outboard engine unit ordinarily has empty space (dead space) between the upper part of the engine cover and the throttle unit. This empty space is formed in a substantially rectangular shape in plan view. In view of this fact, the interference muffler is substantially L-shaped and the external dimensions of the interference muffler can be kept small to allow the interference muffler to be arranged in the empty space. Accordingly, the outboard engine unit can be made smaller because space for providing an interference muffler inside the engine cover does not need to be newly acquired.

In addition, forming the interference muffler substantially in an L shape allows the total length required in an interference muffler to be ensured while keeping the external dimensions of the interference muffler small. The total length required in an interference muffler can be ensured in accordance with the frequency band of the air intake noise generated by particularly high sound pressure in the exhaust noise, and the air intake noise can thereby be sufficiently reduced by the interference muffler.

In yet another aspect of the present invention, there is provided an outboard engine unit having an engine, an engine cover for covering the engine, a pair of openings formed in the upper two sides of the engine cover in order to introduce air into the engine cover, and a throttle unit into which air taken into the interior of the engine cover is introduced from the pair of openings, the outboard engine unit comprising: a pair of intake channels for guiding air directed from the pair of openings to the throttle unit, the pair of intake channels being disposed in the upper two sides inside the engine cover and respectively communicating with the pair of openings; and a pair of interference mufflers for reducing air intake noise, the pair of interference mufflers being medially disposed in a respective manner in the pair of intake channels, wherein each of the interference mufflers is formed substantially in an L shape, is integrally formed, and is arranged at the upper two sides of the throttle unit.

In the outboard engine unit, a pair of intake channels is provided, and a pair of interference mufflers is medially disposed in the pair of intake channels. Accordingly, the air intake noise of the pair of intake channels can be reduced by the pair of interference mufflers. The air intake noise generated when the engine is driven can thereby be sufficiently reduced by the pair of interference mufflers.

Furthermore, the pair of interference mufflers is substantially L-shaped and the pair of interference mufflers is integrally formed, whereby the overall shape of the pair of interference mufflers is formed substantially in a rectangular shape in plan view. The external dimensions of the integrally formed pair of interference mufflers are kept small. Accordingly, providing the pair of interference mufflers in the upper two sides of the throttle unit allows the pair of interference mufflers to be arranged in the empty space. The outboard engine unit can thereby be made smaller because the space for providing the pair of interference mufflers does not need to be newly acquired inside the engine cover.

In addition, forming the interference mufflers in substantially an L shape allows the total length required in the interference mufflers to be ensured while the external dimensions of the interference mufflers are kept small. The total length required in the interference mufflers can be ensured in accordance with the frequency band of the air intake noise generated by particularly high sound pressure in the exhaust noise, and the air intake noise can thereby be sufficiently reduced by the interference mufflers.

In another aspect of the present invention, there is provided an outboard engine unit having an engine, an engine cover for covering the engine, an opening formed in the engine cover in order to introduce air into the engine cover, and a throttle unit into which air taken into the interior of the engine cover is introduced from the opening, the outboard engine unit comprising: an intake channel for guiding air directed from the opening to the throttle unit, the intake channel being disposed inside the engine cover; and a silencer for reducing air intake noise, the silencer being medially disposed in the intake channel, wherein the intake channel is provided with channel redirection areas capable of guiding air directed from the opening in one direction toward redirection parts, redirecting the air at the redirection parts in another direction so that the air flows in the opposite direction, and guiding the redirected air in the other direction toward the silencer.

In the outboard engine unit, the opening of the engine cover is in communication with the throttle unit via the intake channel, and a silencer is medially disposed in the intake channel. Accordingly, the silencer causes the air (outside air) to expand and the air intake noise (i.e., sound pressure) can be reduced.

In addition, channel redirection areas are provided to the intake channel, the air directed from the opening is redirected at the redirection parts so as to flow in the opposite direction, and the redirected air can be guided to the silencer side. The total length of the intake channel can thus be increased because the channel redirection areas can be made longer by redirecting the channel redirection areas at the redirection parts. Accordingly, the air intake noise can be reduced in the intake channel due to the effect of attenuation by distance because the propagation distance of the air intake noise generated by the engine can be increased. In this way, the air intake noise is reduced by the silencer, after which the air intake noise can be further reduced due to the effect of attenuation by distance produced by the intake channel, and the air intake noise generated by the engine can therefore be sufficiently reduced. Air intake noise generated by the engine can thereby be advantageously prevented from being transmitted to the exterior of the engine cover via the intake channel.

Furthermore, providing redirection parts to the channel redirection areas allows water directed to (taken into) the intake channel together with the air from the opening to be separated from the air at the redirection parts. Providing the channel redirection areas to the intake channel makes it possible to increase the total length of the intake channel; therefore, water that has been directed into the intake channel from the opening can be separated from the air partway along the intake channel. In this manner, providing redirection parts to the channel redirection areas and increasing the total length of the intake channel allows water directed from the opening to the intake channel to be reliably separated from the air, and the entry of water into the throttle unit can be inhibited.

In addition, providing channel redirection areas to the intake channel and redirecting the channel redirection areas in the opposite direction at the redirection parts allows the intake channel to be made compact while the length of the intake channel is sufficiently ensured. The outboard engine unit ordinarily has an empty space (dead space) between the throttle unit and the upper part of the engine cover. Accordingly, making the intake channel compact allows the intake channel to be arranged in this empty space. Space for providing the intake channel does not need to be newly acquired inside the engine cover and the outboard engine unit can therefore be made smaller.

It is preferred that the intake channel have wall parts projecting from the sidewalls of the intake channel toward the center thereof so that air therein moves in serpentine fashion. Therefore, the total length of the intake channel can be increased. The propagation distance of the air intake noise generated by the engine can be further increased and the air intake noise can be even more advantageously reduced due to the effect of attenuation by distance. In addition, increasing the total length of the intake channel allows the water directed from the opening to the intake channel to be more reliably separated from the air. The entry of water into the throttle unit can thereby be even more advantageously inhibited.

In another aspect of the present invention, there is provided an outboard engine unit having an engine, an engine cover for covering the engine, a pair of openings formed in the upper two sides of the engine cover in order to introduce air into the engine cover, and a throttle unit into which air taken into the interior of the engine cover is introduced from the pair of openings, the outboard engine unit comprising: a pair of intake channels for guiding air directed from the pair of openings to the throttle unit, the pair of intake channels being disposed in the upper lateral sides inside the engine cover and, respectively communicating with the pair of openings; and a silencer for reducing air intake noise, the silencer being medially disposed in the pair of intake channels, wherein the pair of intake channels extends in one of a forward or rearward direction from the pair of openings to redirection parts, and extends in the other of the forward or rearward directions from the redirection parts to the throttle unit.

In the aspect described above, a pair of intake channels is provided and the pair of intake channels is redirected in the opposite direction at redirection parts. Redirecting the pair of intake channels at redirection parts in this manner allows the total length of the intake channels to be increased. Accordingly, air intake noise can be further reduced in the intake channels due to the effect of attenuation by distance because the propagation distance of the air intake noise generated by the engine can be increased. Air intake noise generated by the engine can thereby be more advantageously prevented from being transmitted to the exterior of the engine cover via the intake channels.

Redirecting the pair of intake channels in the opposite direction at the redirection parts allows the intake channels to be made compact (a small shape). Accordingly, the pair of intake channels can be arranged using the empty space between the throttle unit and the upper part of the engine cover. In this way, space for providing the pair of intake channels does not need to be newly acquired inside the engine cover and the outboard engine unit can therefore be made smaller.

BRIEF DESCRIPTION OF THE DRAWINGS

Several preferred embodiments of the present invention will be described in detail below, by way of example only, with reference to the accompanying drawings, in which.

DETAILED DESCRIPTION OF THE PREFERRED EMBODIMENTS

First Embodiment

Figure 1:
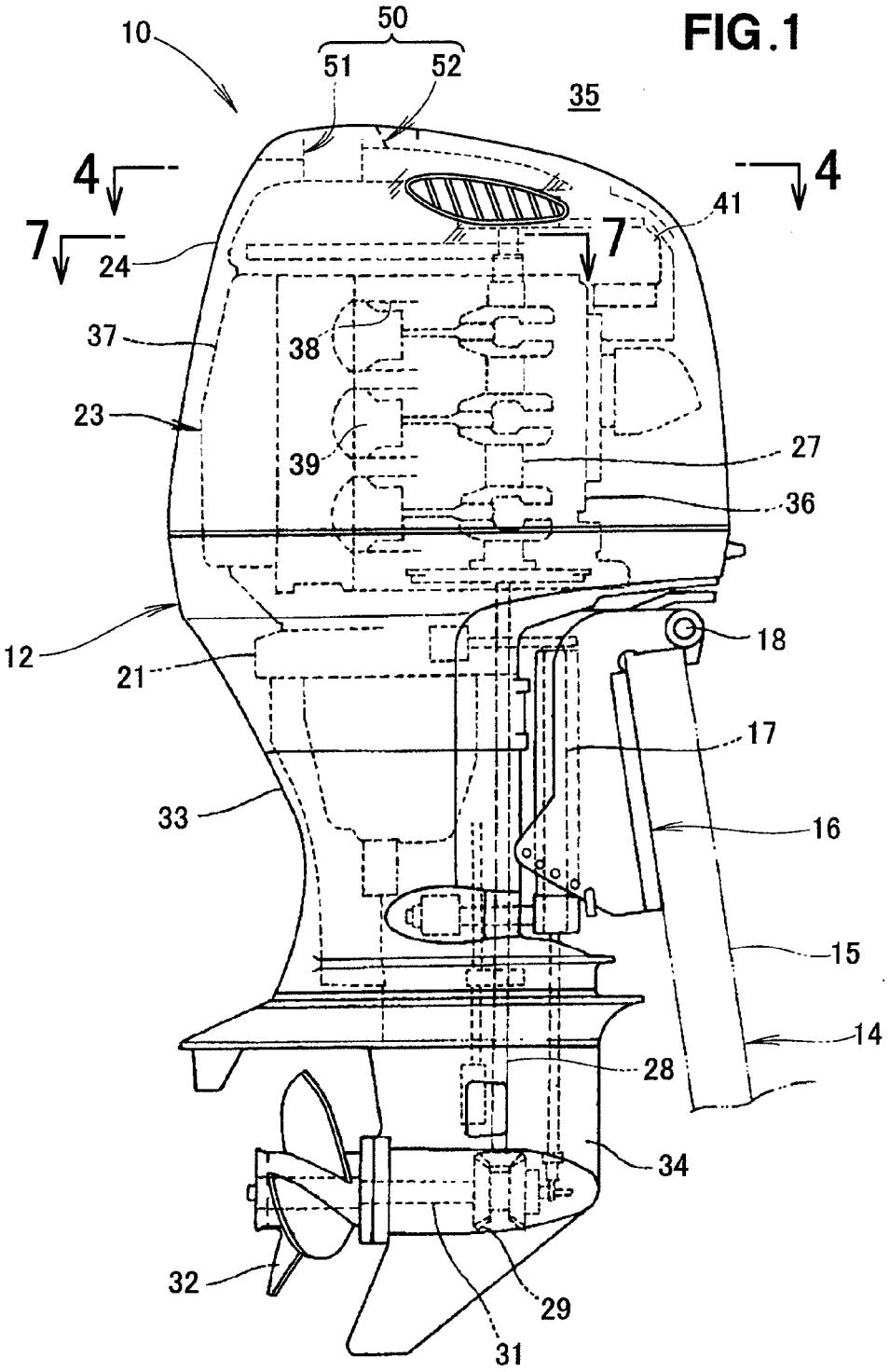
FIG. 1 is a side elevational view illustrating an outboard engine unit having a cooling/intake device according to a first embodiment of the present invention.

As shown in FIG. 1, the outboard engine unit 10 of a first embodiment is provided with an outboard engine unit body 12, and mounting means 16 detachable from a hull 14 (specifically, a stern 15), the mounting means being provided to the outboard engine unit body 12. The mounting means 16 is provided with a swivel shaft 17 for allowing the outboard engine unit body 12 to pivot in the lateral direction (horizontal direction), and a tilt shaft 18 for allowing the outboard engine unit body 12 to pivot in the vertical direction.

The outboard engine unit body 12 is provided with a mounting case 21 provided to the mounting means 16, an engine 23 equipped in the upper part of the mounting case 21, an engine cover 24 for covering the engine 23, a drive shaft 28 coaxially connected to a crankshaft 27 of the engine 23, a gear mechanism 29 to which the rotations of the engine 23 (crankshaft 27) are transmitted via the drive shaft 28, and a propeller 32 to which the rotations of the gear mechanism 29 are transmitted via a propeller shaft 31.

The outboard engine unit body 12 is furthermore provided with a cooling/intake device 50 for an outboard engine unit that can guide air from the exterior 35 of the engine cover 24 to the engine 23, and that can cool the interior 40 (see FIG. 3) of the engine cover 24.

The drive shaft 28 is covered by an extension case 33 disposed on the lower side of the mounting case 21. The gear mechanism 29 and the propeller shaft 31 are covered by a gear case 34 disposed on the lower side of the extension case 33.

The engine 23 is provided with: a cylinder block 36, a head cover 37, a crankshaft 27, cylinders 38, and pistons 39, which constitute the main engine unit; and auxiliary equipment 41 of the engine 23.

In the outboard engine unit 10, driving the engine 23 causes the rotation of the engine 23 to be transmitted to the propeller 32 via the drive shaft 28, the gear mechanism 29, and the propeller shaft 31; the propeller 32 to rotate, and the hull 14 to glide.

Figure 2:
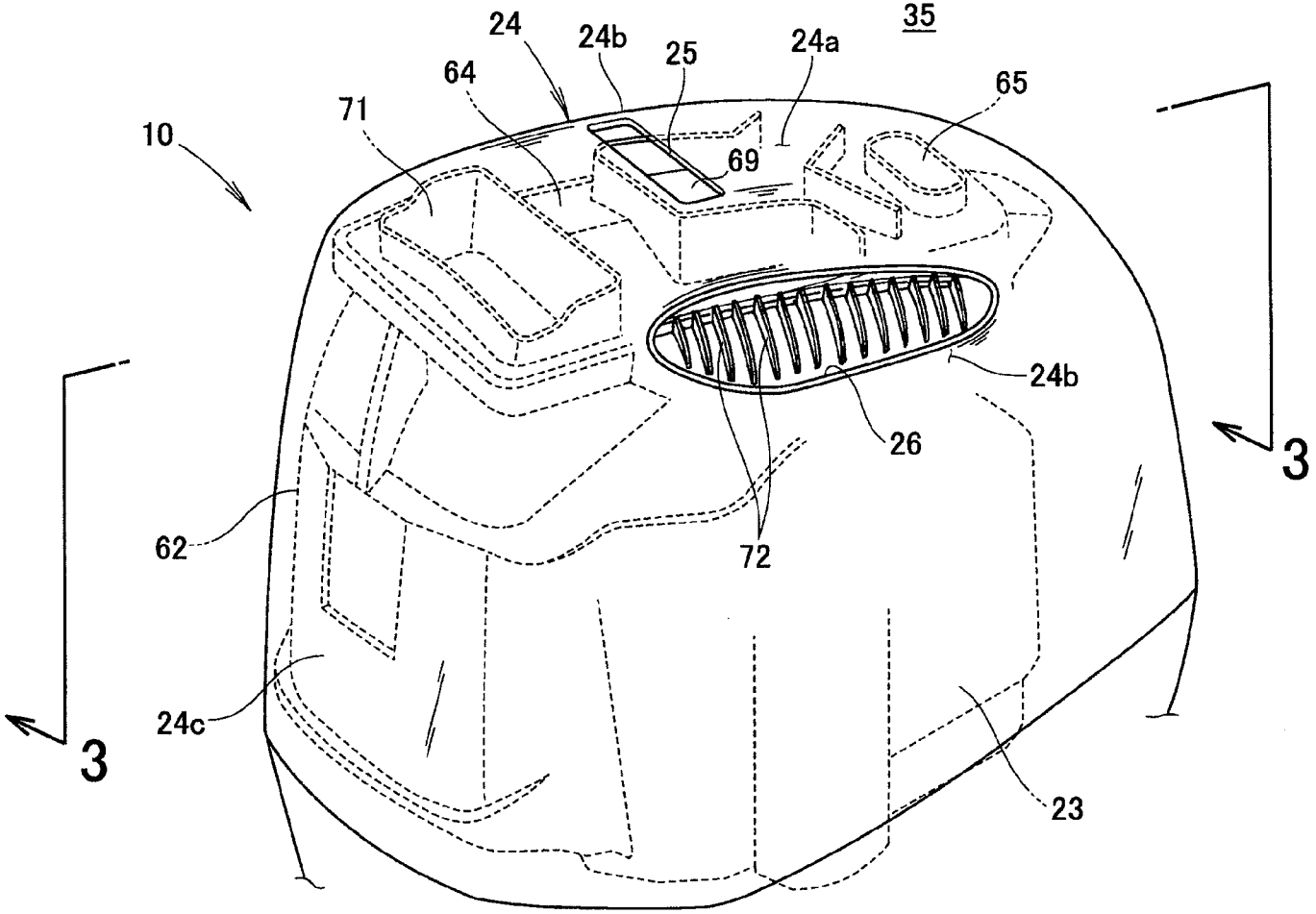
FIG. 2 is a perspective view showing the outboard engine unit of FIG. 1.
Figure 5:
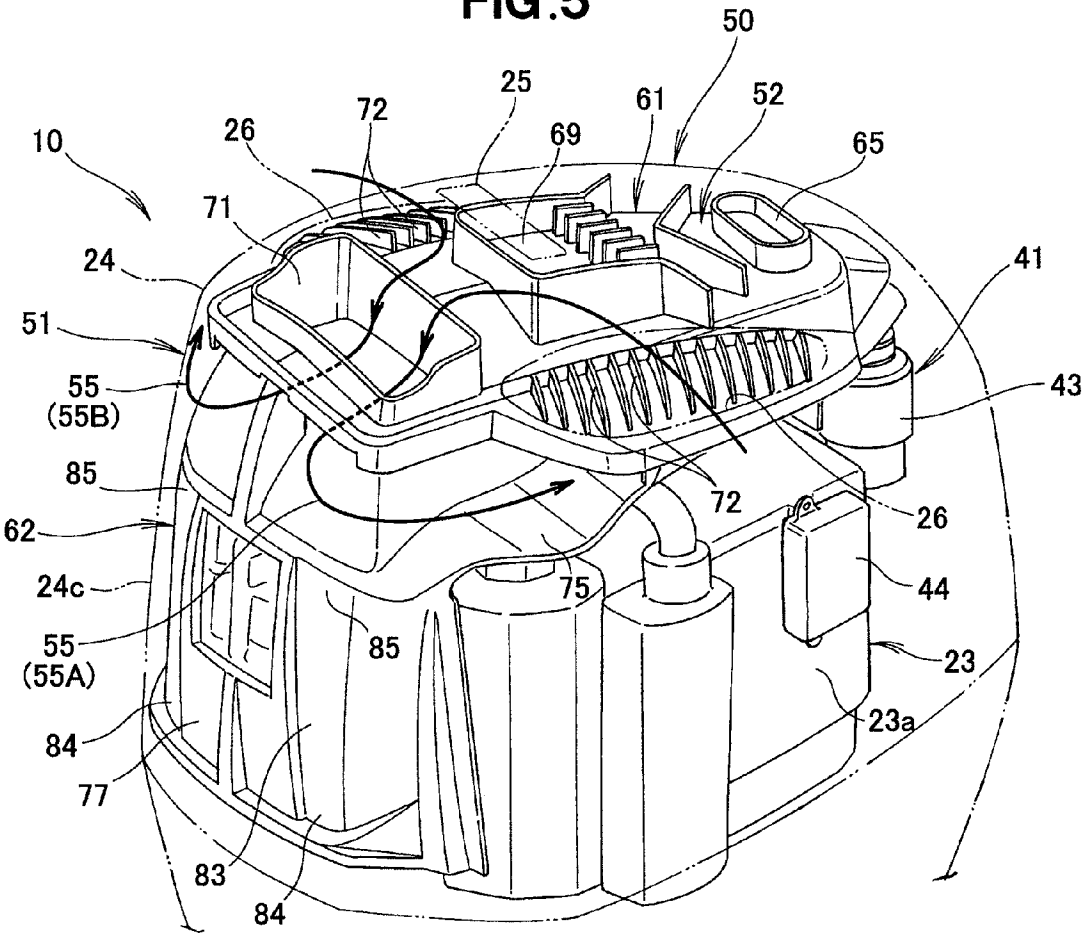
FIG. 5 is a perspective view showing the cooling/intake device of the outboard engine unit of FIG. 1.

As shown in FIG. 2, the engine cover 24 has intake openings 26 for drawing in air disposed in upper two side parts 24*b*, and has a cooling opening (opening) 25 disposed in a top part 24*a*. FIG. 5 shows the other intake opening 26 (opposite-side intake opening) of the intake openings 26 in the upper two side parts 24*b*. The intake openings 26 and the cooling opening 25 are described later in detail.

Figure 3:
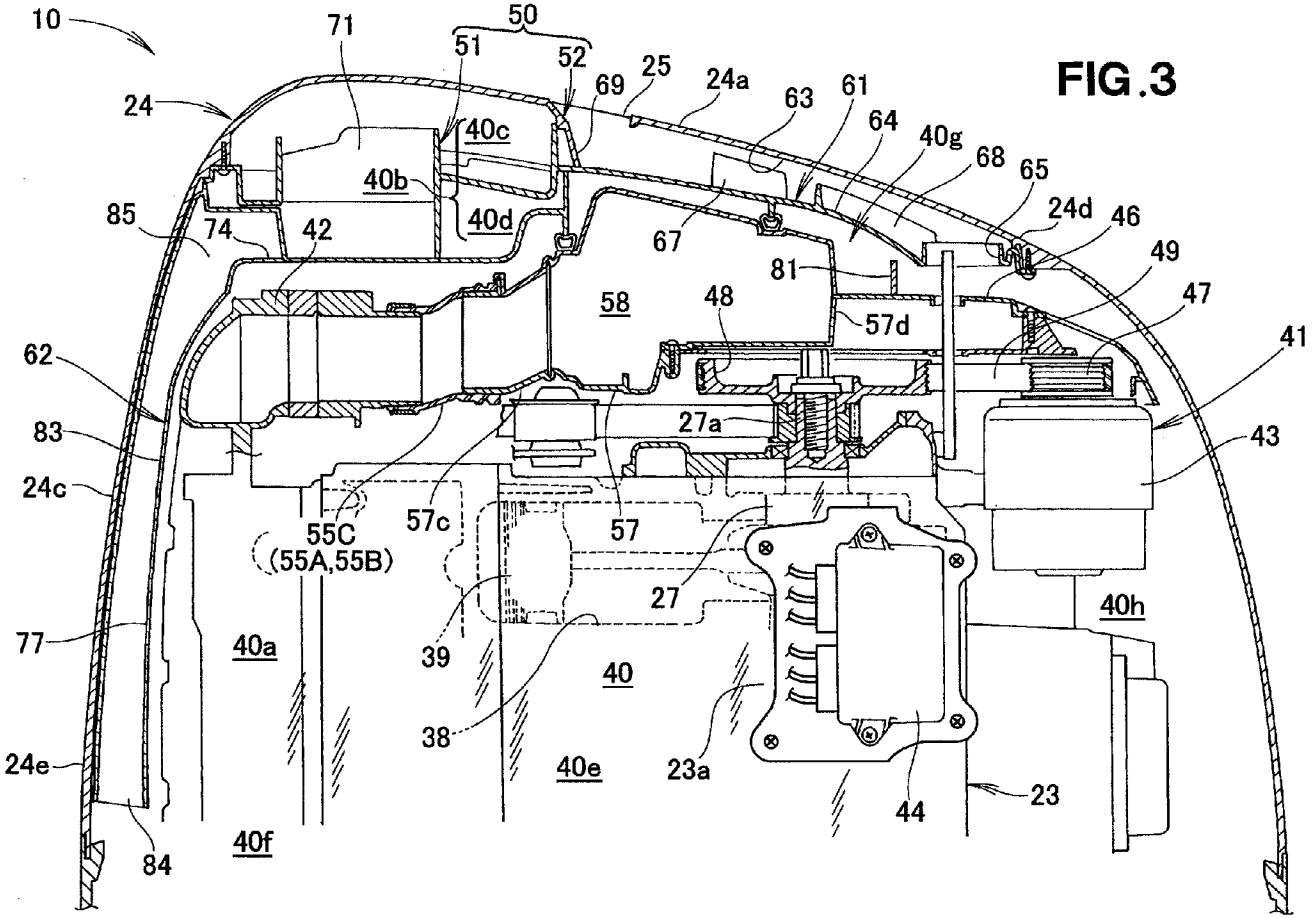
FIG. 3 is a cross-sectional view taken along line 3-3 of FIG. 2.
Figure 4:
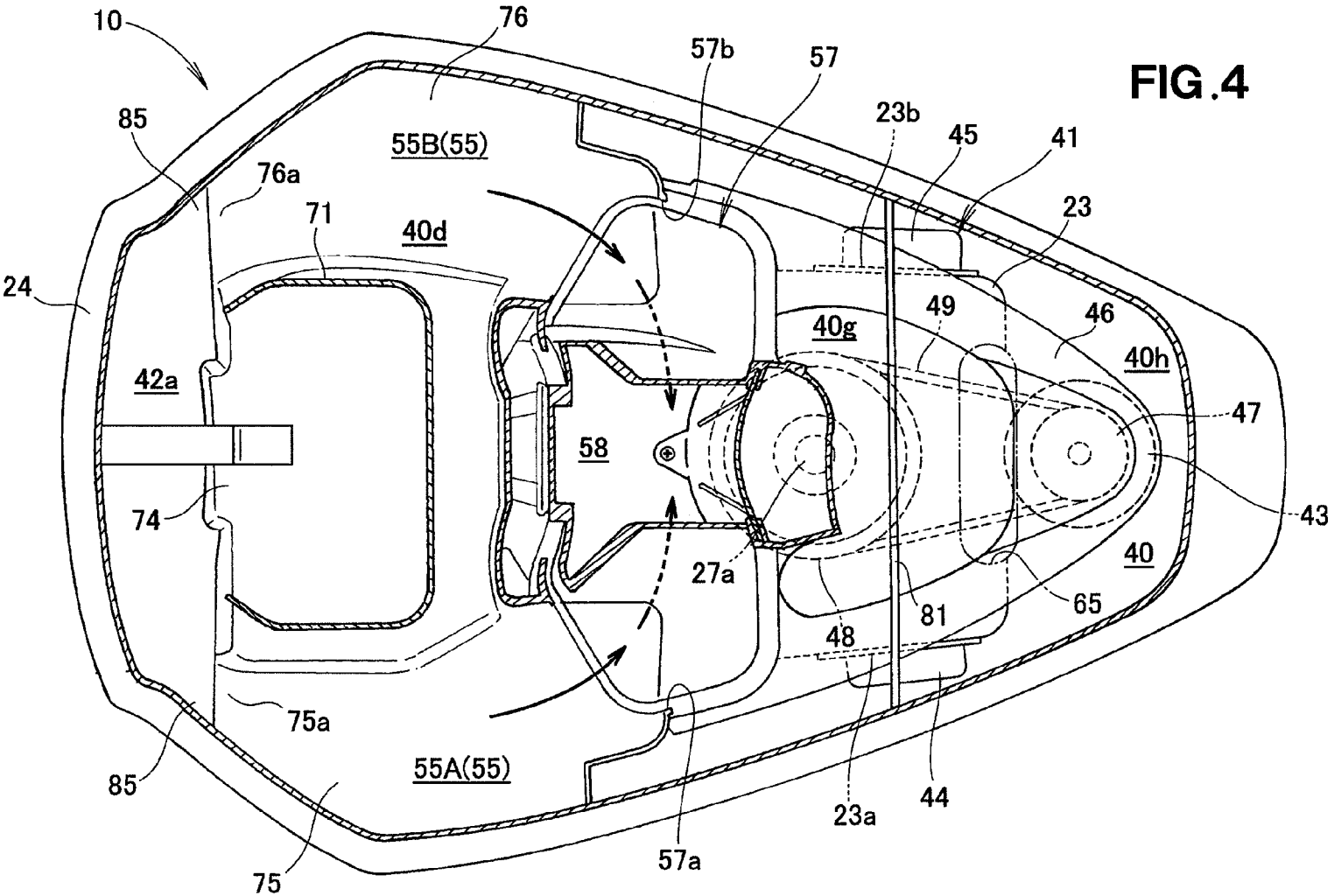
FIG. 4 is a cross-sectional view taken along line 4-4 of FIG. 1.

As shown in FIGS. 3 and 4, the auxiliary equipment 41 of the engine 23 is provided with a throttle unit 42 in communication with the combustion chambers of the engine 23, a power generator 43 provided on the opposite side (i.e., the front side) of the throttle unit 42, and a pair of electrical components 44, 45 (see FIG. 4 for the other electrical component 45) disposed rearward and below the power generator 43.

A drive pulley 48 is wound onto a drive pulley 48 and a driven pulley 47 of the power generator 43. The drive pulley 48 is disposed at the upper end 27*a* of the crankshaft 27. A belt cover 46 covers the area above the driven pulley 47, the drive pulley 48, and the drive belt 49. The belt cover 46 is disposed at the front end 57*d* of a silencer 57.

The drive pulley 48 is rotated by the rotation of the crankshaft 27. The rotation of the drive pulley 48 is transmitted to the driven pulley 47 via the drive belt 49. The power generator 43 is driven by the rotation of the driven pulley 47. The power generator 43 is disposed in front of the engine 23 in the interior 40 of the engine cover 24. The power generator 43 is furthermore disposed in front of a partition wall 81 below a first outlet 65 of a first cooling air intake channel 63.

The first electrical component 44 and the second electrical component 45 are symmetrically disposed in lateral positions 23*a*, 23*b*, respectively, of the engine 23. The first electrical component 44 is disposed on the right front side part 23*a* of the engine 23 in the interior 40 of the engine cover 24. The first electrical component 44 is thereby disposed to the right and rear of the power generator 43 and vertically below the partition wall 81. The second electrical component 45 is disposed on the left front side part 23*b* of the engine 23, in the interior 40 of the engine cover 24. The second electrical component 45 is thereby disposed to the left and rear of the power generator 43 and vertically below the partition wall 81.

The cooling/intake device 50 is provided with intake means 51 for directing air from the exterior 35 of the engine cover 24 to the engine 23, and cooling means 52 for guiding air from the exterior 35 of the engine cover 24 to the interior 40 of the engine cover 24. The cooling/intake device 50 is provided with a function for directing air to the combustion chambers of the engine 23 with the aid of the intake means 51, and a function for directing air into the engine cover 24 with the aid of the cooling means 52 to cool the interior of the engine cover 24.

Figure 6:
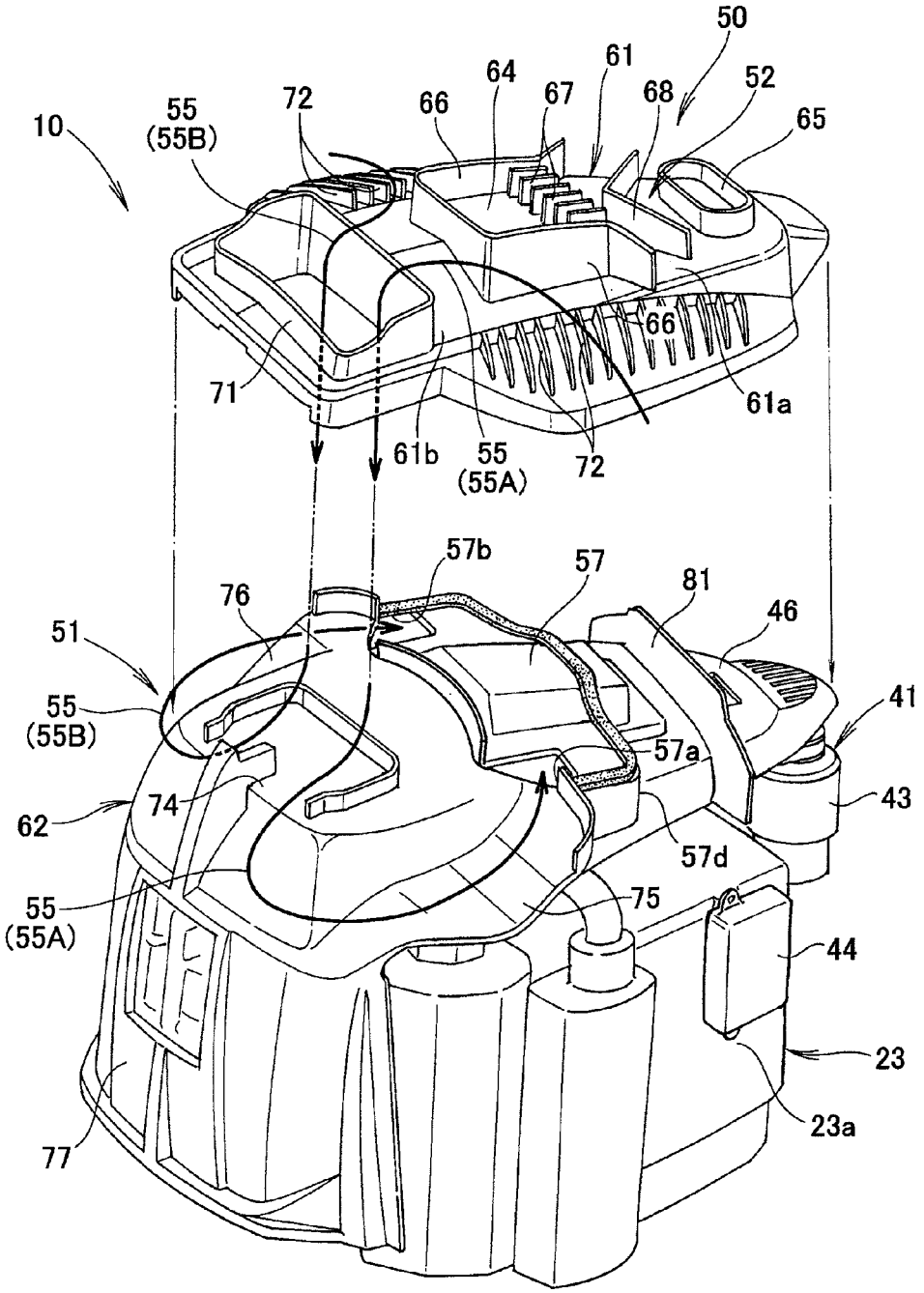
FIG. 6 is an exploded perspective view illustrating the cooling/intake device of FIG. 5.

As shown in FIGS. 5 and 6, the intake means 51 is provided with an intake channel 55 for guiding air to the throttle unit 42 (FIG. 3) from the exterior of the engine cover 24, and a silencer 57 is medially disposed in the intake channel 55.

Figure 7:
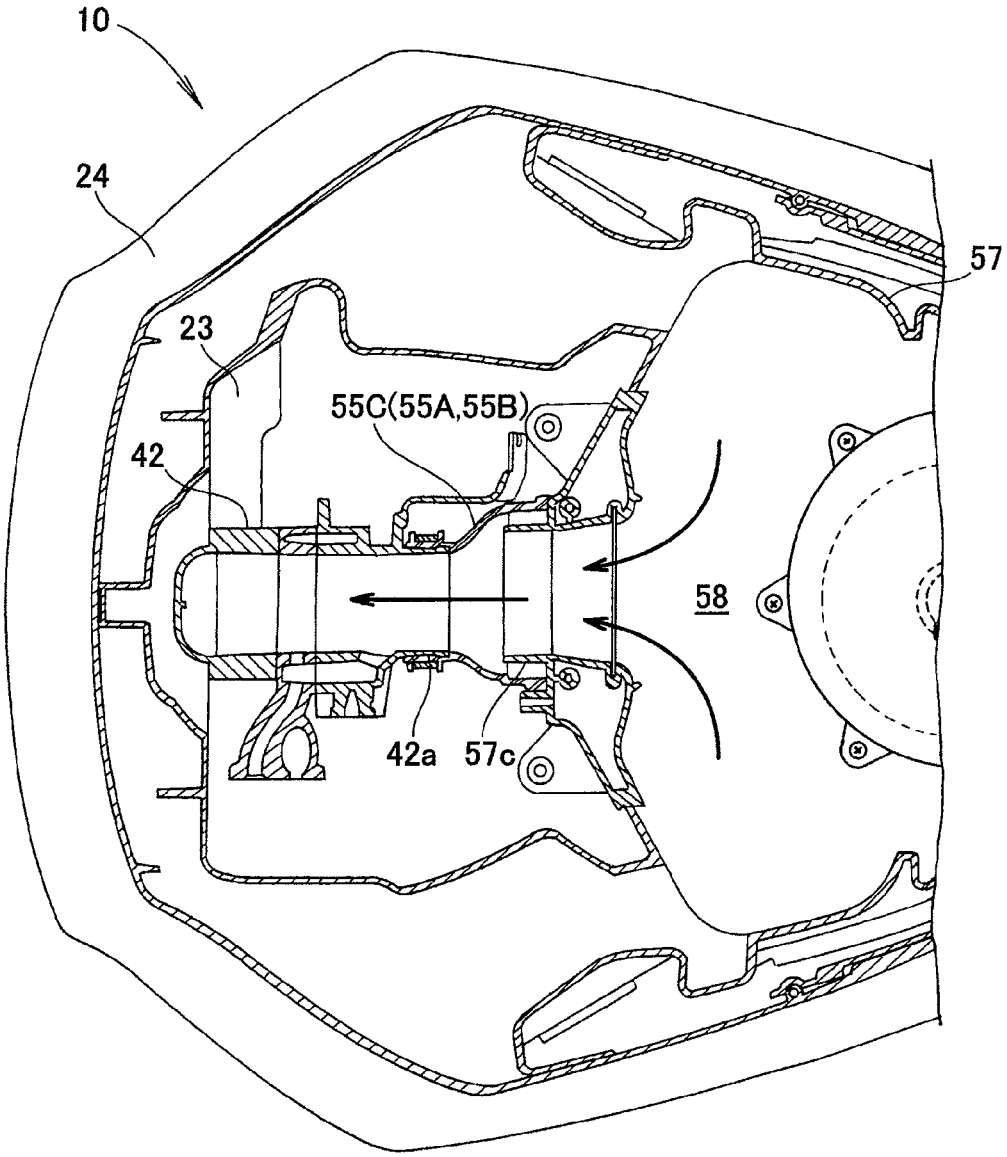
FIG. 7 is an enlarged cross-sectional view taken along line 7-7 of FIG. 1.

The intake channel 55 is a channel that can introduce air taken into the engine cover 24 from the intake openings 26 on the upper two sides of the engine cover 24 to the throttle unit 42. The intake channel 55 is formed by the engine cover 24, an air guide 61, a rear duct 62, and the like, and is provided with two channel systems, i.e., a pair of intake channels 55A, 55B (first intake channel 55A and second intake channel 55B), as indicated by the arrow. Here, as shown in FIG. 7, the first intake channel 55A and the second intake channel 55B each have integrally formed downstream channels that constitute a downstream intake channel 55C. The silencer 57 and the throttle unit 42 are placed in communication with each other by the downstream intake channel 55C, which is integrally formed by the first intake channel 55A and the second intake channel 55B.

Returning to FIGS. 5 and 6, the first intake channel 55A is a channel for guiding air introduced from one of the intake openings 26 of the engine cover 24 to the throttle unit 42 (see FIG. 7) via the silencer 57. The second intake channel 55B guides air introduced from the other intake opening 26 of the engine cover 24 to the throttle unit 42 via the silencer 57.

As shown in FIGS. 3 and 6, the air guide 61 is a member disposed along the reverse surface side of the top part 24*a* of the engine cover 24 and is thereby a member for forming the first cooling air intake channel (first intake channel) 63. The first cooling air intake channel 63 is described later in detail.

The air guide 61 is provided with a guide bottom part 64 disposed along the top part 24*a* of the engine cover 24, a first outlet 65 disposed at the front end of the guide bottom part 64, a sidewall 66 disposed behind the first outlet 65, and first and second guide plates 67, 68 disposed between the sidewall 66 and the first outlet 65. The first outlet 65 forms the outlet of the first cooling air intake channel 63. The sidewall 66 forms the sidewall of the first cooling air intake channel 63.

The space between the guide bottom part 64 and the top part 24*a* of the engine cover 24 is covered by the sidewall 66, whereby the first cooling air intake channel 63 is formed between the engine cover 24 and the front half 61*a* of the air guide 61. First and second guide plates 67, 68 are disposed in the first cooling air intake channel 63, whereby air directed into the first cooling air intake channel 63 from the intake openings 26 can be smoothly guided toward the first outlet 65 by the first and second guide plates 67, 68.

Furthermore, the air guide 61 is provided with an intake guide part 71 disposed in the rear end part of the guide bottom part 64, and a plurality of guide plates 72 disposed at both ends of the guide bottom part 64. As shown in FIG. 5, the plurality of guide plates 72 is disposed in locations corresponding to the intake openings 26 in the upper two sides, the locations being where water is separated from the air taken in from the intake openings 26.

As shown in FIGS. 3 and 6, the intake guide part 71 is medially disposed in the intake channel 55. The intake guide part 71 is a substantially rectangular and cylindrical channel disposed in the rear end of the guide bottom part 64 in the longitudinal direction. The intake guide part 71 is disposed in a space 40*b* above a rear interior 40*a* of the engine cover 24. The upper space 40*b* is divided into an upper guide space 40*c* and a lower guide space (upper space) 40*d* by the guide bottom part 64. The lower guide space 40*d* is a space disposed above the rear interior 40*a* of the engine cover 24. The upper guide space 40*c* is in communication with the lower guide space 40*d* via the intake guide part 71. Accordingly, air taken into the upper guide space 40*c* from the intake openings 26 is guided downward to the lower guide space 40*d* via the intake guide part 71.

The rear duct 62 is disposed below a rear half 61*b* of the air guide 61. The rear duct 62 is disposed downstream of the intake guide part 71 and to the side of the rear wall 24*c* of the engine cover 24. The rear duct 62 is provided with a guide port 74 disposed below the rear half 61*b* of the air guide 61 and is in communication with the intake guide part 71, a first side guide part 75 disposed to one side of the guide port 74, a second side guide part 76 disposed to the other side of the guide port 74, and a rear guide part 77 disposed along the rear wall 24*c* of the engine cover 24.

As shown in FIGS. 4 and 6, the first side guide part 75 extends from the guide port 74 to a first inlet 57*a* of the silencer 57, and forms a portion of the first intake channel 55A. In other words, the silencer 57 is in communication at an intermediate point in the first intake channel 55A. The second side guide part 76 extends from the guide port 74 to a second inlet 57*b* of the silencer 57, and forms a portion of the second intake channel 55B. In other words, the silencer 57 is in communication at an intermediate point in the second intake channel 55B. Accordingly, the silencer 57 is dually used as a channel for the first intake channel 55A and the second intake channel 55B.

As shown in FIGS. 3, 4, and 7, the silencer 57 is provided with a silencer chamber (expansion chamber) 58. The silencer chamber 58 of the silencer 57 is configured so that the first inlet 57*a* is in communication with the first intake channel 55A at an intermediate point and the second inlet 57*b* is in communication with the second intake channel 55B at an intermediate point. The intermediate point in the first intake channel 55A and the intermediate point in the second intake channel 55B are disposed in the lower guide space 40*d* of the rear interior 40*a* of the engine cover 24. Accordingly, the silencer chamber 58 of the silencer 57 is in communication with the lower guide space 40*d* inside the engine cover 24. The silencer chamber 58 of the silencer 57 has an outlet 57*c* in communication with the throttle unit 42 via the downstream intake channel 55C. Accordingly, air guided by the first intake channel 55A is directed as indicated by the arrow to the silencer chamber 58 via the first inlet 57*a*. The air guided by the second intake channel 55B is directed as indicated by the arrow to the silencer chamber 58 via the second inlet 57*b*. The air directed to the silencer chamber 58 is directed as indicated by the arrow to the throttle unit 42 via the other outlet 57*c* and the downstream intake channel 55C. The silencer 57 has a function for reducing an intake noise generated in accompaniment with air intake pulsation or shockwaves when the engine 23 is driven.

The downstream end part of the throttle unit 42 is in communication with the combustion chambers of the engine 23. The throttle unit 42 has a downstream end part 42*a* (FIG. 7) that is in communication with the lower guide space 40*d* inside the engine cover 24 via the silencer 57.

As shown in FIG. 3, the cooling means 52 is provided with the cooling opening 25 disposed in the top part 24*a* of the engine cover 24, the first cooling air intake channel (first intake channel) 63 in communication with the cooling opening 25, the partition wall 81 disposed below the first cooling air intake channel 63, and a second cooling air intake channel (second intake channel) 83 extended substantially in the perpendicular direction along the rear wall 24*c* of the engine cover 24.

The cooling opening 25 is disposed substantially in the longitudinal center and substantially in the lateral center (see FIG. 2) of the top part 24*a* of the engine cover 24, and is in communication with a first inlet 69 of the first cooling air intake channel 63.

The first cooling air intake channel 63 extends from the first inlet 69 to the upper front end part 24*d* of the engine cover 24 along the upper interior part of the engine cover 24, the first inlet 69 being in communication with the cooling opening 25, and the first outlet 65 being open to the upper front end part 24*d*. The first outlet 65 is arranged above the power generator 43 and in a position slightly offset rearward in relation to the power generator 43. Furthermore, the first outlet 65 is arranged between the pair of electrical components (the second electrical component 45 is shown in FIG. 4) 44, 45 and above the pair of electrical components 44, 45.

As shown in FIGS. 3 and 6, the partition wall 81 is provided to the upper surface of the belt cover 46, and is oriented substantially laterally and vertically in the outboard engine unit 10, and is a plate-shaped dividing wall arranged adjacent to the first outlet 65 to the rear and below. Accordingly, a space 40*g* between the guide bottom part 64 and the belt cover 46 is divided from a space 40*h* on the power generator 43 side by the partition wall 81, in a position adjacent to the first outlet 65 to the rear and below (also, see FIG. 4). The space 40*h* on the power generator 43 side faces the first outlet 65. Accordingly, air (outside air) directed out from the first outlet 65 is prevented by the partition wall 81 from flowing into the space 40*g*. Air directed out from the first outlet 65 is thereby guided by the partition wall 81 toward the power generator 43 below the engine cover 24 and the pair of electrical components 44, 45.

As shown in FIGS. 3 and 5, the rear guide part 77 of the rear duct 62 extends substantially in the perpendicular direction with a predetermined interval to the forward side in relation to the rear wall 24*c* of the engine cover 24, whereby the second cooling air intake channel 83 is formed by the rear wall 24*c* and the rear guide part 77.

The second cooling air intake channel 83 extends substantially in the perpendicular direction along the rear wall 24*c* of the engine cover 24, and has a second inlet 84 disposed in the lower end part and a second outlet 85 disposed in the upper end part. As shown in FIG. 4, the second outlet 85 of the second cooling air intake channel 83 is disposed in the lower guide space 40*d* by facing a front upper surface 75*a* of the first side guide part 75 and by facing the front upper surface 76*a* of the second side guide part 76.

The first side guide part 75 constitutes an intermediate part of the first intake channel 55A. The second side guide part 76 constitutes an intermediate part of the second intake channel 55B. Accordingly, the second outlet 85 of the second cooling air intake channel 83 is in communication with an intermediate point of the first intake channel 55A and is in communication with an intermediate part of the second intake channel 55B. Hence, the second outlet 85 of the second cooling air intake channel 83 is in communication with the throttle unit 42 (see FIG. 3) via the first intake channel 55A and the silencer 57. Furthermore, the second outlet 85 is in communication with the throttle unit 42 via the second intake channel 55B and the silencer 57. In other words, as shown in FIG. 3, the second outlet 85 in communication with the throttle unit 42 is disposed in the lower guide space 40*d* of the rear interior 40*a* of the engine cover 24.

In the second cooling air intake channel 83, the second inlet 84 is arranged in a lower part 24*e* of the rear wall 24*c*. The second inlet 84 of the second cooling air intake channel 83 is positioned in the lower part 24*e* of the rear wall 24*c* and is thereby in communication with the lower rear-side interior (lower-side interior) 40*f*, which is in a lower-side interior 40*e* of the engine cover 24 and adjacent to the rear wall 24*c*. In other words, the second cooling air intake channel 83 provides communication between the lower rear-side interior 40*f* of the engine cover 24 and the throttle unit 42. The lower rear-side interior 40*f* is positioned behind and below the power generator 43 and the pair of electrical components 44, 45.

Next, an example of directing air taken in from the exterior 35 of the engine cover 24 by the intake means 51 of the cooling/intake device 50 to the throttle unit 42 will be described with reference to FIGS. 8A, 8B, 9A, and 9B. The air flow directions in FIGS. 8A to 9B are indicated by arrows.

Figure 8A:
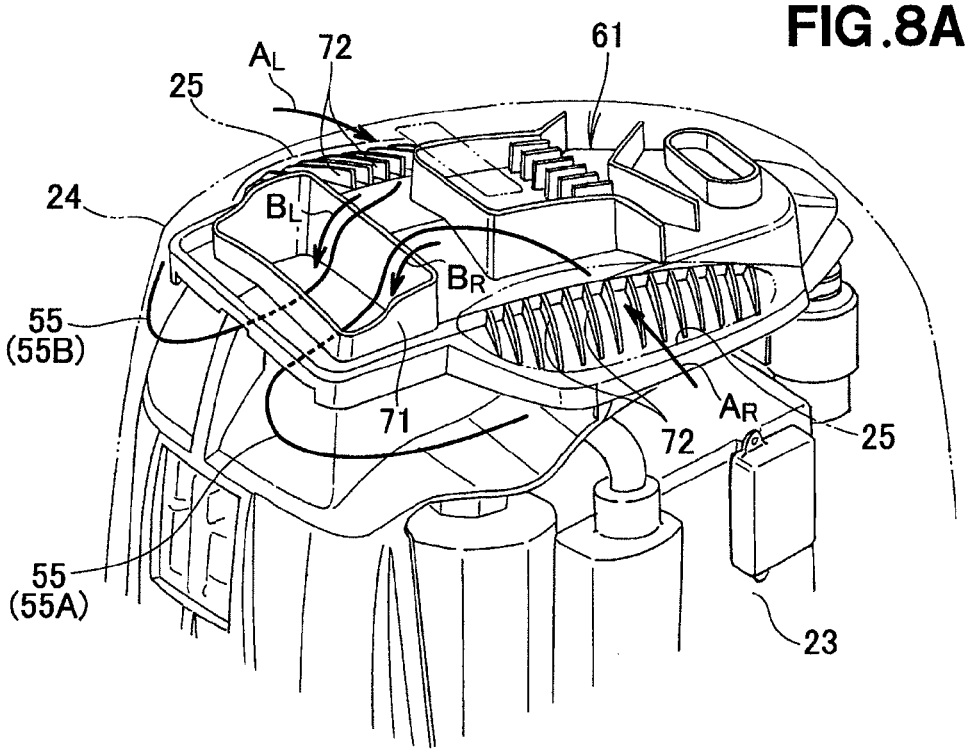
FIGS. 8A and 8B illustrate an example of directing air taken in from the exterior of an engine cover to a silencer.

As shown in FIG. 8A, driving the engine 23 directs air from one intake opening 26 in the engine cover 24 toward the right side of the air guide 61 as indicated by the arrow $A_R$. At the same time, air is directed from another intake opening 26 in the engine cover 24 toward the left side of the air guide 61 as indicated by the arrow $A_L$. The flow of air directed as indicated by the arrow $A_R$ from the one intake opening 26 is described in detail below.

Air taken in from the one intake opening 26 is directed to the first intake channel 55A inside the engine cover 24 via one of the guide plates 72. The air directed to the first intake channel 55A is directed downward as indicated by the arrow $B_R$ toward the interior of the intake guide part 71.

Figure 8B:
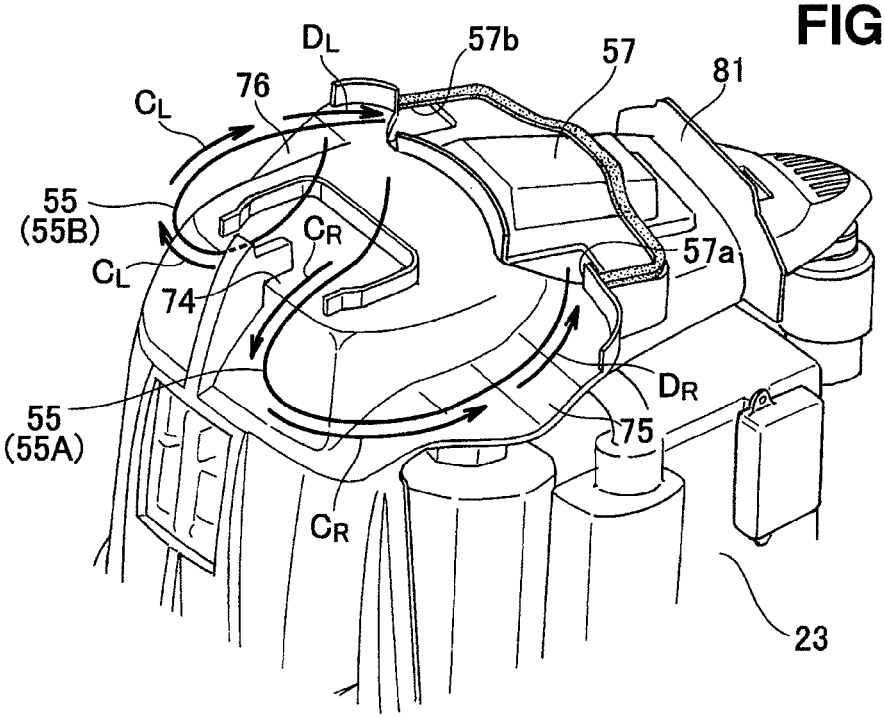

As shown in FIG. 8B, the air directed into the intake guide part 71 (FIG. 8A) is directed laterally as indicated by the arrow $C_R$ toward the first side guide part 75 via the guide port 74. Air directed to the first side guide part 75 is directed as indicated by the arrow $D_R$ toward the first inlet 57*a* of the silencer 57 via the first side guide part 75.

Figure 9A:
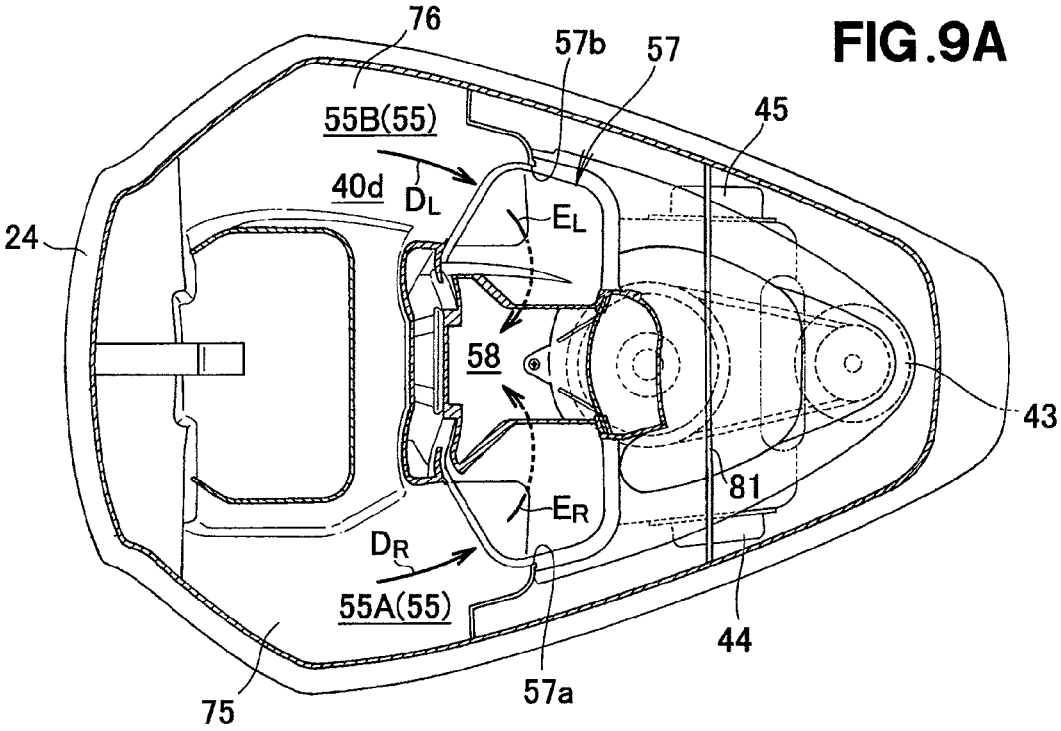
FIGS. 9A and 9B illustrate an example of directing air to the engine via the silencer.

As shown in FIG. 9A, the air directed toward the first inlet 57*a* is directed as indicated by the arrow $E_R$ to the silencer chamber 58 of the silencer 57 via the first inlet 57*a*.

Figure 9B:
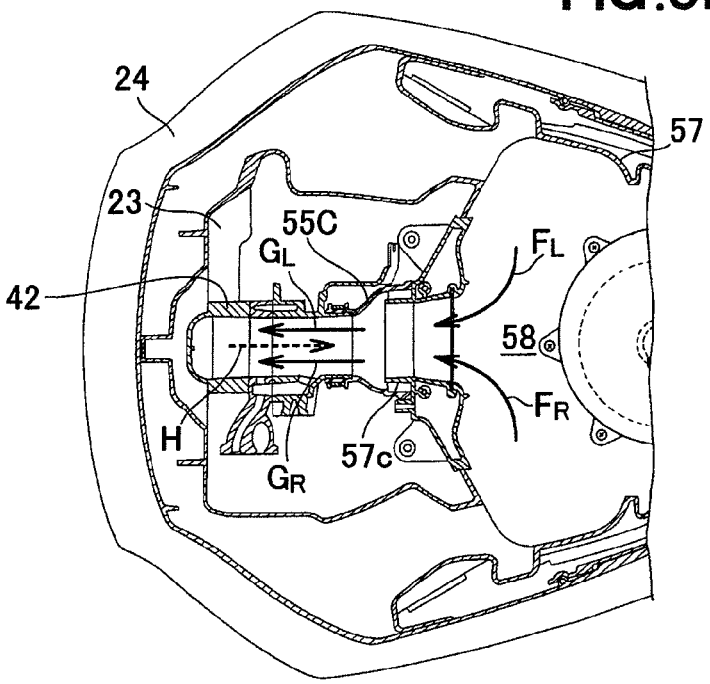

As shown in FIG. 9B, the air directed to the silencer chamber 58 is directed as indicated by the arrow $F_R$ toward the outlet 57*c* of the silencer 57. The air directed to the outlet 57*c* of the silencer 57 is directed as indicated by the arrow $G_R$ from the downstream intake channel 55C to the throttle unit 42, and is furthermore directed to the combustion chambers of the engine 23 via the throttle unit 42.

In reference to FIG. 8A, the air directed as indicated by the arrow $A_L$ from the other intake opening 26 is directed downward as indicated by the arrow $B_L$ to the second intake channel 55B in the same manner as the air directed as indicated by the arrow $A_R$ from the right intake opening 26.

As shown in FIGS. 8B, 9A, and 9B, the air directed to the second intake channel 55B is directed to the combustion chambers of the engine 23 via the throttle unit 42 as indicated by the arrows $C_L$, $D_L$, $E_L$, $F_L$, and $G_L$, in the same manner as the air directed to the first intake channel 55A.

Here, an example of using a silencer 57 to reduce the air intake noise generated in accompaniment with air intake pulsation or shockwaves when the engine 23 is driven is described with reference to FIGS. 9A and 9B. The direction in which the air intake noise is transmitted in FIG. 9B is shown by an arrow (broken line).

As shown in FIG. 9B, air intake noise is generated in accompaniment with air intake pulsation or shockwaves when the engine 23 is driven. The generated air intake noise is transmitted as indicated by the arrow H toward the silencer chamber 58 of the silencer 57 via the throttle unit 42. The air directed to the silencer chamber 58 expands and the flow rate is reduced. Accordingly, the sound pressure of the air intake noise transmitted to the silencer chamber 58 is reduced and the intake noise is attenuated and reduced.

Next, an example of cooling the interior of the engine cover 24 using the cooling means 52 of the cooling/intake device 50 will be described with reference to FIGS. 10A to 12B.

Figure 10A:
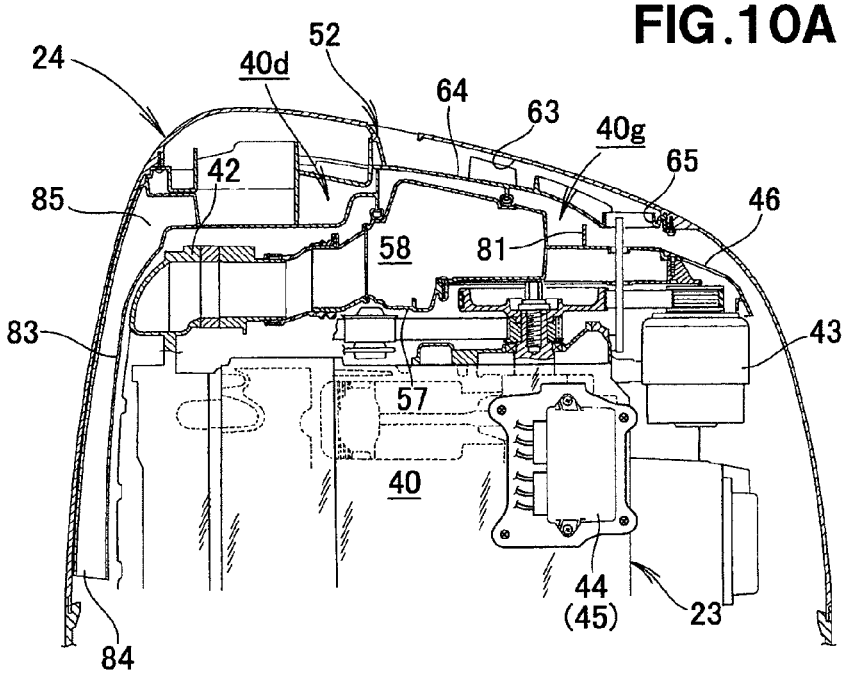
FIGS. 10A and 10B illustrate an example of air being taken in by cooling means from the exterior of the engine cover.

As shown in FIG. 10A, the throttle unit 42 is in communication with the silencer chamber 58 of the silencer 57 and the second cooling air intake channel 83 via the lower guide space (upper space) 40*d* of the engine cover 24. Accordingly, the engine 23 is driven and the air in the lower guide space 40*d* is thereby taken into the throttle unit 42. The air in the engine cover 24 (interior 40) is directed to the throttle unit 42 via the lower guide space 40*d* and the second cooling air intake channel 83 from the second inlet 84 of the second cooling air intake channel 83.

Figure 10B:
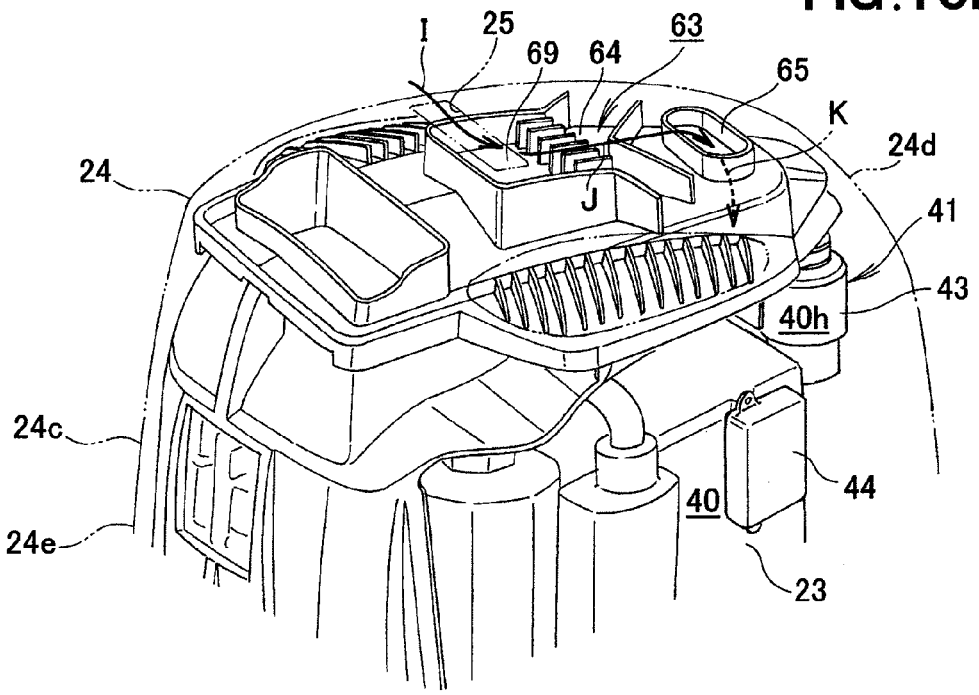

As shown in FIG. 10B, air in the interior 40 is taken into the throttle unit 42 and is thereby directed as indicated by the arrow I from the cooling opening 25 of the engine cover 24 to the first inlet 69 of the first cooling air intake channel 63. The air directed to the first inlet 69 is directed as indicated by the arrow J to the first outlet 65 via the first cooling air intake channel 63. The air directed to the first outlet 65 passes through the first outlet 65 and is directed downward as indicated by the arrow K toward the space on the upper front end part 24*d* side of the interior 40 of the engine cover 24.

Figure 11:
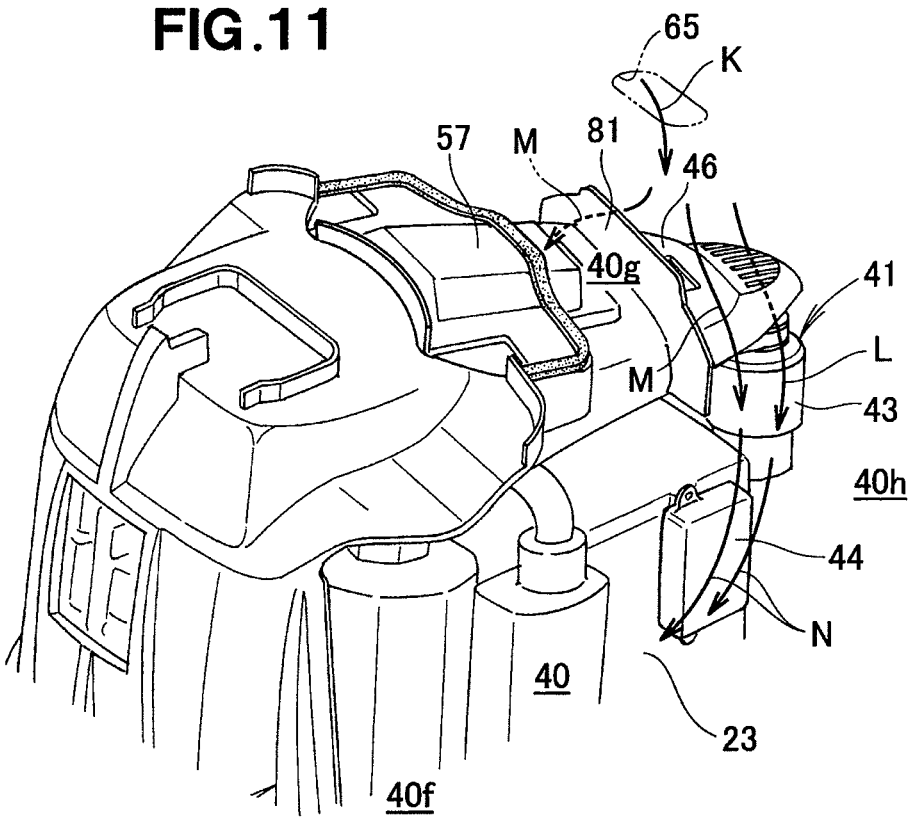
FIG. 11 is a perspective view showing an example of cooling a power generator with the cooling means.

As shown in FIG. 11, the air directed to the space on the upper front end part 24*d* (FIG. 10B) side of the interior 40 is blocked by the partition wall 81 from being directed to the space 40*g* between the guide bottom part 64 (FIG. 10A) and the belt cover 46. In other words, the air directed to the space on the upper front end part 24*d* side of the interior 40 is guided downward by the partition wall 81 as indicated by the arrow L toward the space 40*h* on the upper front end part 24*d* side.

The power generator 43 is disposed in the space 40*h* of the upper front end part 24*d* side. Accordingly, a portion of the air guided downward is directed as indicated by the arrow L toward the power generator 43, and the remaining air is directed as indicated by the arrow M toward the pair of electrical components 44, 45. The power generator 43 can be cooled by the air directed as indicated by the arrow L toward the power generator 43.

Figure 12A:
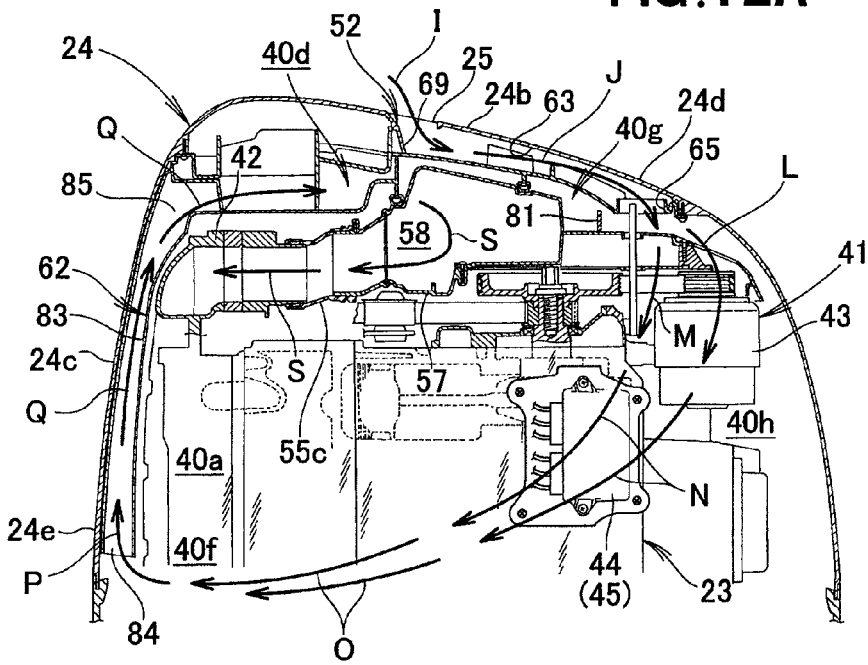
FIGS. 12A and 12B are views showing an example of cooling the interior of the engine cover using the cooling means.
Figure 12B:
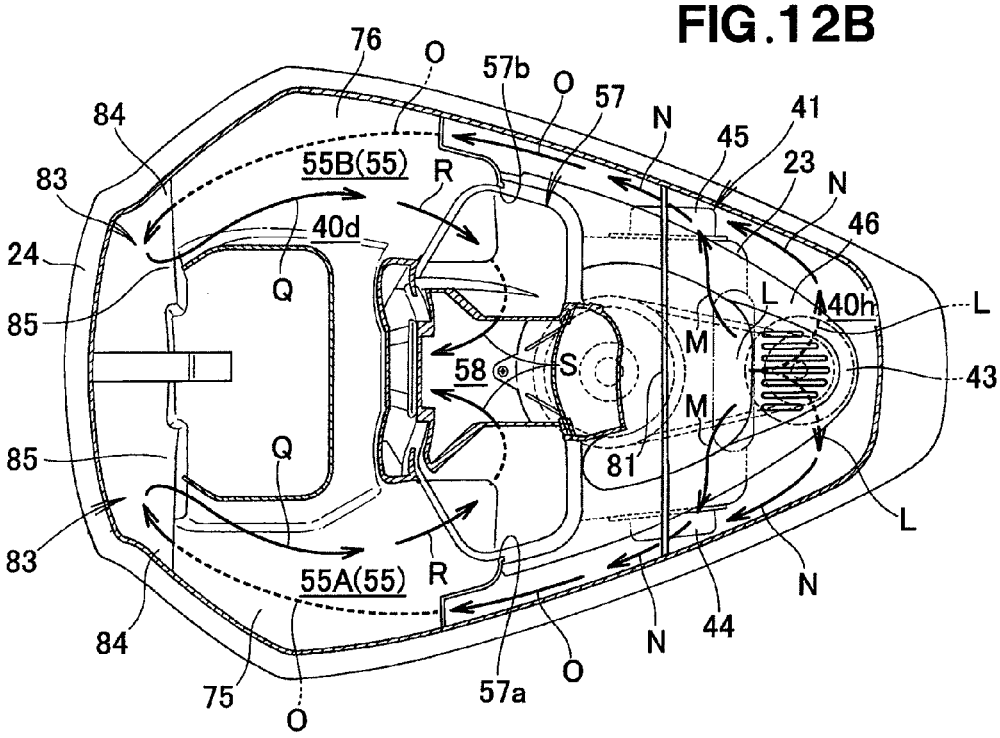

As shown in FIGS. 12A and 12B, the pair of electrical components 44, 45 is disposed behind the power generator 43 and below the partition wall 81 in the perpendicular direction. The second inlet 84 of the second cooling air intake channel 83 is arranged substantially on a diagonal line with the first outlet 65. Furthermore, the second inlet 84 is in communication with the lower rear-side interior 40*f* adjacent to the rear wall 24*c* (specifically, the lower part 24*e*) of the engine cover 24. Accordingly, the air that has cooled the power generator 43 or the air guided toward the pair of electrical components 44, 45 can be reliably directed as indicated by the arrow N to the pair of electrical components 44, 45. The pair of electrical components 44, 45 can thereby be cooled by the air directed to the pair of electrical components 44, 45.

The air which has cooled the pair of electrical components 44, 45 is directed as indicated by the arrow O toward the lower rear-side interior 40*f*. The air directed to the lower rear-side interior 40*f* is directed as indicated by the arrow P to the second cooling air intake channel 83 via the second inlet 84. The air directed to the second cooling air intake channel 83 is directed as indicated by the arrow Q to the upper space (lower guide space) 40*d* via the second outlet 85 of the second cooling air intake channel 83.

The intermediate part of the first intake channel 55A and the intermediate part of the second intake channel 55B are disposed in the upper space 40*d*. Accordingly, air directed from the second outlet 85 to the upper space 40*d* is directed as indicated by the arrow R to the silencer chamber 58 of the silencer 57 together with air directed from the pair of intake channels 55A, 55B. The air directed to the silencer chamber 58 is directed as indicated by the arrow S to the throttle unit 42 via the outlet 57*c* of the silencer chamber 58 and the downstream intake channel 55C.

As described above, the air taken into the engine cover 24 from the first outlet 65 is guided downward (front-side lower area) from the upper front end part 24*d* of the engine cover 24, and the air guided to the front-side lower area is directed to the lower rear-side interior 40*f*. The air directed to the lower rear-side interior 40*f* is directed to the upper space 40*d* via the second cooling air intake channel 83. Accordingly, circulating the air taken in from the first outlet 65 around the entire area inside the engine cover 24 allows the air inside the engine cover 24 to be stirred around the entire area. The temperature of the air in the entire area of the engine cover 24 is thereby averaged out and the engine 23 and other components inside the engine cover 24 can be efficiently cooled.

Efficiently cooling the engine 23 and the like inside the engine cover 24 makes it possible to inhibit any increase in the temperature of air directed to the combustion chambers via the throttle unit 42. Inhibiting an increase in the temperature of the air directed to the combustion chambers thus makes it possible to improve the output of the engine 23.

In addition, a cooling fan can be obviated because air is taken inside the engine cover 24 using air taken into the engine 23 (combustion chambers), and the interior of the engine cover 24 can be efficiently cooled using the air thus taken in. The interior of the engine cover 24 can thereby be cooled with a simple configuration.

The cooling/intake device of the outboard engine unit in the first embodiment may be suitably modified, improved, or otherwise adjusted. For example, the shape and/or configuration of the outboard engine unit 10, the engine 23, the engine cover 24, the cooling opening 25, the throttle unit 42, the power generator 43, the pair of electrical components 44, 45, the cooling/intake device 50 of the outboard engine unit, the first cooling air intake channel 63, the first outlet 65, the partition wall 81, the second cooling air intake channel 83, the second inlet 84, the second outlet 85, and the like shown in the first embodiment are not limited to those exemplified above, and may be suitably modified.

Second Embodiment

The outboard engine unit 210 in the second embodiment will be described using the same reference numerals for the same members in the first embodiment.

Figure 13:
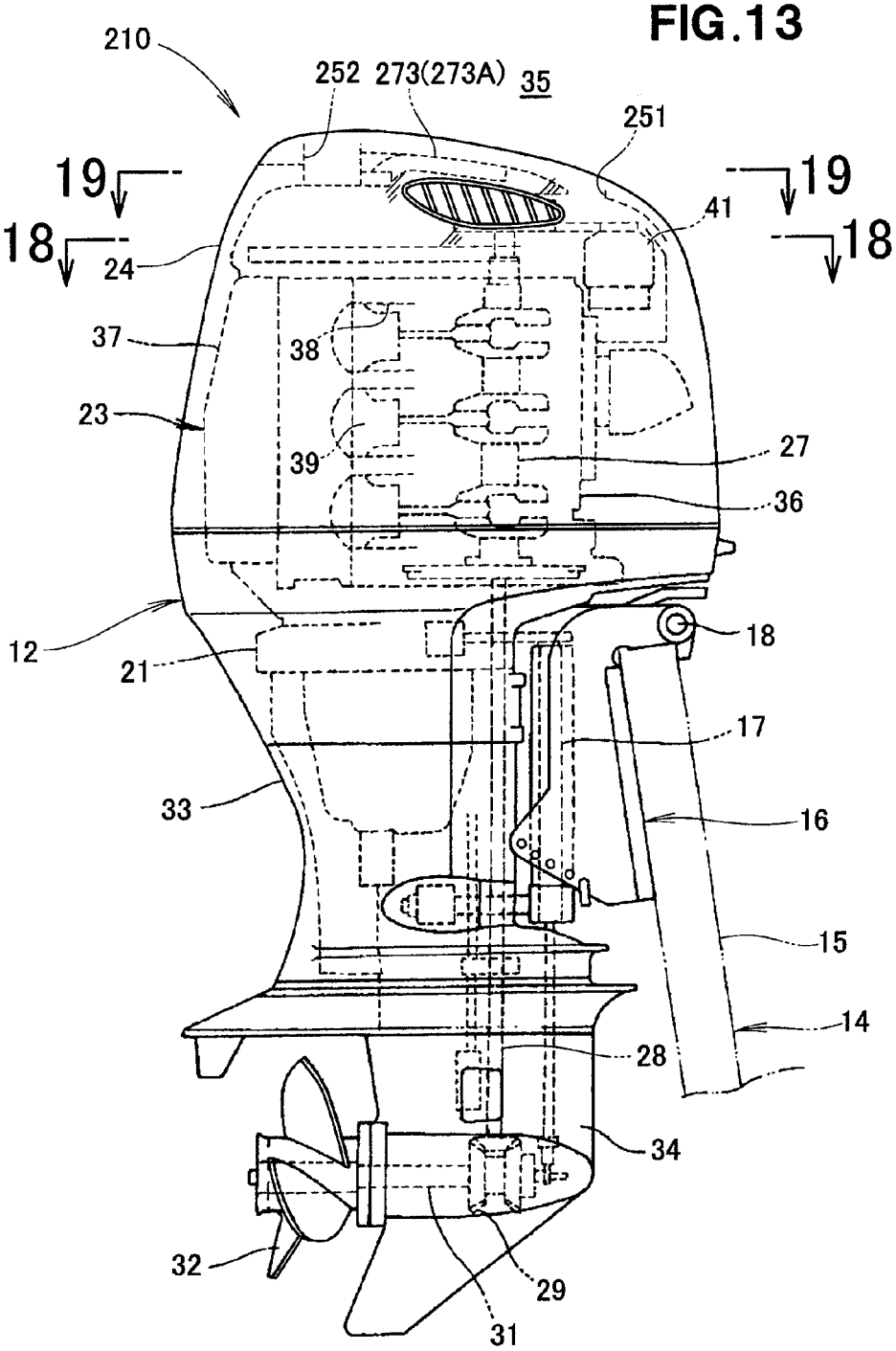
FIG. 13 is a side elevational view illustrating an outboard engine unit according to a second embodiment of the present invention.

As shown in FIG. 13, the outboard engine unit 210 in the second embodiment is provided with an outboard engine unit body 12, and mounting means 16 detachable from a hull 14 (specifically, a stern 15), the mounting means being provided to the outboard engine unit body 12. The mounting means 16 is provided with a swivel shaft 17 for allowing the outboard engine unit body 12 to pivot in the lateral direction (horizontal direction), and a tilt shaft 18 for allowing the outboard engine unit body 12 to pivot in the vertical direction.

The outboard engine unit body 12 is provided with a mounting case 21 provided to the mounting means 16, an engine 23 equipped in the upper part of the mounting case 21, an engine cover 24 for covering the engine 23, a drive shaft 28 coaxially connected to a crankshaft 27 of the engine 23, a gear mechanism 29 to which the rotations of the engine 23 (crankshaft 27) are transmitted via the drive shaft 28, and a propeller 32 to which the rotations of the gear mechanism 29 are transmitted via a propeller shaft 31.

The outboard engine unit body 12 is furthermore provided with exhaust means (ventilation means) 251 for discharging air (inside air) inside the engine cover 24 to the exterior 35, and an intake device (intake device of the outboard engine unit) 252 for guiding air (outside air) to the engine 23 from the exterior 35 of the engine cover 24.

The drive shaft 28 is covered by an extension case 33 disposed on the lower side of the mounting case 21. The gear mechanism 29 and the propeller shaft 31 are covered by a gear case 34 disposed on the lower side of the extension case 33.

The engine 23 is provided with: a cylinder block 36, a head cover 37, a crankshaft 27, cylinders 38, pistons 39, and the like, which constitute the main engine unit; and is furthermore provided with auxiliary equipment 41 of the engine 23.

In the outboard engine unit 210, driving the engine 23 causes the rotations of the engine 23 to be transmitted to the propeller 32 via the drive shaft 28, the gear mechanism 29, and the propeller shaft 31; the propeller 32 to rotate, and the hull 14 to glide.

Figure 14:
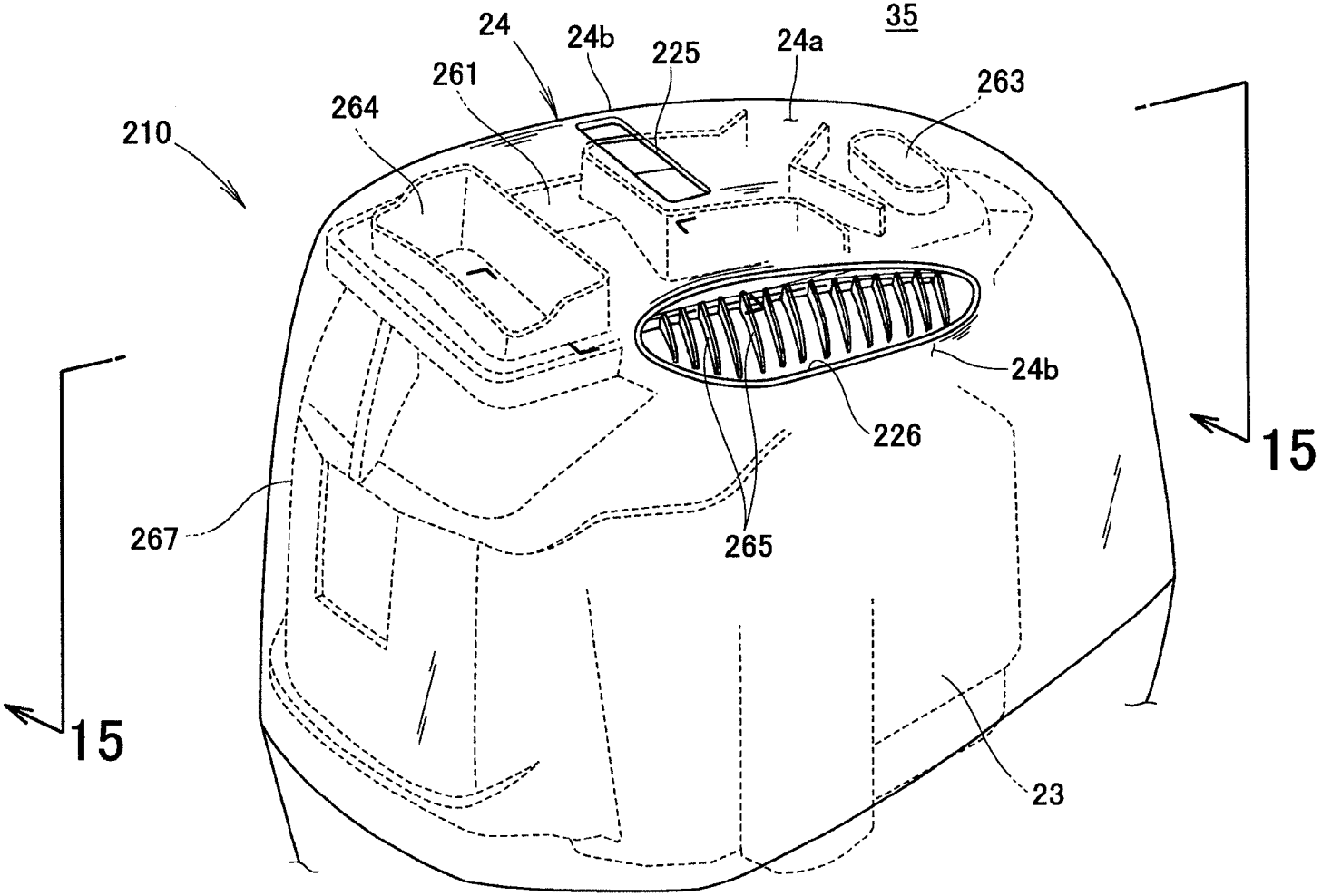
FIG. 14 is a partial enlarged perspective view of the engine unit of FIG. 13.
Figure 16:
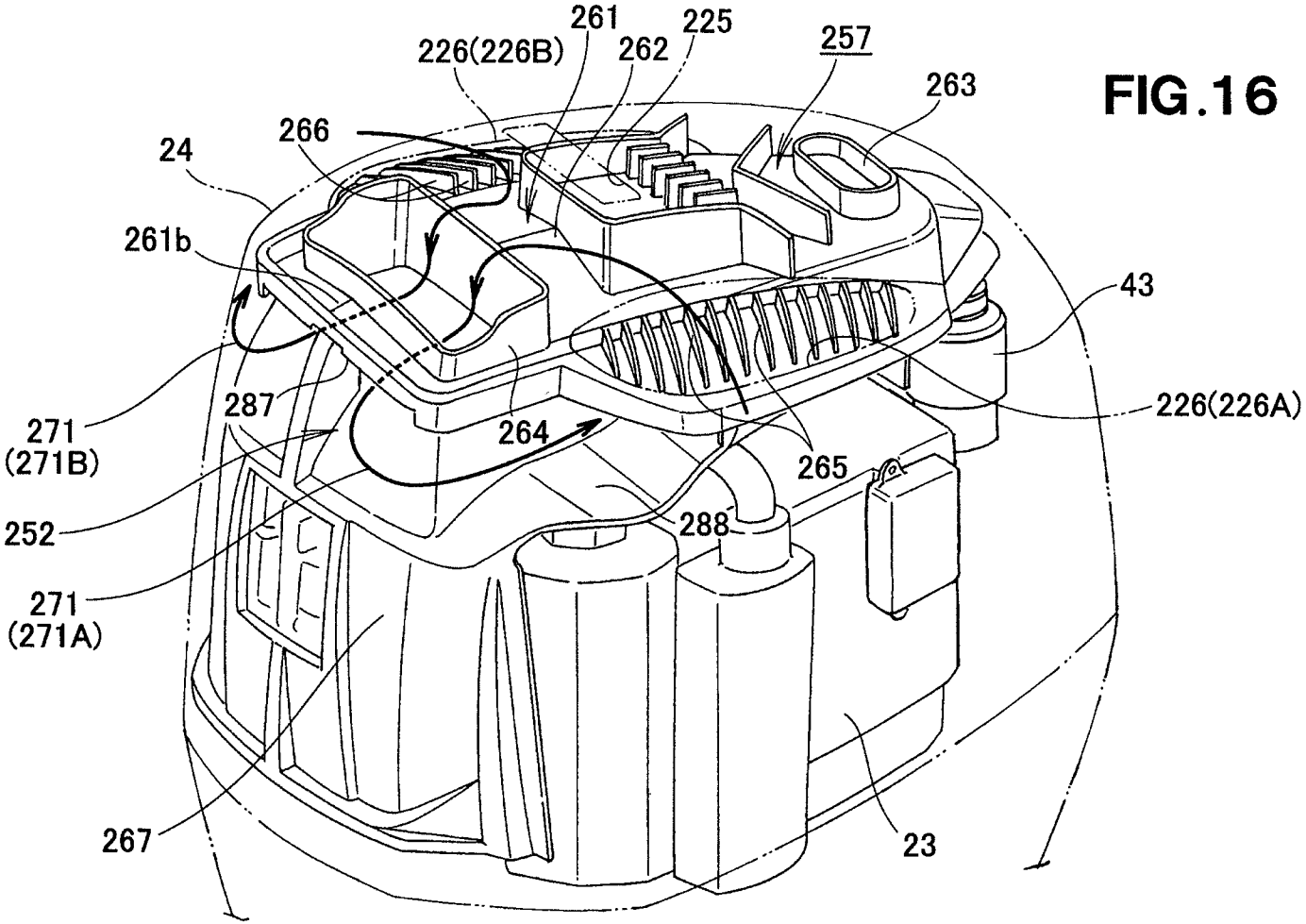
FIG. 16 is a perspective view showing the outboard engine unit of FIG. 14, with an engine cover shown by a phantom line.

As shown in FIG. 14, the engine cover 24 has exhaust openings 25 disposed in the upper part 24*a*, and a pair of intake openings (openings) 226 disposed in the upper two side parts 24*b*. FIG. 16 shows the other intake opening 226 (left-side intake opening) of the pair of intake openings 226.

Figure 15:
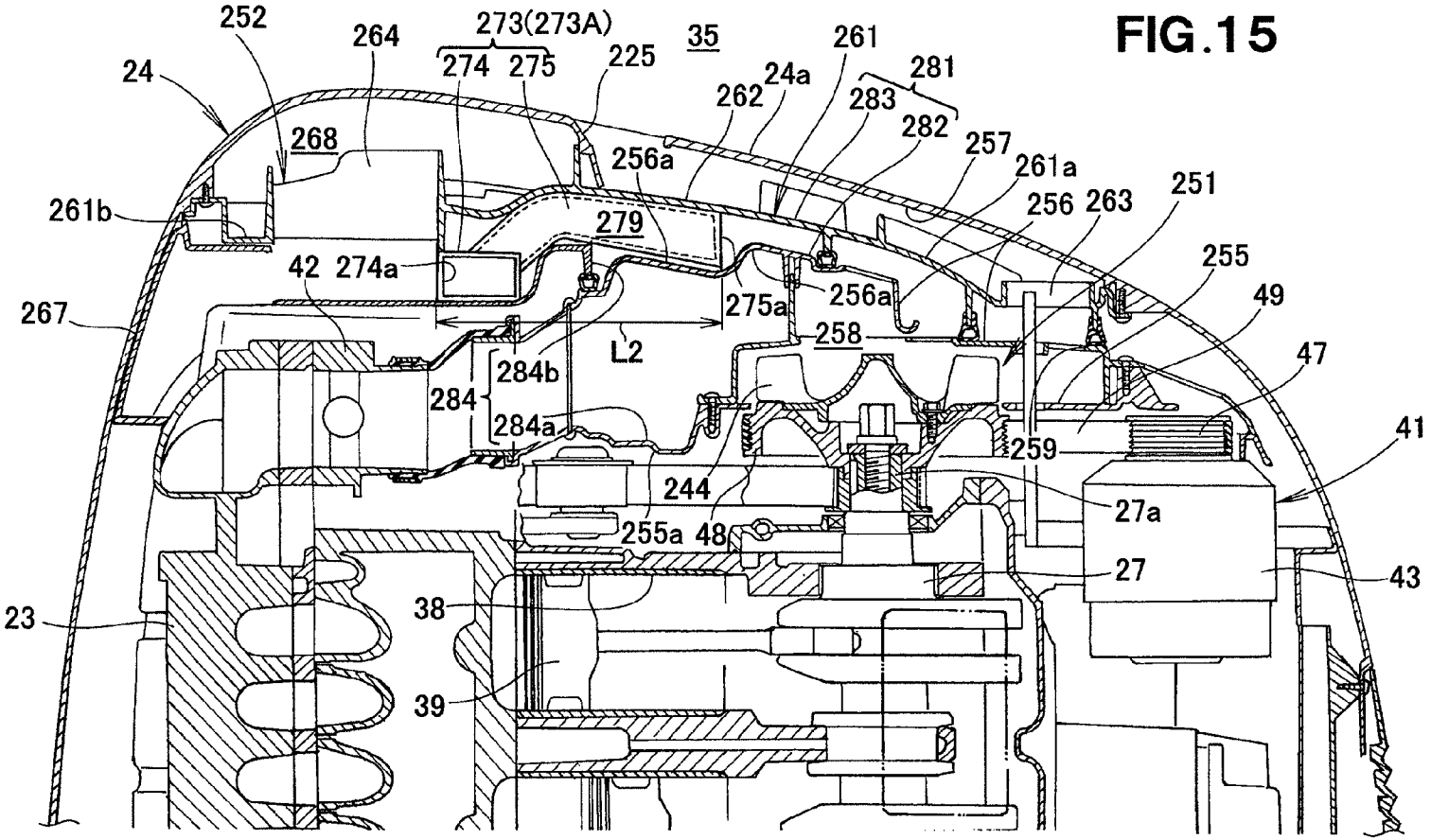
FIG. 15 is a cross-sectional view taken along line 15-15 of FIG. 14.

As shown in FIG. 15, the auxiliary equipment 41 of the engine 23 is provided with a throttle unit 42 in communication with the combustion chambers of the engine 23, a power generator 43 provided on the front side of the throttle unit 42, and an exhaust fan 244 disposed between the power generator 43 and the throttle unit 42. A drive belt 49 is wound onto a drive pulley 48 and a driven pulley 47 of the power generator 43. The drive pulley 48 is disposed at the upper end 27*a* of the crankshaft 27. Accordingly, the drive pulley 48 is driven by the rotation of the crankshaft 27. The rotation of the drive pulley 48 is transmitted to the driven pulley 47 via the drive belt 49. The power generator 43 is driven by the rotation of the driven pulley 47.

The exhaust means 251 is provided with the exhaust fan 244 coaxially disposed on the upper part of the drive pulley 48, a belt cover 255 for covering the area above the drive belt 49, a fan cover 256 disposed above the belt cover 255, and an exhaust channel 257 for guiding air inside the engine cover 24 to the exterior. The exhaust fan 244 is accommodated in an exhaust fan chamber 258 and is coaxially disposed on the upper part of the drive pulley 48. Accordingly, the exhaust fan 244 is rotated by the rotation of the drive pulley 48.

An exhaust port 259 that places the exhaust fan chamber 258 in communication with the exhaust channel 257 is formed in the front part of the fan cover 256. The exhaust channel 257 is disposed along the upper part 24*a* of the engine cover 24 in the upper part 24*a* of the engine cover 24 and a front half part 261*a* of an air guide 261. The air guide 261 is disposed along the upper part 24*a* of the engine cover 24.

The exhaust channel 257 is in communication with the exterior 35 of the engine cover 24 via an exhaust opening 225. The exhaust opening 225, as described above, is formed in the upper part 24*a* of the engine cover 24. In other words, the exhaust fan chamber 258 is in communication with the exterior 35 of the engine cover 24 via the exhaust port 259, the exhaust channel 257, and the exhaust opening 225. Accordingly, the exhaust fan 244 is rotated, whereby the air in the exhaust fan chamber 258 is discharged to the exterior 35 of the engine cover 24 via the exhaust port 259, the exhaust channel 257, and the exhaust opening 225. Air in the exhaust fan chamber 258 is discharged to the exterior 35 of the engine cover 24, whereby the air in the engine cover 24 is discharged to the exterior 35 of the engine cover 24 via the exhaust fan chamber 258.

Figure 17:
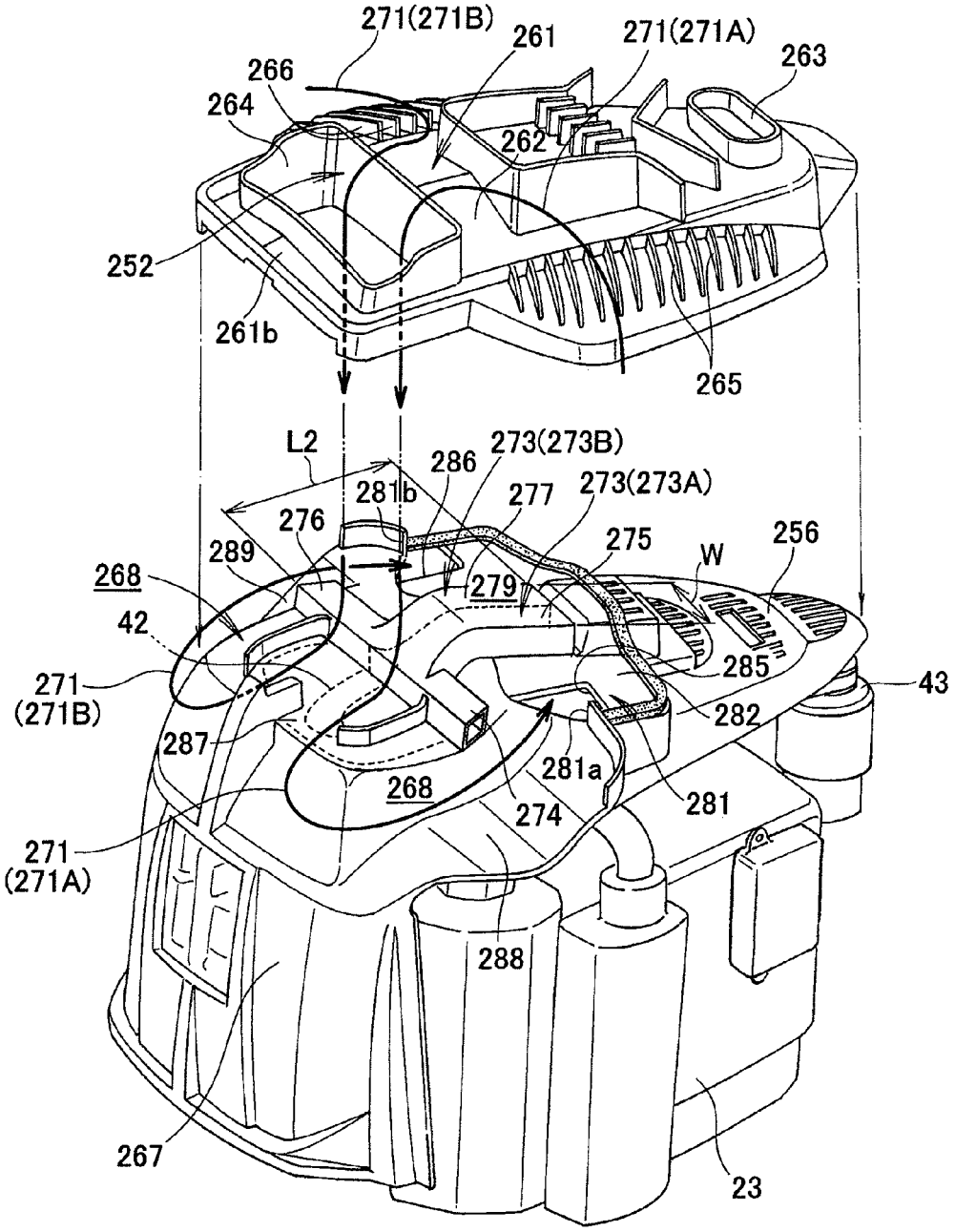
FIG. 17 is an exploded perspective view showing the outboard engine unit of FIG. 16.

As shown in FIGS. 16 and 17, the intake device 252 of the outboard engine unit is provided with a pair of intake openings 226 disposed in the upper two side parts 24*b* (see FIG. 2) of the engine cover 24, a pair of intake channels 271 in communication with the pair of intake openings 226, a pair of interference mufflers 273 medially disposed in the pair of intake channels 271, respectively, and a silencer 281 disposed on the downstream side of the pair of interference mufflers 273 and on the upstream side of the throttle unit 42.

The pair of intake openings 226 is disposed in the upper two side parts 24*b*, respectively, of the engine cover 24, as described above, and are symmetrically formed. Hereinbelow, the right-side intake opening of the pair of intake openings 226 will be described as the right intake opening 226A and the left-side intake opening will be described as the left intake opening 226B.

The pair of intake channels 271 is disposed in the space 268 on the upper two sides (see FIG. 15) in the engine cover 24 by being formed by the engine cover 24, the air guide 261, a rear duct 267, and the like. The pair of intake channels 271 is formed as indicated by the arrows, so that the air directed from the pair of intake openings 226 of the engine cover 24 is guided to the throttle unit 42. Hereinbelow, the right intake channel of the pair of intake channels 271 will be described as the right intake channel 271A and the left intake channel will be described as the left intake channel 271B.

Figure 18:
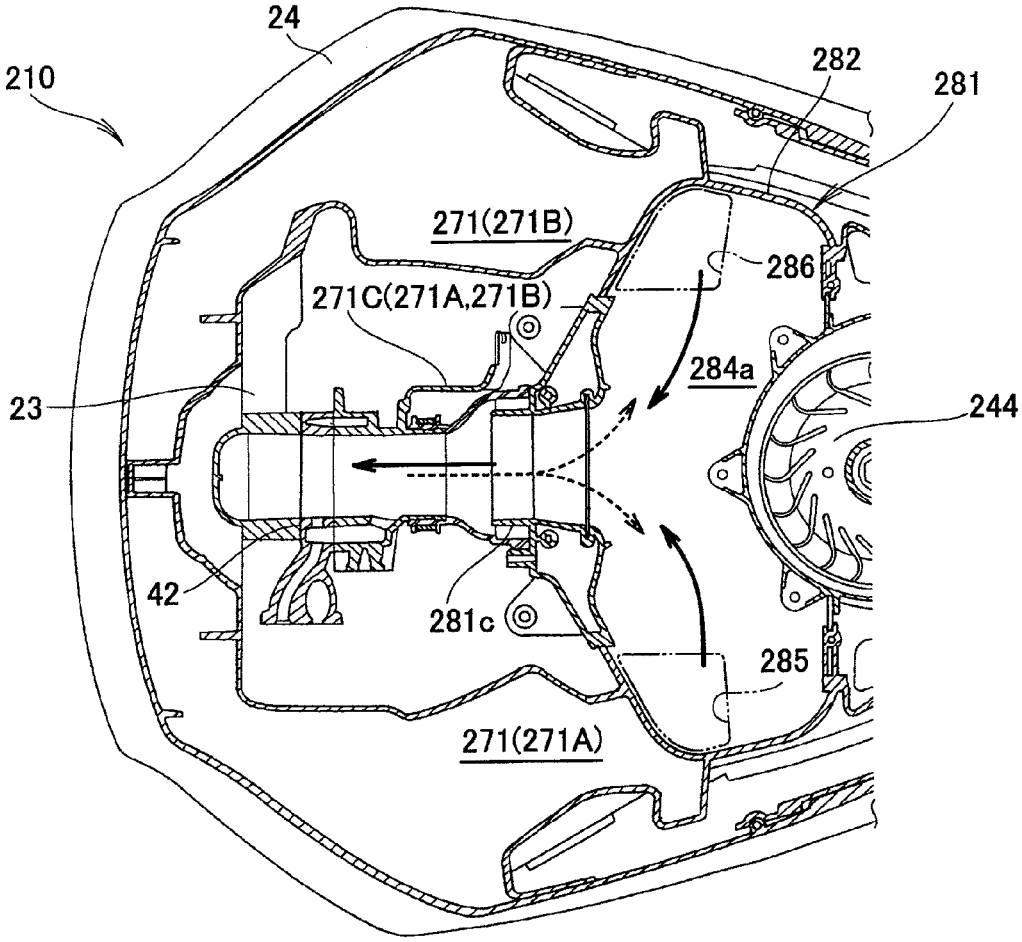
FIG. 18 is a cross-sectional view taken along line 18-18 of FIG. 13.

As shown in FIG. 18, the downstream-side channels of the right intake channel 271A and the left intake channel 271B are integrally formed as a downstream-side intake channel 271C. The downstream-side intake channel 271C integrally formed from the right intake channel 271A and the left intake channel 271B places the silencer 281 and the throttle unit 42 in communication with each other.

As shown in FIGS. 16 and 17, the right intake channel 271A is disposed on the right side of the outboard engine unit 210 and is a channel for guiding air from the right intake opening 226A to the throttle unit 42 (see also FIG. 18). The silencer 281 and a right interference muffler 273A of the pair of interference mufflers 273 are in communication with each other in an intermediate part of the right intake channel 271A. The silencer 281 is disposed on the downstream side of the right interference muffler 273A.

The left intake channel 271B is symmetrically formed with respect to the right intake channel 271A by being provided to the left side of the outboard engine unit 210, and is a channel for guiding air from the left intake opening 226B to the throttle unit 42 (see also FIG. 18). The silencer 281 and a left interference muffler 273B of the pair of interference mufflers 273 are in communication with each other in an intermediate part of the left intake channel 271B. The silencer 281 is disposed on the downstream side of the left interference muffler 273B. In other words, the silencer 281 is jointly used by the right intake channel 271A and the left intake channel 271B. Accordingly, the generated air intake noise can be reduced in the silencer 281 and the right and left interference mufflers 273A, 273B when air intake noise is generated in accompaniment with air intake pulsation or shockwaves when the engine 23 is driven. The left and right interference mufflers 273A, 273B and the silencer 281 are described later in detail.

As shown in FIGS. 15 and 17, the air guide 261 is arranged above the fan cover 256 and the rear duct 267, and is disposed on the reverse surface side of the upper part 224*a* of the engine cover 24. The air guide 261 is provided with a guide bottom part 262 for covering the fan cover 256 and the rear duct 267, a channel inlet 263 disposed at the front end of the guide bottom part 262, and an intake guide part 264 disposed at the rear end of the guide bottom part 262. Furthermore, the air guide 261 is provided with a plurality of right guide plates 265 disposed on the right side of the guide bottom part 262, and a plurality of left guide plates 266 disposed on the left side of the guide bottom part 262.

The channel inlet 263 is disposed at the front end of the exhaust channel 257 and forms an inlet to the exhaust channel 257. The rear end of the exhaust channel 257 is in communication with the exhaust opening 225. Accordingly, the air in the exhaust fan chamber 258 is discharged by the rotation of the exhaust fan 244, as described above, to the exterior 35 of the engine cover 24 via the exhaust port 259, the exhaust channel 257, and the exhaust opening 225.

The plurality of right guide plates 265 is provided in a position facing the right intake opening 226A (FIG. 16) of the engine cover 24. Providing a plurality of right guide plates 265 that faces the right intake opening 226A allows air to be guided and water to be separated from air when the air inside the engine cover 24 is directed from the right intake opening 226A.

The plurality of left guide plates 266 is provided in a position facing the left intake opening 226B (FIG. 4) of the engine cover 24. Providing a plurality of left guide plates 266 that face the left intake opening 226B allows air to be guided and water to be separated from air when the air inside the engine cover 224 is directed from the left intake opening 226B.

The rear duct 267 is provided with a guide port 287 in communication with the intake guide part 264 and disposed below the rear half 261*b* of the air guide 261, a right-side guide part 288 disposed on the right side of the guide port 287, and a left-side guide part 289 disposed on the left side of the guide port 287. The right-side guide part 288 is formed from the guide port 287 to a right inlet 281*a* of the silencer 281. The left-side guide part 289 is formed from the guide port 287 to the left inlet 281*b* of the silencer 281.

Figure 19:
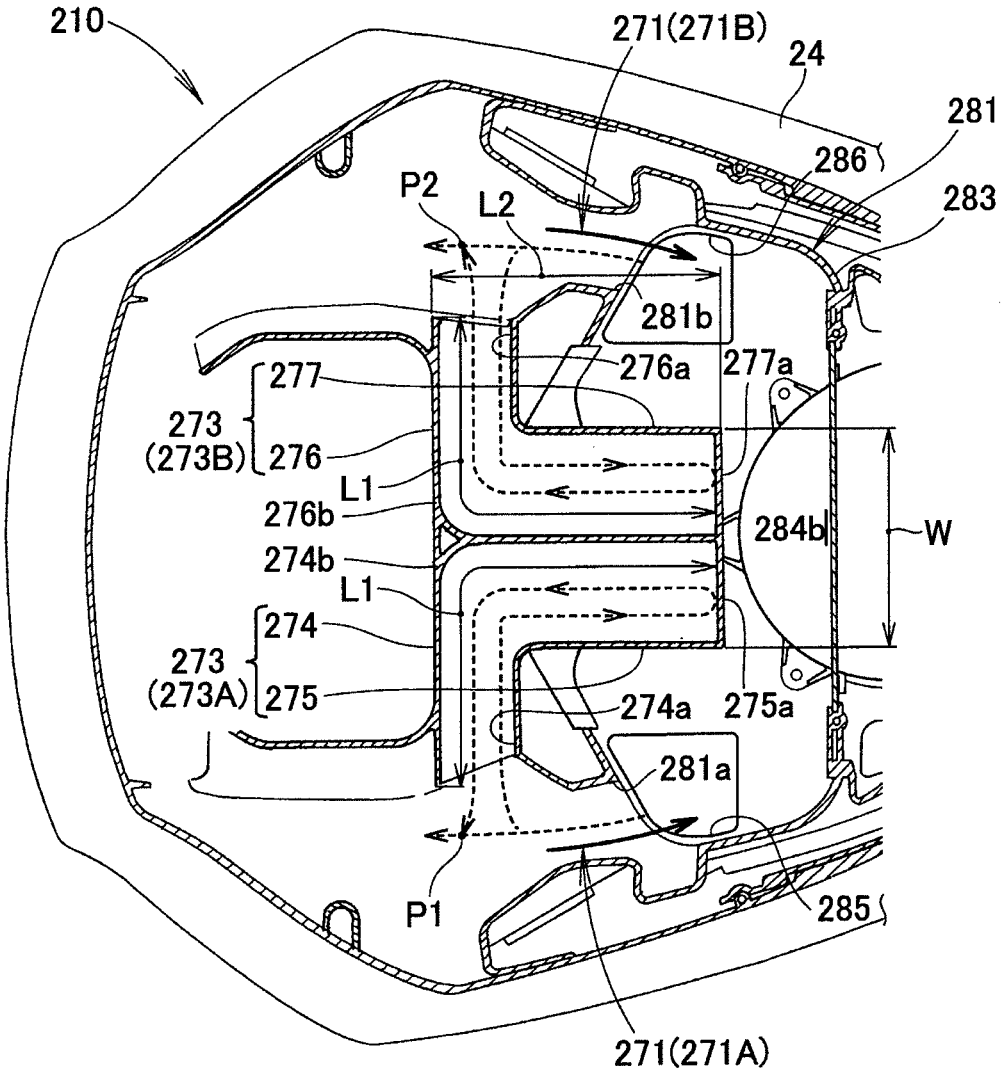
FIG. 19 is a cross-sectional view taken along line 19-19 of FIG. 13.

As shown in FIGS. 17 and 19, the pair of interference mufflers 273 is in communication with an intermediate part of the pair of intake channels 271, respectively, and are side branches disposed in the space 268 (see also FIG. 15) on the upper two sides in the engine cover 24. Each of the pair of interference mufflers 273 is formed substantially in an L shape in plan view, and each is integrally formed. The integrally formed pair of interference mufflers 273 is arranged on the upper two sides of the throttle unit 42. Hereinbelow, the right-side interference muffler of the pair of interference mufflers 273 will be described as the right interference muffler 273A and the left-side interference muffler will be described as the left interference muffler 273B.

The right interference muffler 273A has a right orthogonal hollow part 274 and a right parallel hollow part 275, and the right hollow parts 274, 275 are hollow members formed so as to be substantially rectangular in cross section. The right orthogonal hollow part 274 and the right parallel hollow part 275 are formed substantially in an L shape in plan view so that the right interference muffler 273A has a total length of L1. Forming the right interference muffler 273A substantially in an L shape in plan view allows the total length L1 required for the right interference muffler 273A to be ensured while the external dimensions (longitudinal dimensions) L2 of the right interference muffler 273A are kept small. Accordingly, the total length required in the right interference muffler 273A is ensured in accordance with the frequency band of the air intake noise generated by particularly high sound pressure. The air intake noise can thereby be sufficiently reduced by the right interference muffler 273A.

The right orthogonal hollow part 274 is disposed so as to be substantially orthogonal to the right intake channel 271A, and has a right-facing end part 274*a* that opens so as to face the right intake channel 271A. The right parallel hollow part 275 extends forward along the right intake channel 271A from an inward-side end part 274*b* of the right orthogonal hollow part 274, and has a right front end part 275*a* that is blocked off. In other words, the right interference muffler 273A is a side branch that can reduce air intake noise generated in accompaniment with air intake pulsation or shockwaves when the engine 23 is driven.

Opening the right-facing end part 274*a* facing the right intake channel 271A places the right interference muffler 273A in communication with the combustion chambers of the engine 23 (FIG. 18) via the right intake channel 271A, the silencer 281, and the throttle unit 42 (FIG. 18).

The left interference muffler 273B is a hollow member in which a left orthogonal hollow part 276 and a left parallel hollow part 277 are formed substantially rectangular in cross section so as to be symmetrical with the right interference muffler 273A. The left orthogonal hollow part 276 and the left parallel hollow part 277 are formed substantially in an L shape in plan view so that the left interference muffler 273B has a total length of L1. Forming the left interference muffler 2738 substantially in an L shape in plan view allows the total length L1 required for the left interference muffler 273B to be ensured while the external dimension L2 of the left interference muffler 273B is kept small. Accordingly, the total length required in the left interference muffler 273B is ensured in accordance with the frequency band of the air intake noise generated by particularly high sound pressure. The air intake noise can thereby be sufficiently reduced by the left interference muffler 273B.

The left orthogonal hollow part 276 is provided so as to be substantially orthogonal to the left intake channel 271B, and has a left-facing end part 276*a* opened so as to face the left intake channel 271B. The left parallel hollow part 277 extends forward along the left intake channel 271B from an inward-side end part (end part laterally near the center) 276*b* of the left orthogonal hollow part 276, and has a left front end part 277*a* that is blocked off. In other words, the left interference muffler 273B is a side branch that can reduce air intake noise generated in accompaniment with air intake pulsation or shockwaves when the engine 23 is driven.

Opening the left-facing end part 276*a* facing the left intake channel 271B places the left interference muffler 273B in communication with the combustion chambers of the engine 23 (FIG. 18) via the left intake channel 271B, the silencer 281, and the throttle unit 42 (FIG. 18).

As shown in FIGS. 18 and 19, the right interference muffler 273A is medially disposed in the right intake channel 271A, and the left interference muffler 273B is medially disposed in the left intake channel 271B. Accordingly, the air intake noise generated from the engine 23 (the combustion chambers) is transmitted as indicated by the arrow (indicated by a broken line) to the silencer 281 via the throttle unit 42. Hereinbelow, the transmission direction of the air intake noise in the drawings is indicated by a broken-line arrow.

The air intake noise transmitted to the silencer 281 is transmitted to the right intake channel 271A via a right opening 285 and the right inlet 281*a* of the silencer 281, and is transmitted to the left intake channel 271B via a left opening 286 and the right inlet 281*a* of the silencer 281. The air intake noise transmitted to the right intake channel 271A is transmitted as indicated by the arrow to the right orthogonal hollow part 274 and the right parallel hollow part 275 via the right intake channel 271A.

The direction of air intake noise transmitted to the right parallel hollow part 275 is reversed at the right front end part 275*a* as indicated by the arrow. The air intake noise reversed in direction in the right interference muffler 273A interferes, at an interference position P1, with the air intake noise directly transmitted from the right inlet 281*a* of the silencer 281 to the upstream side of the right interference muffler 273A.

At this point, the frequency of the air intake noise reversed in direction (hereinbelow referred to as reverse-direction air intake noise) in the right interference muffler 273A is inverted in phase at the interference position P1 in relation to the air intake noise directed from the right inlet 281*a* of the silencer 281 directly to the upstream side of the right interference muffler 273A.

The air intake noise transmitted to the left intake channel 271B is transmitted as indicated by the arrow to the left orthogonal hollow part 276 and the left parallel hollow part 277 via the left intake channel 271B. The direction of the air intake noise transmitted to the left parallel hollow part 277 is reversed as indicated by the arrow at the left front end part 277*a*. The air intake noise reversed in direction in the left interference muffler 273B interferes at an interference position P2 with the air intake noise directly transmitted from the left inlet 281*b* of the silencer 281 to the upstream side of the left interference muffler 273B.

At this point, the frequency of air intake noise reversed in direction (hereinbelow referred to as reverse-direction air intake noise) in the left interference muffler 273B is inverted in phase at the interference position P2 in relation to the air intake noise directed from the left inlet 281*b* of the silencer 281 directly to the upstream side of the left interference muffler 273B.

The pair of interference mufflers 273A, 273B is thus formed so that the frequency of the reverse-direction air intake noise is inverted in phase at the interference positions P1, P2 in relation to the air intake noise directed directly to the upstream side. Specifically, the pair of interference mufflers 273A, 273B is formed so that the phase of the reverse-direction air intake noise is inverted in relation to the air intake noise directed directly to the upstream side, which is achieved by adjusting the total length L1 of the interference mufflers 273A, 273B. The reverse-direction air intake noise inverted in phase is made to interfere with the air intake noise directed directly to the upstream side at the interference positions P1, P2, whereby the air intake noise transmitted from the right inlet 281*a* and the left inlet 281*b* of the silencer 281 can be reduced.

In the second embodiment, side branches are used as the pair of interference mufflers 273A, 273B. The pair of interference muffler (side branches) 273A, 273B causes the sound waves to branch out, the branched-out sound waves are made to interfere with the sound waves yet to be branched out, and the air intake noise is reduced. Therefore, a specific frequency band can be attenuated in accordance with the characteristics of the interference muffler. Accordingly, the air intake noise can be sufficiently reduced with good efficiency when adjustments are made in accordance with the high sound-pressure air intake noise among the air intake noise generated in accompaniment with air intake pulsation or shockwaves when the engine 23 is driven.

Here, the reason for forming the right interference muffler 273A and the left interference muffler 273B each substantially in an L shape in plan view will be described in detail. In other words, as shown in FIGS. 15 and 17, the pair of interference mufflers (side branches) 273A, 273B are tubes for branching sound waves and, in structural terms, can have a high degree of freedom in shape selection. For example, the shape of the pair of interference mufflers 273A, 273B can be a rectilinear shape, an L shape, or another shape that conforms to the arrangement location.

The outboard engine unit 210 ordinarily has an empty space (dead space) 279 between the upper part 24*a* of the engine cover 24 and the throttle unit 42, i.e., on the upper two sides of the throttle unit 42. This empty space 279 is formed in a substantially rectangular shape in plan view. The maximum length dimension of the empty space 279 is less than the total length L1 (FIG. 19) of the pair of interference mufflers 273A, 273B. For this reason, it is difficult to arrange a pair of interference mufflers 273A, 273B with a rectilinear shape in the empty space 279.

In view of this fact, each element of the pair of interference mufflers 273A, 273B is formed substantially in an L shape and the external dimensions L2 of the pair of interference mufflers 273A, 273B can be kept small. The external dimensions L2 of the pair of interference mufflers 273A, 273B can thereby be kept smaller than the maximum length dimension of the empty space 279.

Furthermore, the pair of interference mufflers 273A, 273B is integrally formed. Specifically, the right parallel hollow part 275 of the right interference muffler 273A and the left parallel hollow part 277 of the left interference muffler 273B are formed to be in parallel contact with each other. Accordingly, the pair of interference mufflers 273A, 273B is formed in a T shape in plan view. The right parallel hollow part 275 and the left parallel hollow part 277 can thereby be kept small in terms of the width dimension W.

The pair of interference mufflers 273A, 273B thus keeps the external dimension L2 small and keeps the width dimension W of the right parallel hollow part 275 and the left parallel hollow part 277 small. Accordingly, providing the pair of interference mufflers 273A, 273B to the upper two sides of the throttle unit 42 allows the pair of interference mufflers 273A, 273B to be arranged using the empty space 279. Since the space for disposing the pair of interference mufflers 273A, 273B does not need to be newly acquired inside the engine cover 24, the outboard engine unit 210 can be reduced in size.

The silencer 281 is provided with a main unit 282 formed by a rear part 255*a* of the belt cover 255 and a rear part 256*a* of the fan cover 256, and a cover part 283 formed above the main unit 282. The silencer 281 is provided with a silencer chamber 284. The silencer chamber 284 is provided with a silencer lower-half chamber 284*a* and a silencer upper-half chamber 284*b*. The silencer upper-half chamber 284*b* and the silencer lower-half chamber 284*a* are in communication via the right opening 285 and the left opening 286.

As shown in FIGS. 18 and 19, the silencer 281 has the right inlet 281*a* in communication with the right intake channel 271A at an intermediate point, the left inlet 281*b* in communication with the left intake channel 271B at an intermediate point, and an outlet 281*c* in communication with the downstream-side intake channel 271C. The silencer chamber 284 of the silencer 281 is in communication with the throttle unit 42 via the outlet 281*c* and the downstream-side intake channel 271C. The air directed as indicated by the arrow shown by the solid line from the right intake channel 271A to the right inlet 281*a* is directed as indicated by the arrow from the right inlet 281*a* to the silencer upper-half chamber 284*b*. Hereinbelow, the airflow direction in the drawings is shown by a solid line arrow.

The air directed to the silencer upper-half chamber 284*b* is directed as indicated by the arrow to the silencer lower-half chamber 284*a* via the right opening 285 (see FIG. 17). Air is thus directed from the right intake channel 271A to the silencer chamber 284 (the silencer upper-half chamber 284*b* and the silencer lower-half chamber 284*a*), whereby the directed air expands in the silencer chamber 284 and the flow rate is reduced. The air directed to the silencer lower-half chamber 284*a* is directed as indicated by the arrow to the throttle unit 42 via the outlet 281*c* and the downstream-side intake channel 271C.

Similarly, the air directed as indicated by the arrow from the left intake channel 271B to the left inlet 281*b* is directed as indicated by the arrow from the left inlet 281*b* to the silencer upper-half chamber 284*b*. The air directed to the silencer upper-half chamber 284*b* is directed as indicated by the arrow to the silencer lower-half chamber 284*a* via the left opening 286. In this manner, air is directed from the left intake channel 271B to the silencer chamber 284, whereby the directed air expands in the silencer chamber 284 and the flow rate is reduced. The air directed to the silencer lower-half chamber 284*a* is directed as indicated by the arrow to the throttle unit 42 via the outlet 281*c* and the downstream-side intake channel 271C. The throttle unit 42 is in communication with the combustion chambers of the engine 23. Accordingly, directing air from the right intake channel 271A and the left intake channel 271B to the silencer chamber 284 and causing the air to expand in the silencer chamber 284 allows the sound pressure of the air intake noise generated in accompaniment with air intake pulsation or shockwaves when the engine 23 is driven to be reduced.

Next, an example in which air taken in from the exterior 35 of the engine cover 24 is directed to the throttle unit 42 will be described with reference to FIGS. 20A to 21B. Hereinbelow, the airflow direction in FIGS. 20A to 21B is shown by a solid line arrow.

Figure 20A:
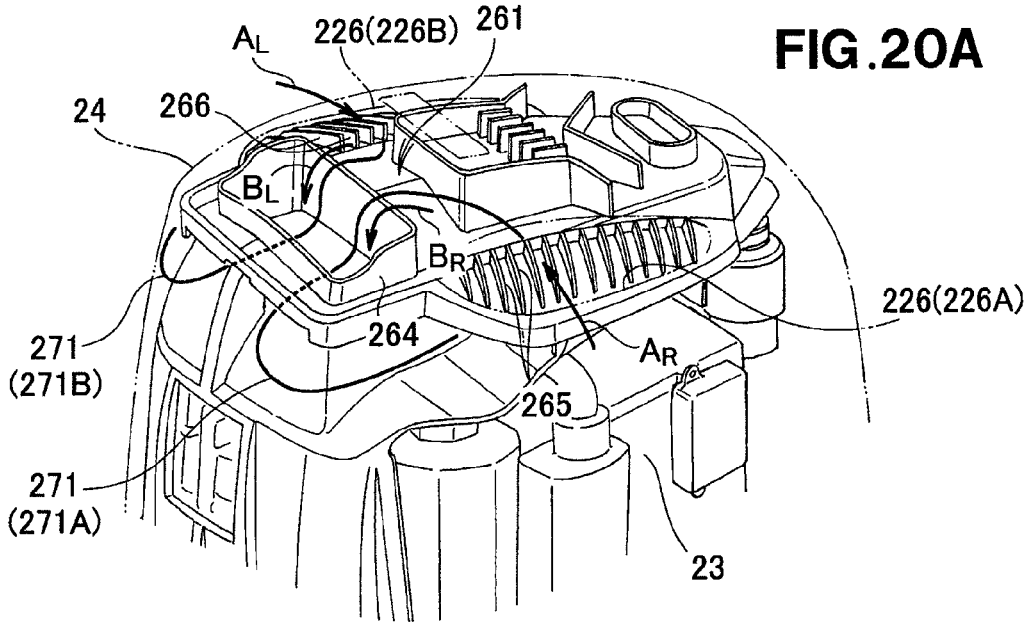
FIGS. 20A and 20B are perspective views showing an example of directing air from the exterior of the engine cover to a silencer using the intake structure of the outboard engine unit according to the second embodiment of the present invention.

As shown in FIG. 20A, the engine 23 is driven, whereby air is directed as indicated by the arrow $A_R$ from the right intake opening 226A of the engine cover 24 toward the right side of the air guide 261. At the same time, air is directed as indicated by the arrow $A_L$ from the left intake opening 226B of the engine cover 24 toward the left side of the air guide 261. The airflow directed as indicated by the arrow $A_R$ from the right intake opening 226A is described in detail below.

The air taken in from the right intake opening 226A is directed to the right intake channel 271A in the engine cover 24 via the plurality of right guide plates 265. The air directed to the right intake channel 271A is directed downward as indicated by the arrow $B_R$ toward the interior of the intake guide part 264.

Figure 20B:
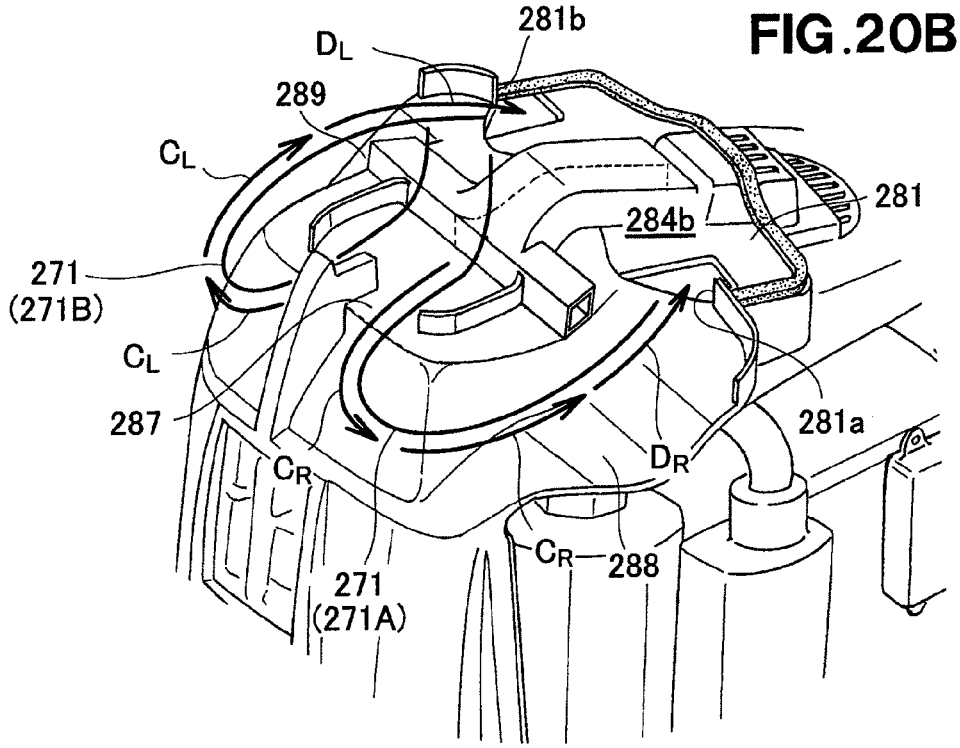

As shown in FIG. 20B, the air directed into the intake guide part 264 (FIG. 20A) is directed laterally as indicated by the arrow $C_R$ toward the right-side guide part 288 via the guide port 287. The air directed to the right-side guide part 288 is directed as indicated by the arrow $D_R$ to the silencer upper-half chamber 284*b* of the silencer chamber 284 via the right-side guide part 288 and then via the right inlet 281*a* of the silencer 281.

Figure 21A:
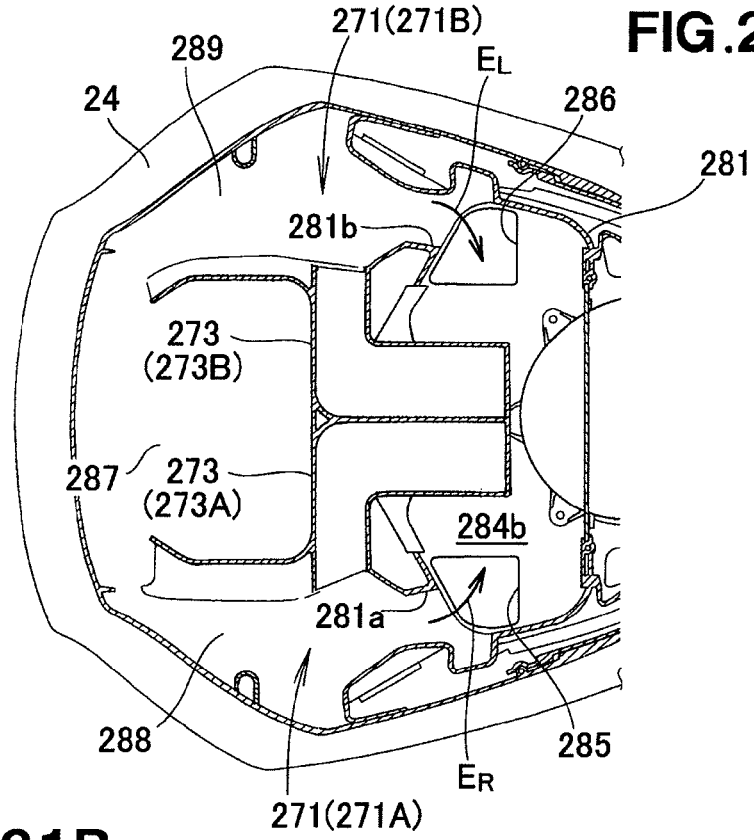
FIGS. 21A and 21B are views showing an example of directing air to the engine via the silencer.

As shown in FIG. 21A, the air directed to the silencer upper-half chamber 284*b* is directed as indicated by the arrow $E_R$ to the silencer lower-half chamber 284*a* (see FIG. 21B) via the right opening 285 of the silencer 281.

Figure 21B:
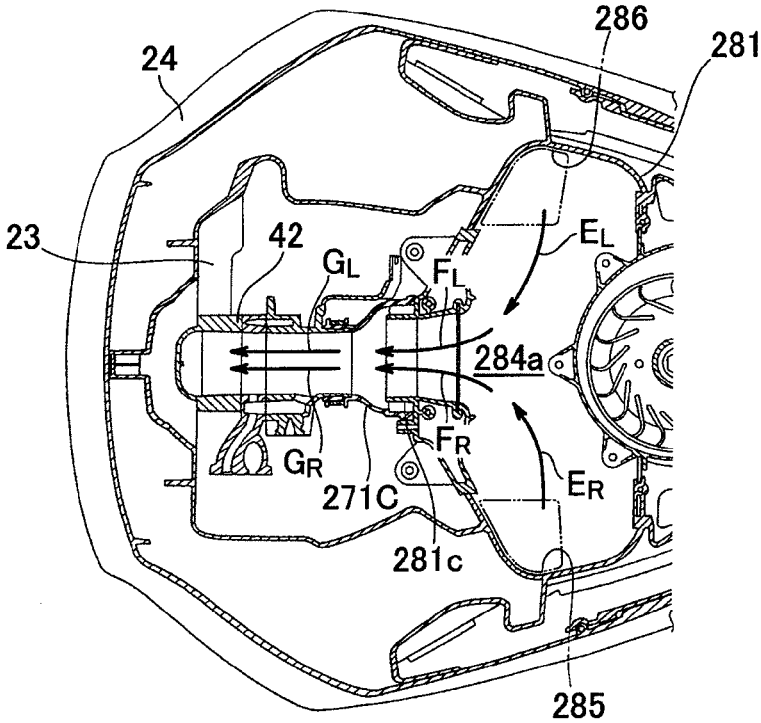

As shown in FIG. 21B, the air directed to the silencer lower-half chamber 284*a* is directed as indicated by the arrow $F_R$ toward the outlet 281*c* of the silencer chamber 284. The air directed to the outlet 281*c* of the silencer chamber 284 is directed as indicated by the arrow $G_R$ from the downstream-side intake channel 271C to the throttle unit 42, and is furthermore directed to the combustion chambers of the engine 23 via the throttle unit 42.

Returning to FIG. 20A, the air directed as indicated by the arrow $A_L$ from the left intake opening 226B is directed downward as indicated by the arrow $B_L$ to the left intake channel 271B in similar fashion to the air directed as indicated by the arrow $A_R$ from the right intake opening 226A. As shown in FIGS. 20B to 21A, B, the air directed to the left intake channel 271B is directed to the combustion chambers of the engine 23 via the throttle unit 42 as indicated by the arrows $C_L$, $D_L$, $E_L$, $F_L$, and $G_L$ in similar fashion to the air directed to the right intake channel 271A.

Figure 22A:
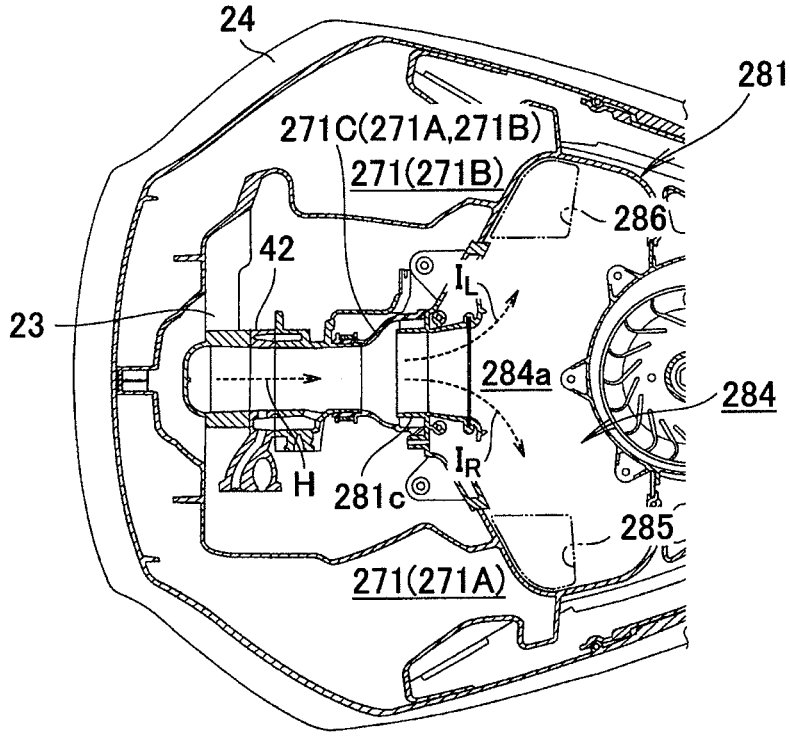
FIGS. 22A and 22B are views showing an example of reducing an intake noise using the intake structure of the outboard engine unit according to the second embodiment of the present invention.
Figure 22B:
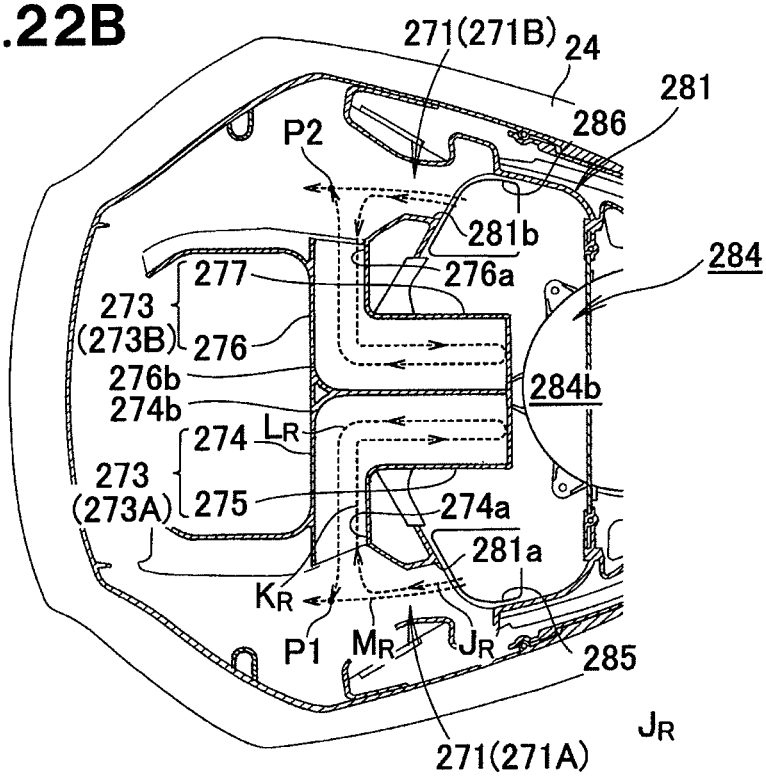

Described next with reference to FIGS. 22A and 22B is an example in which the silencer 281 and the pair of interference mufflers 273 reduce the air intake noise generated in accompaniment with air intake pulsation or shockwaves when the engine 23 is driven. The transmission direction of the air intake noise in FIGS. 22A and 22B is indicated by an arrow (broken line).

As shown in FIG. 22A, air intake noise is generated in accompaniment with air intake pulsation or shockwaves when the engine 23 is driven. The generated air intake noise is transmitted as indicated by the arrow H toward the silencer lower-half chamber 284*a* of the silencer 281 via the throttle unit 42. The air intake noise transmitted toward the silencer lower-half chamber 284*a* is transmitted as indicated by the arrow $I_R$ to the right side of the silencer lower-half chamber 284*a*, and is transmitted as indicated by the arrow $I_L$ to the left side of the silencer lower-half chamber 284*a*. The air intake noise transmitted as indicated by the arrow $I_R$ to the right side of the silencer lower-half chamber 284*a* is described in detail below.

As shown in FIG. 22B, the silencer lower-half chamber 284*a* (FIG. 22A) is in communication with the silencer upper-half chamber 284*b* via the right opening 285 and the left opening 286. The air directed to the silencer chamber 284 (the silencer lower-half chamber 284*a* and the silencer upper-half chamber 284*b*) of the silencer 281 expands and the flow rate is reduced. The sound pressure of the air intake noise transmitted to the silencer chamber 284 is reduced, and the air intake noise is attenuated and reduced. The air intake noise attenuated in the silencer 281 is transmitted as indicated by the arrow $J_R$ from the right inlet 281*a* of the silencer 281 to the right-side guide part 288 (FIG. 20B) of the right intake channel 271A. The air intake noise transmitted to the right-side guide part 288 of the right intake channel 271A is transmitted to the right interference muffler 273A via the side guide part 288.

The air intake noise transmitted to the right interference muffler 273A is transmitted as indicated by the arrow $K_R$ to the right orthogonal hollow part 274 and the right parallel hollow part 275 via the right-facing end part 274*a* of the right orthogonal hollow part 274. The direction of the air intake noise transmitted to the right parallel hollow part 275 is reversed in direction as indicated by the arrow $L_R$ at the right front end part 275*a*. The air intake noise reversed in direction interferes at the interference position P1 with the air intake noise directly transmitted as indicated by the arrow $M_R$ from the right inlet 281*a* of the silencer 281 to the upstream side of the right interference muffler 273A.

At this point, the frequency of the air intake noise reversed in direction (hereinbelow referred to as reverse-direction air intake noise) in the right interference muffler 273A is inverted in phase at the interference position P1 in relation to the air intake noise directed from the right inlet 281*a* of the silencer 281 directly to the upstream side of the right interference muffler 273A. The reverse-direction air intake noise thus inverted in phase is made to interfere at interference position P1 with the air intake noise directed directly to the upstream side, whereby the air intake noise transmitted from the right inlet 281*a* of the silencer 281 can be reduced.

Returning to FIGS. 22A and 22B, air intake noise transmitted as indicated by the arrow $I_L$ to the left side of the silencer lower-half chamber 284*a* is directed as indicated by the arrow to the left interference muffler 273B and inverted in phase in the same manner as air intake noise transmitted as indicated by the arrow $I_R$ to the right side of the silencer lower-half chamber 284*a*. Accordingly, the air intake noise inverted in phase at the left interference muffler 273B can be made to interfere at the interference position P2 with air intake noise directed from the left inlet 281*b* of the silencer 281 directly to the upstream side of the left interference muffler 273B. The inverted air intake noise is made to interfere at the interference position P2 with the air intake noise directed directly to the upstream, whereby the air intake noise transmitted from the left inlet 281*b* of the silencer 281 can be reduced.

At this point, the right interference muffler 273A and the left interference muffler 273B are capable of attenuating a specific frequency band based on the characteristics of the pair of interference mufflers. Accordingly, intermediately providing the right interference muffler 273A and the left interference muffler 273B to the right intake channel 271A and the left intake channel 271B allows air intake noise with high sound pressure to be attenuated and the air intake noise to be sufficiently reduced with good efficiency.

Thus, in the second embodiment, a right interference muffler 273A and a left interference muffler 273B are intermediately provided in addition to the silencer 281 to the right intake channel 271A and the left intake channel 271B. Air intake noise generated in accompaniment with air intake pulsation or shockwaves when the engine 23 is driven can thereby be sufficiently reduced in an advantageous manner.

The intake device of the outboard engine unit in the present invention is not limited to the second embodiment and can be suitably modified suitably modified, improved, or otherwise adjusted. For example, the shape and/or configuration of the outboard engine unit 210, the engine 23, the engine cover 24, the left and right intake openings 226B, 226A, the throttle unit 42, the left and right intake channels 271B, 271A, the left and right interference mufflers 273B, 273A, and the like shown in the second embodiment are not limited to those exemplified above, and may be suitably modified.

Third Embodiment

The outboard engine unit 310 in the third embodiment will be described using the same reference numerals for the same members in the first and second embodiments.

Figure 23:
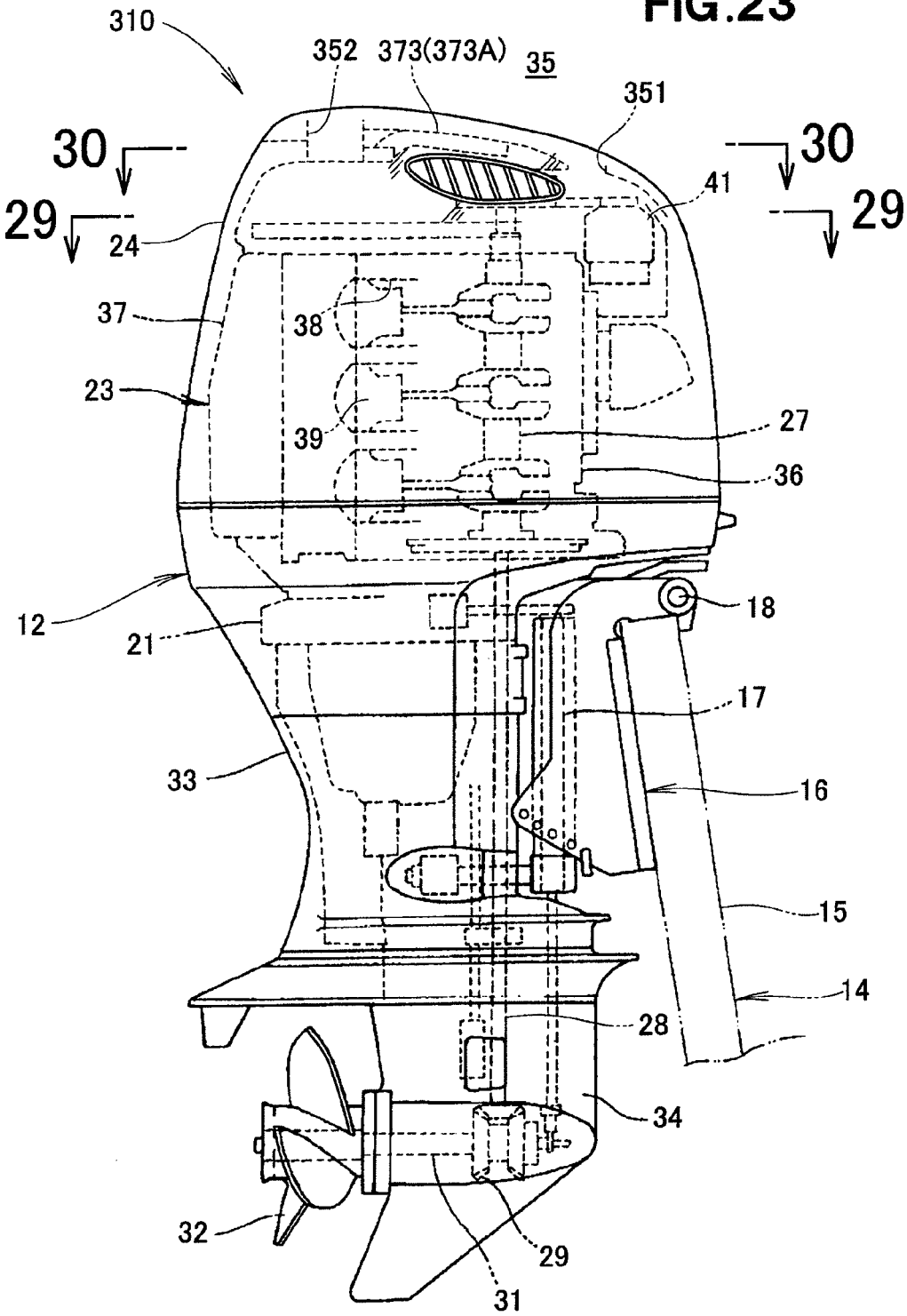
FIG. 23 is a side elevational view illustrating an outboard engine unit according to a third embodiment of the present invention.

As shown in FIG. 23, the outboard engine unit 310 in the third embodiment is provided with an outboard engine unit body 12, and mounting means 16 detachable from a hull 14 (specifically, a stern 15), the mounting means being provided to the outboard engine unit body 12. The mounting means 16 is provided with a swivel shaft 17 for allowing the outboard engine unit body 12 to pivot in the lateral direction (horizontal direction), and a tilt shaft 18 for allowing the outboard engine unit body 12 to pivot in the vertical direction.

The outboard engine unit body 12 is provided with a mounting case 21 provided to the mounting means 16, an engine 23 equipped in the upper part of the mounting case 21, an engine cover 24 for covering the engine 23, a drive shaft 28 coaxially connected to a crankshaft 27 of the engine 23, a gear mechanism 29 to which the rotations of the engine 23 (crankshaft 27) are transmitted via the drive shaft 28, and a propeller 32 to which the rotations of the gear mechanism 29 are transmitted via a propeller shaft 31. The outboard engine unit body 12 is furthermore provided with exhaust means (ventilation means) 351 for discharging air (inside air) inside the engine cover 24 to the exterior 35, and an intake device (intake device of the outboard engine unit) 352 for guiding air (outside air) to the engine 23 from the exterior 35 of the engine cover 24.

The drive shaft 28 is covered by an extension case 33 disposed on the lower side of the mounting case 21. The gear mechanism 29 and the propeller shaft 31 are covered by a gear case 34 disposed on the lower side of the extension case 33.

The engine 23 is provided with: a cylinder block 36, a head cover 37, a crankshaft 27, cylinders 38, pistons 39, and the like, which constitute the main engine unit; and is furthermore provided with auxiliary equipment 41 of the engine 23.

In the outboard engine unit 310, driving the engine 23 causes the rotations of the engine 23 to be transmitted to the propeller 32 via the drive shaft 28, the gear mechanism 29, and the propeller shaft 31; the propeller 32 to rotate; and the hull 14 to glide.

Figure 24:
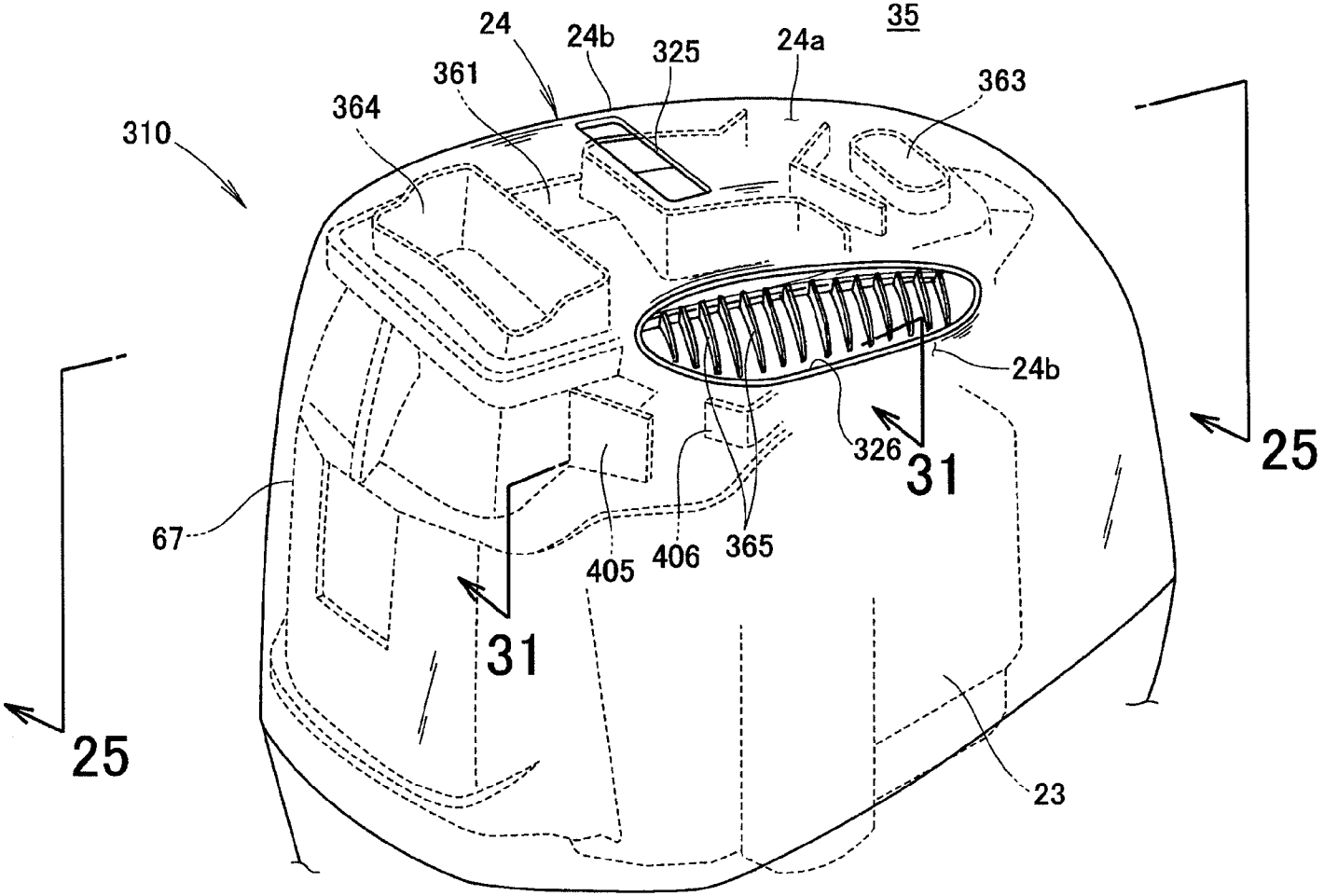
FIG. 24 is a partial enlarged perspective view of the outboard engine unit of FIG. 23.
Figure 26:
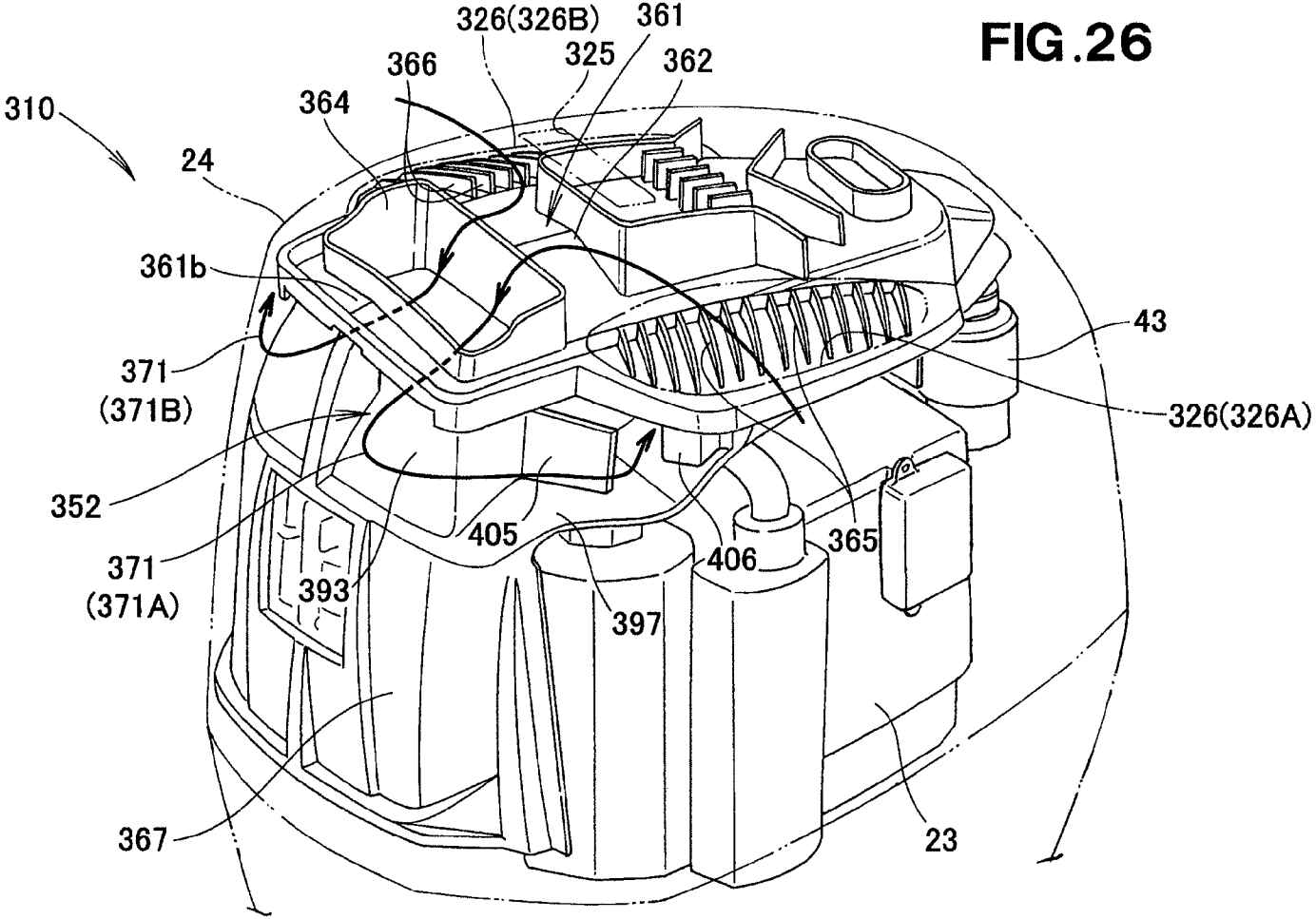
FIG. 26 is a perspective view of the outboard engine unit of FIG. 24, with an engine cover shown by a phantom line.

As shown in FIG. 24, the engine cover 24 has an exhaust opening 325 disposed in the upper part 24*a*, and a pair of intake openings (openings) 326 disposed in the upper two side parts 24*b*. FIG. 26 shows the other intake opening 326 (left-side intake opening) of the pair of intake openings 326.

Figure 25:
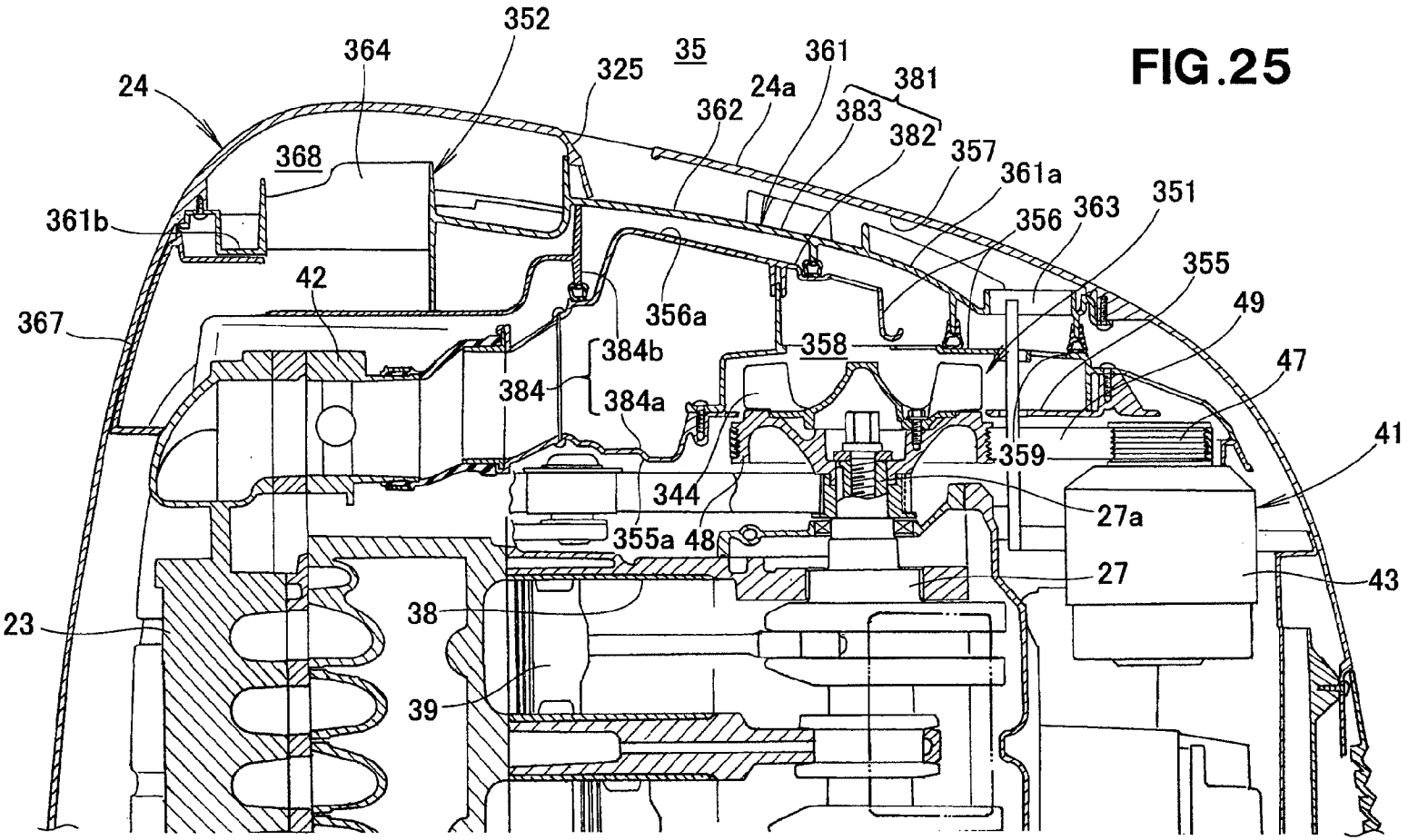
FIG. 25 is a cross-sectional view taken along line 25-25 of FIG. 24.

As shown in FIG. 25, the auxiliary equipment 41 of the engine 23 is provided with a throttle unit 42 in communication with the combustion chambers of the engine 23, a power generator 43 provided on the opposite side of the throttle unit 42, and an exhaust fan 344 disposed between the power generator 43 and the throttle unit 42.

A drive belt 49 is wound onto a drive pulley 48 and a driven pulley 47 of the power generator 43. The drive pulley 48 is disposed at the upper end 27*a* of the crankshaft 27. Accordingly, the drive pulley 48 is rotated by the rotation of the crankshaft 27. The rotation of the drive pulley 48 is transmitted to the driven pulley 47 via the drive belt 49. The power generator 43 is driven by the rotation of the driven pulley 47.

The exhaust means 351 is provided with the exhaust fan 344 coaxially disposed on the upper part of the drive pulley 48, a belt cover 355 for covering the area above the drive belt 49, a fan cover 356 disposed above a belt cover 355, and an exhaust channel 357 for guiding air inside the engine cover 24 to the exterior. The exhaust fan 344 is accommodated in an exhaust fan chamber 358 and is coaxially disposed on the upper part of the drive pulley 48. Accordingly, the exhaust fan 344 is rotated by the rotation of the drive pulley 48.

An exhaust port 59 that places the exhaust fan chamber 358 in communication with the exhaust channel 357 is formed in the front part of the fan cover 356. The exhaust channel 357 is formed by the upper part 24*a* of the engine cover 24 and a front half part 361*a* of an air guide 361, along the upper part 24*a* of the engine cover 24. The air guide 361 is disposed along the upper part 24*a* of the engine cover 24.

The exhaust channel 357 is in communication with the exterior 35 of the engine cover 24 via the exhaust opening 325. The exhaust opening 325, as described above, is formed in the upper part 24*a* of the engine cover 24. In other words, the exhaust fan chamber 358 is in communication with the exterior 35 of the engine cover 24 via the exhaust port 359, the exhaust channel 357, and the exhaust opening 325. Accordingly, the exhaust fan 344 is rotated, whereby the air in the exhaust fan chamber 358 is discharged to the exterior 35 of the engine cover 24 via the exhaust port 359, the exhaust channel 357, and the exhaust opening 325. Air in the exhaust fan chamber 358 is discharged to the exterior 35 of the engine cover 24, whereby the air in the engine cover 24 is discharged to the exterior 35 of the engine cover 24 via the exhaust fan chamber 358.

Figure 27:
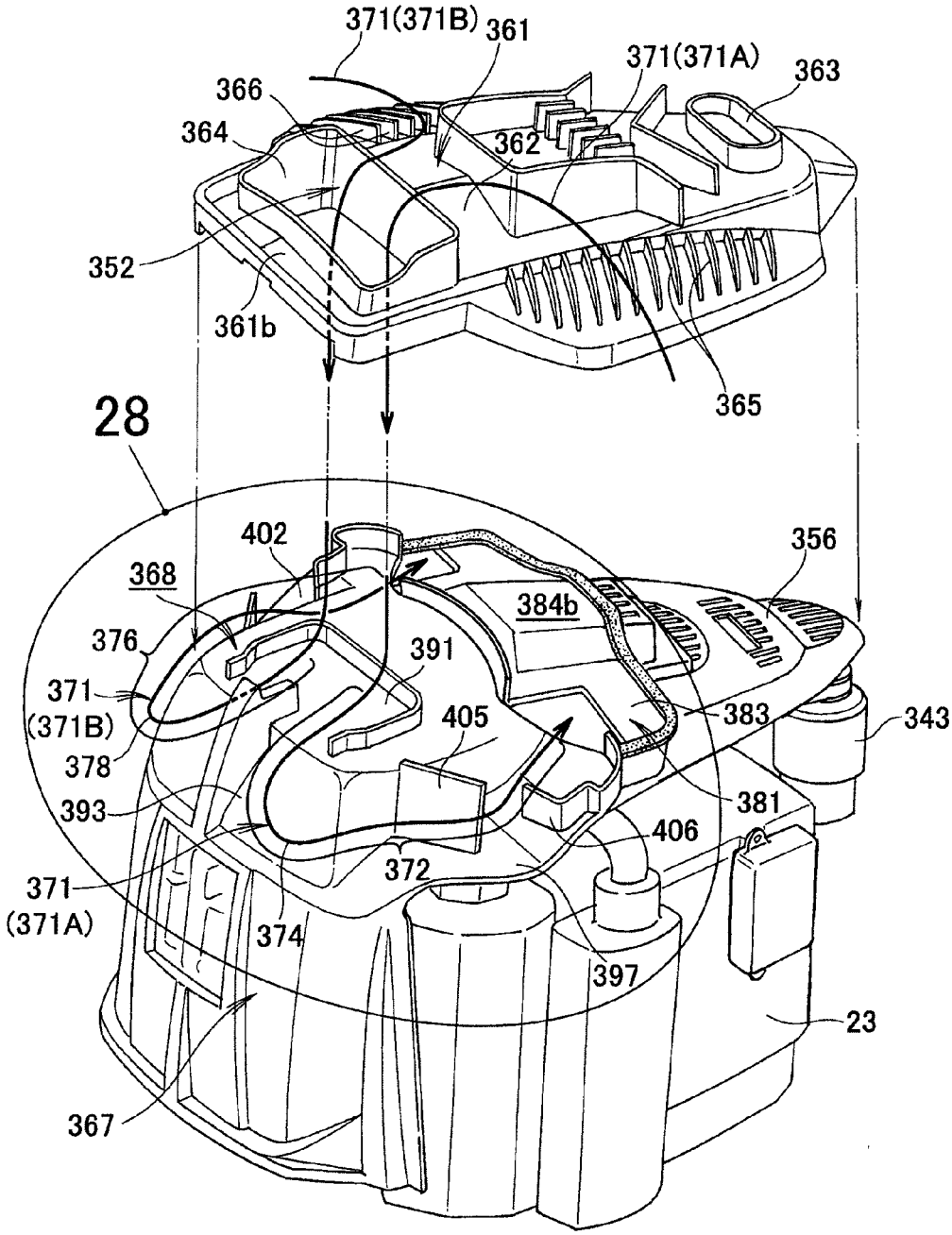
FIG. 27 is a perspective view showing the outboard engine unit of FIG. 26.

As shown in FIGS. 26 and 27, the intake device 352 of the outboard engine unit 310 is provided with a pair of intake openings 326 formed in the upper two side parts 24*b* (see FIG. 24) of the engine cover 24, a pair of intake channels 371 in communication with the pair of intake openings 326, and a silencer 381 medially disposed in the pair of intake channels 371.

The pair of intake openings 326 is disposed in the upper two side parts 24*b*, respectively, of the engine cover 24, as described above, and are symmetrically formed in relation to the lateral center of the outboard engine unit 310. Hereinbelow, the right-side intake opening of the pair of intake openings 326 will be described as the right intake opening 326A and the left-side intake opening will be described as the left intake opening 326B.

The air guide 361 and a rear duct 367 are accommodated in the engine cover 24. As shown in FIGS. 25 and 27, the air guide 361 is arranged on the upper side of the fan cover 356 and the rear duct 367, and is disposed on the reverse surface side of the upper part 24*a* of the engine cover 24.

The air guide 361 is provided with a guide bottom part 362 for covering the fan cover 356 and the rear duct 367, a channel inlet 363 disposed at the front end of the guide bottom part 362, and an intake guide part 364 disposed at the rear end of the guide bottom part 362. Furthermore, the air guide 361 is provided with a plurality of right guide plates 365 disposed on the right side of the guide bottom part 362, and a plurality of left guide plates 366 disposed on the left side of the guide bottom part 362.

The channel inlet 363 is disposed at the front end of the exhaust channel 357 and forms an inlet to the exhaust channel 357. The rear end of the exhaust channel 357 is in communication with the exhaust opening 325. Accordingly, the air in the exhaust fan chamber 358 is discharged by the rotation of the exhaust fan 344, as described above, to the exterior 35 of the engine cover 24 via the exhaust port 359, the exhaust channel 357, and the exhaust opening 325.

The plurality of right guide plates 365 is provided in a position facing the right intake opening 326A (FIG. 26) of the engine cover 24. Providing a plurality of right guide plates 365 to the right intake opening 326A allows air to be guided and moisture to be separated from air containing moisture when the air inside the engine cover 24 is directed from the right intake opening 326A.

The plurality of left guide plates 366 is provided in the position of the left intake opening 326B (FIG. 26) of the engine cover 24. Providing a plurality of left guide plates 366 to the left intake opening 326B allows air to be guided and moisture to be separated from air containing moisture when the air inside the engine cover 24 is directed from the left intake opening 326B.

Figure 28:
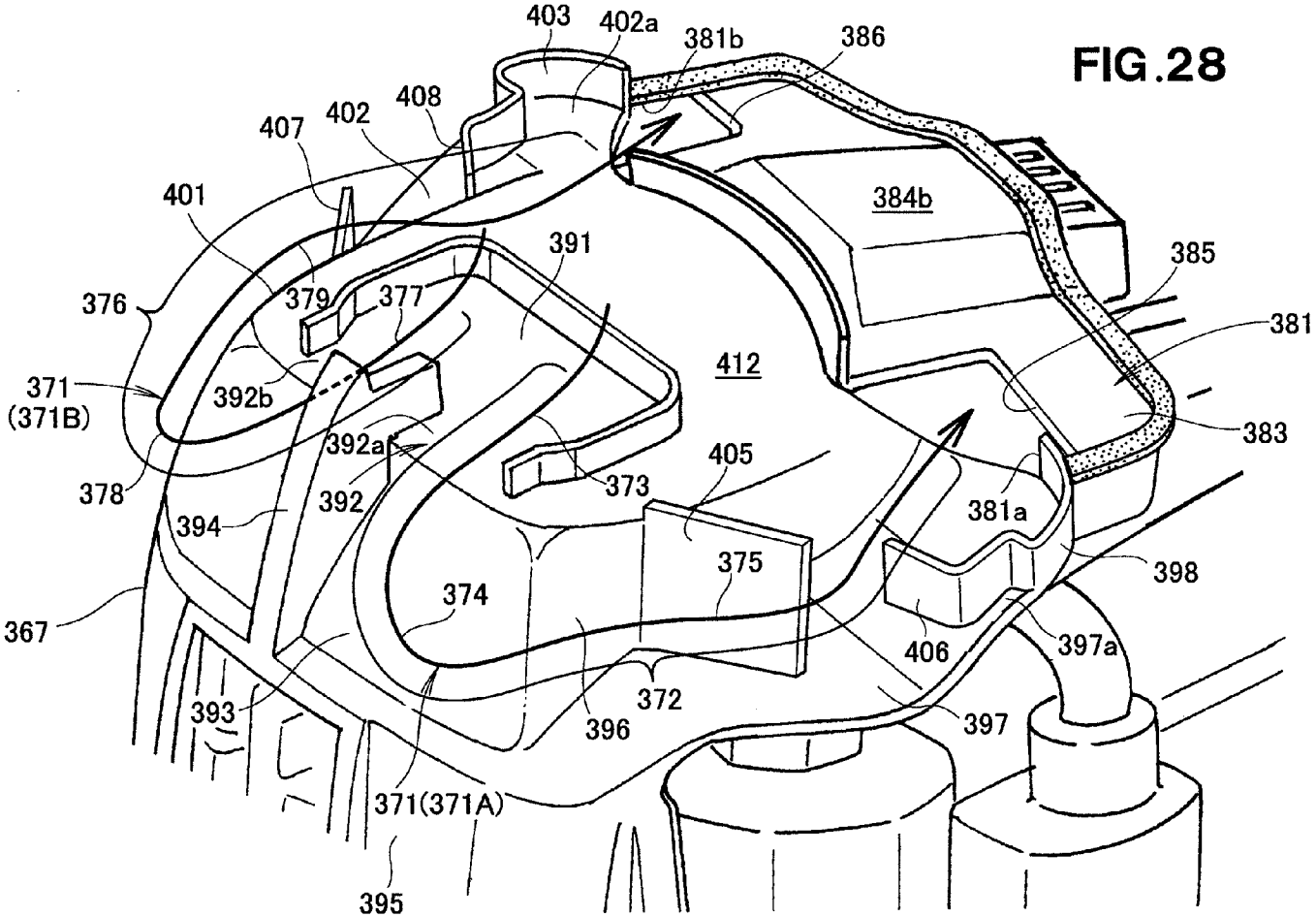
FIG. 28 is an enlarged view showing area 28 of FIG. 27.

The rear duct 367 is disposed below the rear half part 361*b* of the air guide 361. As shown in FIG. 28, the rear duct 367 has an upper plate part 391 disposed below the intake guide part 364 (FIG. 27), a guide port 392 disposed at the rear end of the upper plate part 391, a rear upper wall part 393 extended downward from the rear end of the upper plate part 391, a divider 394 disposed in the lateral center of the rear upper wall part 393, and a rear lower wall part 395 extended downward from the lower end of the rear upper wall part 393. The guide port 392 is in communication with the intake guide part 364 (FIG. 27), and is divided by the divider 394 into a right guide port 92*a* and a left guide port 92*b*.

Furthermore, the rear duct 367 has an upper right inner wall part 396 extended downward from the right end of the upper plate part 391, a right side guide part 397 extended outward from the upper right inner wall part 396, and an upper right outer wall part 398 provided upright from the outer end 397*a* of the right side guide part 397. The right side guide part 397 is formed from the right guide port 92*a* to a right inlet 381*a* of the silencer 381.

The rear duct 367 also has an upper left inner wall part 401 extended downward from the left end of the upper plate part 391, a left side guide part 402 extended outward from the upper left inner wall part 401, and an upper left outer wall part 403 erectly provided from the outer end 402*a* of the left side guide part 402. The left side guide part 402 is formed from the left guide port 392*b* to the left inlet 381*b* of the silencer 381.

As shown in FIGS. 26 and 27, the pair of intake channels 371 is formed by the engine cover 24, the air guide 361, the rear duct 367, and other members. The pair of intake channels 371 is formed as indicated by the arrow in the space 368 of the upper two sides in the engine cover 24. In the pair of intake channels 371, the air directed from the pair of intake openings 326 of the engine cover 24 can be guided to the throttle unit 42.

Here, in the pair of intake channels 371, the intake guide part 364, the upper plate part 391, and the rear upper wall part 393 are disposed facing the downstream side between the left and right intake openings 326A, 326B, and the silencer 381. Furthermore, the right side guide part 397 is disposed on the right downstream side of the rear upper wall part 393. Also, the left side guide part 402 is disposed on the left downstream side of the rear upper wall part 393. Hereinbelow, the right-side intake channel of the pair of intake channels 371 will be described as the right intake channel 371A and the left-side intake channel will be described as the left intake channel 371B.

Figure 29:
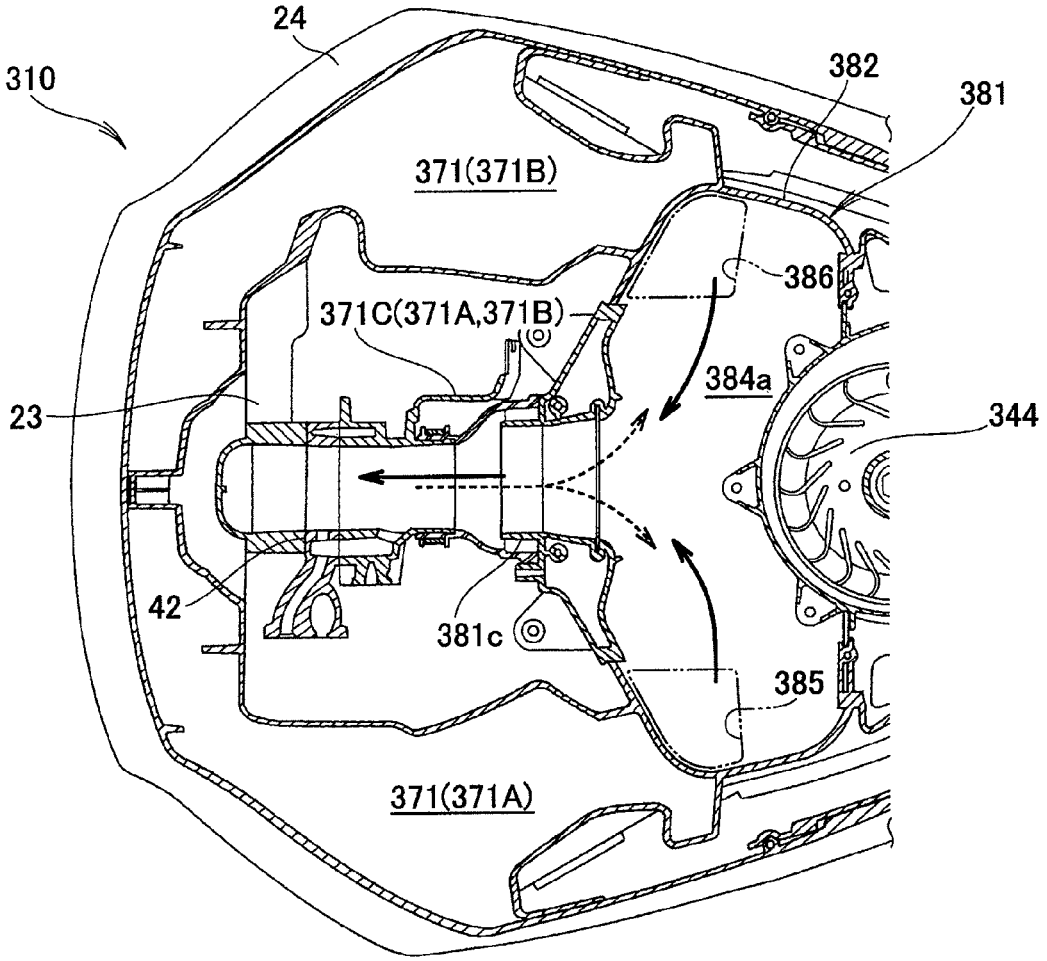
FIG. 29 is a cross-sectional view taken along line 29-29 of FIG. 23.

As shown in FIG. 29, the downstream-side channels of the right intake channel 371A and the left intake channel 371B are integrally formed as a downstream-side intake channel 371C. The downstream-side intake channel 371C integrally formed from the right intake channel 371A and the left intake channel 371B places the silencer 381 and the throttle unit 42 in communication with each other. In other words, as shown in FIGS. 26 and 27, the right intake channel 371A is disposed to the right side of the outboard engine unit 310 and is a channel for guiding air from the right intake opening 326A to the throttle unit 42 (FIG. 29). The left intake channel 371B is formed symmetrically with respect to the right intake channel 371A by being provided to the left side of the outboard engine unit 310, and is a channel for guiding air from the left intake opening 326B to the throttle unit 42 (FIG. 29).

The rear upper wall part 393, the right side guide part 397, and the left side guide part 402 are covered by the upper rear part of the engine cover 24 or the rear half part 361*b* of the air guide 361. A right channel redirection area (channel redirection area) 372 is formed at an intermediate point in the right intake channel 371A, and a left channel redirection area (channel redirection area) 376 is formed at an intermediate point in the left intake channel 371B.

Figure 30:
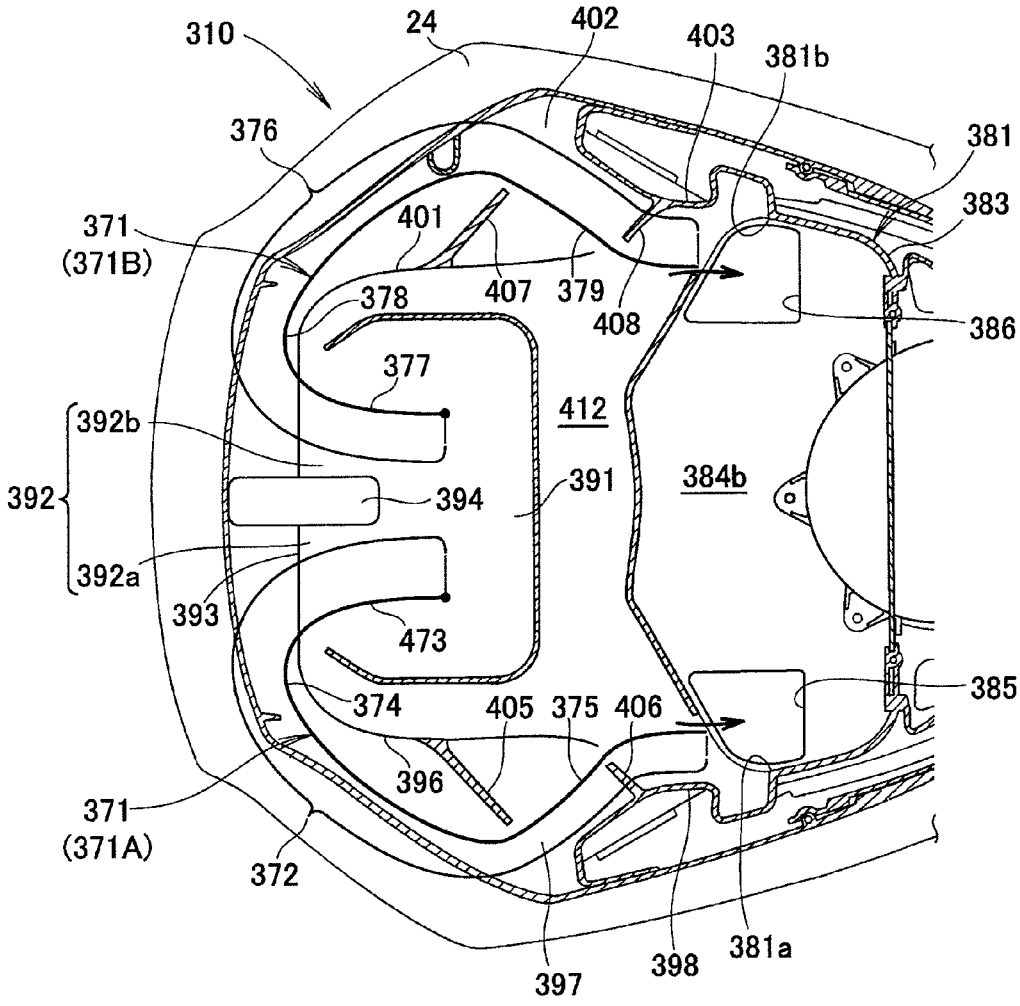
FIG. 30 is a cross-sectional view taken along line 30-30 of FIG. 23.

As shown in FIGS. 28 and 30, the right channel redirection area 372 is disposed on the downstream side of the intake guide part 364 and on the upstream side of the silencer 381. The right channel redirection area 372 is provided with a right rearward channel part 373, a right redirection part (redirection part) 374, and a right forward channel part 375. The right rearward channel part 373, the right redirection part 374, and the right forward channel part 375 are formed substantially in a U shape in plan view.

The right rearward channel part 373 extends from the downstream side of the air guide 361 (FIG. 27) to the right redirection part 374 rearward (one direction) along the upper plate part 391 and the rear upper wall part 393. Accordingly, air is directed from the right intake opening 326A to the right rearward channel part 373 via the intake guide part 364 (FIG. 26), and the directed air is guided rearward by the right rearward channel part 373 to the right redirection part 374.

The right redirection part 374 is a channel part for redirecting air in the reverse direction from the right rearward channel part 373 to the right forward channel part 375. Accordingly, the air guided from the right rearward channel part 373 to the right redirection part 374 is redirected forward (other direction) at the right redirection part 374 so as to be in the reverse direction with respect to the rearward direction. The right forward channel part 375 extends from the right redirection part 374 to the silencer 381 along the rear upper wall part 393 and the right side guide part 397. Accordingly, air redirected forward at the right redirection part 374 is guided forward to the silencer 381 side by the right forward channel part 375.

Thus, a right channel redirection area 372 is provided to the right intake channel 371A, air directed from the right intake opening 326A is redirected in the reverse direction at the right redirection part 374, and the redirected air is guided to the silencer 381 side. Since the length of the right channel redirection area 372 can thus be increased by redirecting the right channel redirection area 372 at the right redirection part 374, the total length of the right intake channel 371A can be increased.

Figure 31:
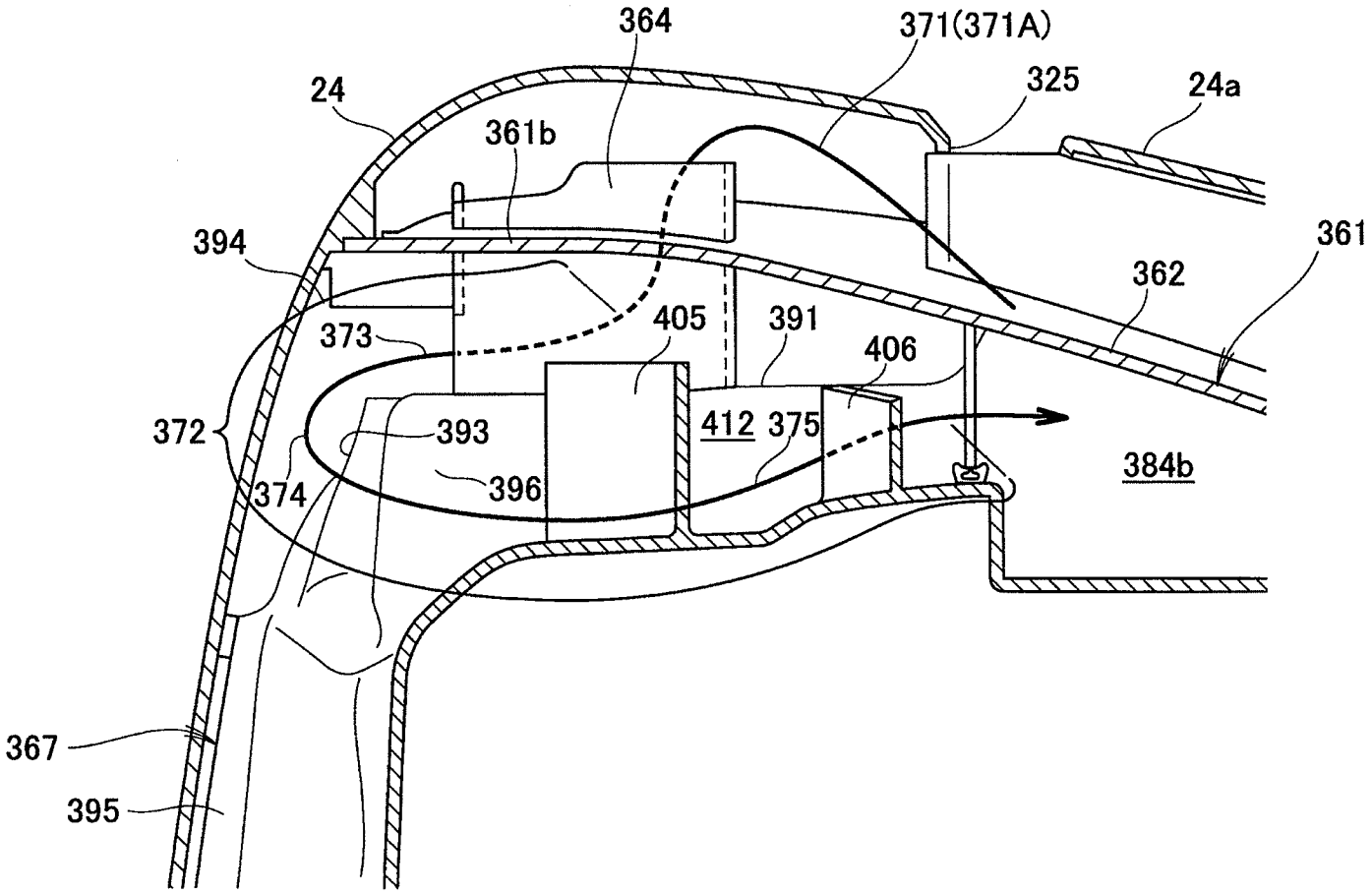
FIG. 31 is an enlarged cross-sectional view taken along line 31-31 of FIG. 24.

Here, as shown in FIG. 31, the right forward channel part 375 is provided with a right upstream-side guide wall (wall part) 405 and a right downstream-side guide wall (wall part) 406 of the right forward at intermediate points in the right forward channel part 375.

As shown in FIGS. 28 and 30, the right upstream-side guide wall 405 faces the center of the right forward channel part 375 from the upper right inner wall part (i.e., the sidewall of the right forward channel part 375) 396 of the rear duct 367, and extends while sloping toward the downstream side. The right downstream-side guide wall 406 faces the center of the right forward channel part 375 from the upper right outer wall part (i.e., the sidewall of the right forward channel part 375) 398 of the rear duct 367, and extends while sloping toward the upstream side. Accordingly, the air redirected forward at the right redirection part 374 is guided toward the forward-located silencer 381 in serpentine fashion by the right upstream-side guide wall 405 and the right downstream-side guide wall 406. In this way, the length of the right forward channel part 375 can be increased and the total length of the right intake channel 371A can therefore be increased.

Providing the right intake channel 371A with the right channel redirection area 372, and redirecting the right channel redirection area 372 in the reverse direction at the right redirection part 374 allows the length of the right intake channel 371A in the longitudinal direction to be kept short. Accordingly, the right intake channel 371A can be kept compact in a folded state.

The left channel redirection area 376 is disposed on the downstream side of the intake guide part 364 (FIG. 27) and on the upstream side of the silencer 381. The left channel redirection area 376 is provided with a left rearward channel part 377, a left redirection part (redirection part) 378, and a left forward channel part 379. The left rearward channel part 377, the left redirection part 378, and the left forward channel part 379 are formed substantially in a U shape. The left rearward channel part 377 extends rearward (one direction) from the downstream side of the air guide 61 (FIG. 27) along the upper plate part 391 and the rear upper wall part 393 to the left redirection part 378. Accordingly, air is directed from the left intake opening 326B to the left rearward channel part 377 via the intake guide part 364, and the directed air is guided rearward by the left rearward channel part 377 to the left redirection part 378.

The left redirection part 378 is a channel for redirecting air from the left rearward channel part 377 in the reverse direction to the left forward channel part 379. Accordingly, the air guided from the left rearward channel part 377 to the left redirection part 378 is redirected forward (other direction) at the left redirection part 378 so as to be in the reverse direction with respect to the rearward direction. The left forward channel part 379 extends from the left redirection part 378 to the silencer 381 along the rear upper wall part 393 and the left side guide part 402. Accordingly, the air redirected forward at the left redirection part 378 is guided forward by the left forward channel part 379 to the silencer 381 side.

Thus, the left channel redirection area 376 is provided to the left intake channel 371B, the air directed from the left intake opening 326B is redirected at the left redirection part 378 so as to be in the reverse direction, and the redirected air is guided to the silencer 381 side. Therefore, the left channel redirection area 376 can be increased in length by redirecting the left channel redirection area 376 at the left redirection part 378, and the total length of the left intake channel 371B can therefore be increased.

Here, the left forward channel part 379 is provided with a left upstream-side guide wall (wall part) 407 and a left downstream-side guide wall (wall part) 408 at intermediate points in the left forward channel part 379. The left upstream-side guide wall 407 faces the center of the left forward channel part 379 from the upper left inner wall part (i.e., the sidewall of the left forward channel part 379) 401 of the rear duct 367, and extends while sloping toward the downstream side.

The left downstream-side guide wall 408 faces the center of the left forward channel part 379 from the upper left outer wall part (i.e., the sidewall of the left forward channel part 379) 403 of the rear duct 367, and extends while sloping toward the upstream side. The air redirected forward at the left redirection part 378 is guided toward the forward-located silencer 381 in serpentine fashion by the left upstream-side guide wall 407 and the left downstream-side guide wall 408. The length of the left forward channel part 379 can thus be increased and the total length of the left intake channel 371B can therefore be increased.

Here, providing the left intake channel 371B with a left channel redirection area 376, and redirecting the left channel redirection area 376 in the reverse direction at the left redirection part 378 allows the length of the left intake channel 371B in the longitudinal direction to be kept short. Accordingly, the left intake channel 371B can be kept compact in a folded state.

Keeping the right intake channel 371A and the left intake channel 371B compact in a folded state in this manner allows the right intake channel 371A and the left intake channel 371B to be arranged in an empty space (dead space) 412 in the engine cover 24. The outboard engine unit 310 ordinarily has empty space (dead space) 412 between the upper part of the engine cover 24 and the throttle unit 42. Accordingly, keeping the right intake channel 371A and the left intake channel 371B compact allows the right intake channel 371A and the left intake channel 371B to be arranged in the empty space 412. Space for providing the right intake channel 371A and the left intake channel 371B is thus not required to be newly acquired inside the engine cover 24, and the outboard engine unit 310 can therefore be made smaller.

Here, the silencer 381 is in communication at an intermediate point in the right intake channel 371A and with the downstream side of the right forward channel part 375. Furthermore, the silencer 381 is in communication at an intermediate point in the left intake channel 371B and with the downstream side of the left forward channel part 379. In other words, the silencer 381 is jointly used in the right intake channel 371A and the left intake channel 371B.

Furthermore, as shown in FIG. 29, the silencer 381 is in communication with the throttle unit 42 (i.e., the combustion chambers of the engine 23) at the downstream-side intake channel 371C. Accordingly, when air intake noise is generated in accompaniment with air intake pulsation or shockwaves when the engine 23 is driven, the air intake noise generated from the engine 23 (combustion chambers) is transmitted as indicated by the arrow (indicated by a broken line) to the silencer 381 via the throttle unit 42. Transmitting the air intake noise to the silencer 381 allows the silencer 381 to reduce the generated air intake noise. Hereinbelow, the transmission direction of the air intake noise in the drawings is indicated by a broken-line arrow.

As shown in FIG. 25, the silencer 381 is provided with a main unit 382 formed by a rear part 355*a* of the belt cover 355 and a rear part 356*a* of the fan cover 356, and a cover part 383 formed above the main unit 382. The silencer 381 is provided with a silencer chamber 384. The silencer chamber 384 has a silencer lower-half chamber 384*a* and a silencer upper-half chamber 384*b*. The silencer upper-half chamber 284*b* and the silencer lower-half chamber 384*a* are in communication via the right opening 385 and the left opening 386.

As shown in FIGS. 29 and 30, the silencer 381 has the right inlet 381*a* formed at an intermediate point in the right intake channel 371A, the left inlet 381*b* formed at an intermediate point in the left intake channel 371B, and an outlet 381*c* formed in the downstream-side intake channel 371C. The silencer chamber 384 of the silencer 381 is in communication with the throttle unit 42 via the outlet 381*c* and the downstream-side intake channel 371C.

The air directed as indicated by the arrow (shown by the solid line) from the right intake channel 371A to the right inlet 381*a* is directed as indicated by the arrow from the right inlet 381*a* to the silencer upper-half chamber 384*b*. Hereinbelow, the airflow direction in the drawings is shown by a solid line arrow. The air directed to the silencer upper-half chamber 384*b* is directed as indicated by the arrow to the silencer lower-half chamber 384*a* via the right opening 385.

Air is thus directed from the right intake channel 371A to the silencer chamber 384 (i.e., the silencer upper-half chamber 384*b* and the silencer lower-half chamber 384*a*), the directed air thereby expands in the silencer chamber 384, and the flow rate is reduced. The air directed to the silencer lower-half chamber 384*a* is directed as indicated by the arrow to the throttle unit 42 via the outlet 381*c* and the downstream-side intake channel 371C.

Similarly, the air directed as indicated by the arrow from the left intake channel 371B to the left inlet 381*b* is directed as indicated by the arrow from the left inlet 381*b* to the silencer upper-half chamber 384*b*. The air directed to the silencer upper-half chamber 384*b* is directed as indicated by the arrow to the silencer lower-half chamber 384*a* via the left opening 386. Air is thus directed from the left intake channel 371B to the silencer chamber 384, the directed air thereby expands in the silencer chamber 384, and the flow rate is reduced. The air directed to the silencer lower-half chamber 384*a* is directed as indicated by the arrow to the throttle unit 42 via the outlet 381*c* and the downstream-side intake channel 371C.

The throttle unit 42 is in communication with the combustion chambers of the engine 23. Accordingly, directing air from the right intake channel 371A or the left intake channel 371B to the silencer chamber 384 and causing the air to expand in the silencer chamber 384 allows the sound pressure of the air intake noise generated in accompaniment with air intake pulsation or shockwaves when the engine 23 is driven to be reduced.

The air intake noise transmitted to the silencer 381 is transmitted to the right intake channel 371A via the right opening 385 and the right inlet 381*a* of the silencer 381. At the same time, the air intake noise transmitted to the silencer 381 is transmitted to the left intake channel 371B via the left opening 386 and the left inlet 381*b* of the silencer 381.

Here, providing the right channel redirection area 372 to the right intake channel 371A and providing the right upstream-side guide wall 405 and the right downstream-side guide wall 406 to the right forward channel part 375 increases the total length of the right intake channel 371A. Accordingly, the propagation distance of the air intake noise transmitted to the right intake channel 371A is increased and the air intake noise can be even more advantageously reduced due to the effect of attenuation by distance.

Furthermore, providing the left channel redirection area 376 to the left intake channel 371B and providing the left upstream-side guide wall 407 and the left downstream-side guide wall 408 to the left forward channel part 379 increases the total length of the left intake channel 371B. Accordingly, the propagation distance of the air intake noise transmitted to the left intake channel 371B is increased and the air intake noise can be even more advantageously reduced due to the effect of attenuation by distance.

Further reducing the air intake noise with the effect of attenuation by distance using the right intake channel 371A and the left intake channel 371B in this manner after the air intake noise has been reduced in the silencer 381 allows the air intake noise generated by the engine 23 to be sufficiently reduced. The air intake noise generated by the engine 23 can thus be advantageously prevented from being transmitted to the exterior of the engine cover 24 via the right intake channel 371A and the left intake channel 371B.

Next, an example of directing air taken in from the exterior 35 of the engine cover 24 to the throttle unit 42 will be described with reference to FIGS. 32A to 33B. The air flow directions in FIGS. 32A to 33B are indicated by arrows (solid lines).

Figure 32A:
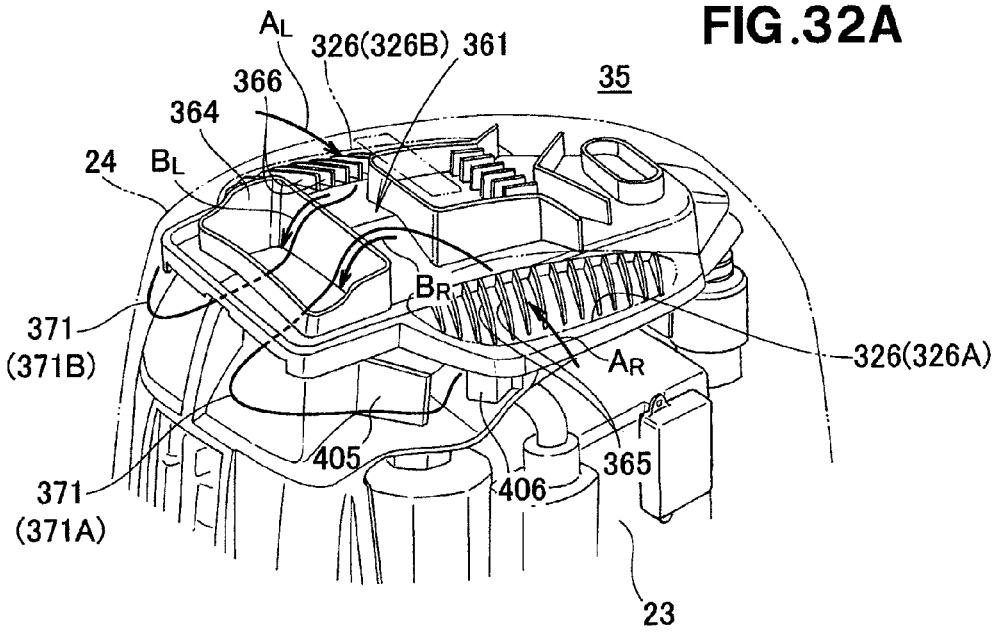
FIGS. 32A and 32B are perspective views showing an example of directing air from the exterior of the engine cover to a silencer using the intake structure of the outboard engine unit according to the third embodiment of the present invention.

As shown in FIG. 32A, driving of the engine 23 guides the air from the right intake opening 326A of the engine cover 24 toward the right side of the air guide 361 as indicated by the arrow $A_R$. At the same time, air is directed from the left intake opening 326B in the engine cover 24 toward the left side of the air guide 361 as indicated by the arrow $A_L$. The flow of air directed as indicated by the arrow $A_R$ from the right intake opening 326A is described in detail below.

Air taken in from the right intake opening 326A is directed to the right intake channel 371A inside the engine cover 24 via the plurality of right guide plates 365. The air directed to the right intake channel 371A is directed downward as indicated by the arrow $B_R$ toward the interior of the intake guide part 364.

Figure 32B:
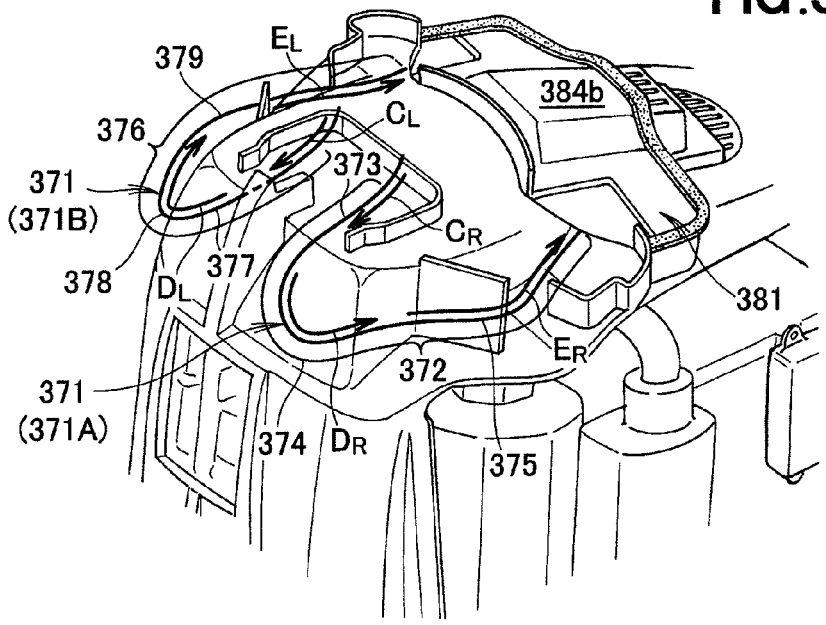

As shown in FIG. 32B, the air directed into the intake guide part 364 (FIG. 32A) is directed rearward as indicated by the arrow $C_R$ toward the right rearward channel part 373 of the right channel redirection area 372. Air directed to the right rearward channel part 373 is directed to the right redirection part 374 via the right rearward channel part 373, and redirected at the right redirection part 374 in the reverse direction (forward) as indicated by the arrow $D_R$.

At this point, it is possible that water spray or water droplets deposited at the periphery of the right intake opening 326A will be directed into the right intake channel 371A together with air when the air is introduced from the right intake opening 326A (FIG. 32A) to the right intake channel 371A. The flow of air is changed to the reverse direction from rearward to forward by the right redirection part 374 to separate out the water taken into the right intake channel 371A. Changing the flow of air at the right redirection part 374 to the reverse direction allows water directed into the right intake channel 371A to be separated from the air at the right redirection part 374. Furthermore, providing the right redirection part 374 to the right channel redirection area 372 allows the total length of the right intake channel 371A to be increased. Accordingly, the water directed to the right intake channel 371A can be separated from the air at an intermediate point in the right intake channel 371A.

Figure 34A:
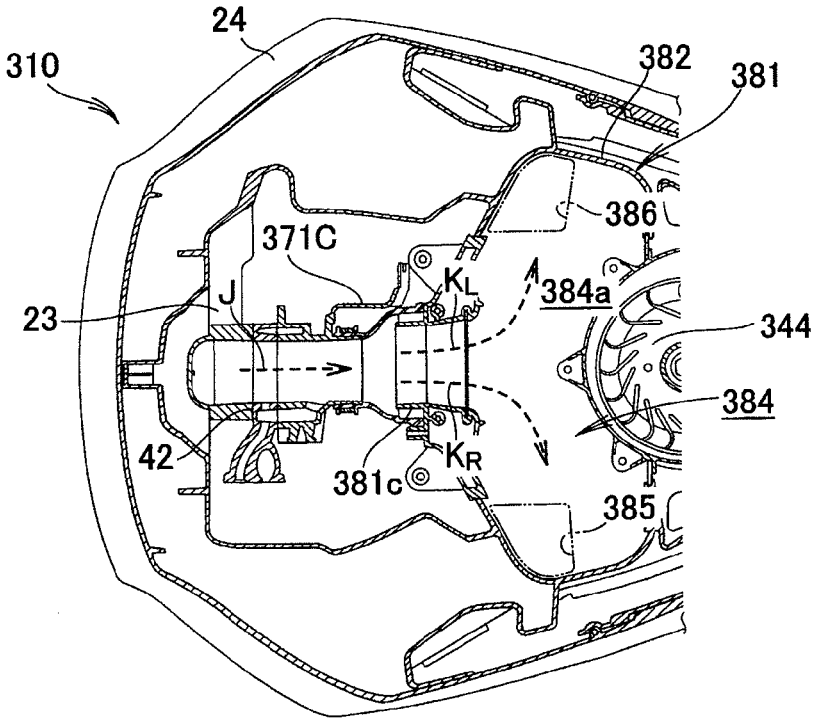
FIGS. 34A and 34B are views showing an example of reducing an intake noise using the air intake structure of the outboard engine unit according to the third embodiment of the present invention.
Figure 34B:
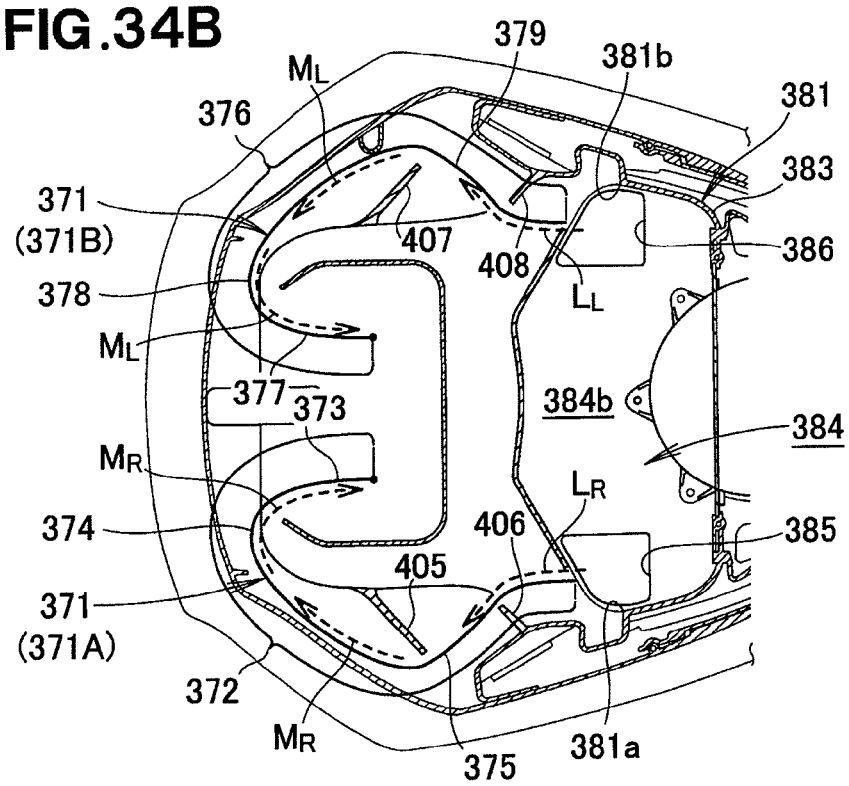

Providing the right redirection part 374 to the right channel redirection area 372 and increasing the total length of the right intake channel 371A in this manner allows water directed from the right intake opening 326A to the right intake channel 371A to be reliably separated out, and makes it possible to inhibit entry of water into the throttle unit 42 (see FIG. 34B).

Figure 33A:
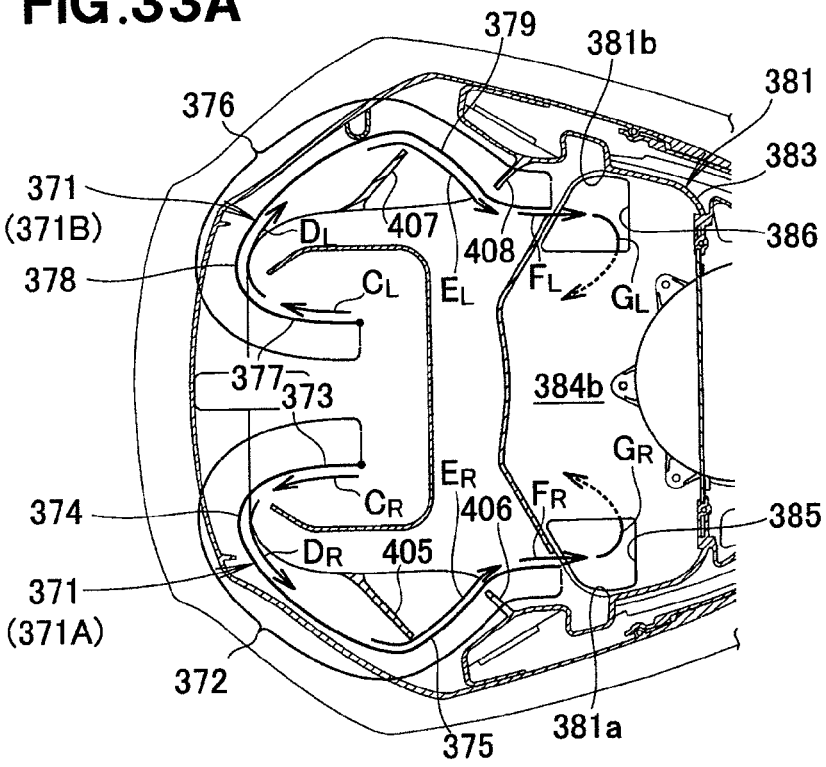
FIGS. 33A and 33B are views showing an example of directing air to the engine via the silencer.

As shown in FIG. 33A, air redirected in the reverse direction at the right redirection part 374 is directed to the right forward channel part 375. The right upstream-side guide wall 405 and the right downstream-side guide wall 406 are disposed in the right forward channel part 375. Accordingly, the air directed to the right forward channel part 375 is directed forward in serpentine fashion as indicated by the arrow $E_R$ in the right forward channel part 375. Air directed to the right forward channel part 375 is made to flow in serpentine fashion in this manner, whereby the length of the right forward channel part 375 can be increased. In this way, the total length of the right intake channel 371A can be further increased, water directed to the right intake channel 371A can be more reliably separated out, and water can be more advantageously inhibited from entering the throttle unit 42 (FIG. 33B).

The air directed to the right forward channel part 375 is directed as indicated by the arrow $F_R$ to the silencer upper-half chamber 384*b* of the silencer chamber 384 via the right forward channel part 375 and then via the right inlet 381*a* of the silencer 381. The air directed to the silencer upper-half chamber 384*b* is directed as indicated by the arrow $G_R$ to the silencer lower-half chamber 384*a* (FIG. 33B) via the right opening 385 of the silencer 381.

Figure 33B:
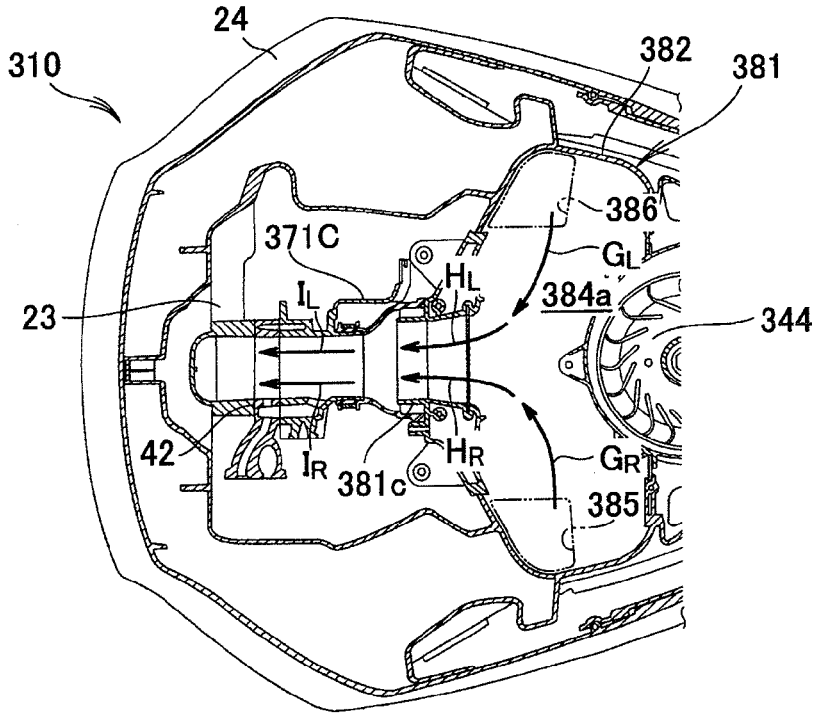

As shown in FIG. 33B, the air directed to the silencer lower-half chamber 384*a* is directed as indicated by the arrow $H_R$ to the outlet 381*c* of the silencer chamber 384. The air directed to the outlet 381*c* of the silencer chamber 384 is directed as indicated by the arrow $I_R$ from the downstream-side intake channel 371C to the throttle unit 42, and is then directed to the combustion chambers of the engine 23 via the throttle unit 42.

Returning to FIG. 32A, the air directed as indicated by the arrow $A_L$ from the left intake opening 326B is directed downward as indicated by the arrow $B_L$ to the left intake channel 371B in similar fashion to the air directed as indicated by the arrow $A_R$ from the right intake opening 326A.

As shown in FIGS. 32B to 33A, and FIG. 33B, the air directed to the left intake channel 371B is directed to the combustion chambers of the engine 23 via the throttle unit 42 as indicated by the arrows $C_L$, $D_L$, $E_L$, $F_L$, $G_L$, $H_L$, and $I_L$ in similar fashion to the air directed to the right intake channel 371A.

Described next with reference to FIGS. 34A and 34B is an example in which the air intake noise generated in accompaniment with air intake pulsation or shockwaves when the engine 23 is driven is reduced in the silencer 381. The transmission direction of the air intake noise in FIGS. 34A and 34B is indicated by an arrow (broken line).

As shown in FIG. 34A, air intake noise is generated in accompaniment with air intake pulsation or shockwaves when the engine 23 is driven. The generated air intake noise is transmitted as indicated by the arrow J toward the silencer lower-half chamber 384*a* of the silencer 381 via the throttle unit 42. The air intake noise transmitted toward the silencer lower-half chamber 384*a* is transmitted as indicated by the arrow $K_R$ to the right side of the silencer lower-half chamber 384*a*, and is transmitted as indicated by the arrow $K_L$ to the left side of the silencer lower-half chamber 384*a*. The air intake noise transmitted as indicated by the arrow $K_R$ to the right side of the silencer lower-half chamber 384*a* is described in detail below.

As shown in FIG. 34B, the silencer lower-half chamber 384*a* (FIG. 34A) is in communication with the silencer upper-half chamber 384*b* via the right opening 385 and the left opening 386. At this point, the air directed to the silencer chamber 384 (the silencer lower-half chamber 384*a* and the silencer upper-half chamber 384*b*) of the silencer 381 expands and the flow rate is reduced. The sound pressure of the air intake noise transmitted to the silencer chamber 384 is reduced, and the air intake noise is attenuated and reduced. The air intake noise attenuated in the silencer 381 is transmitted as indicated by the arrow $L_R$ to the right channel redirection area 372 (specifically, the right forward channel part 375) of the right intake channel 371A via the right inlet 381*a* of the silencer 381. The air intake noise transmitted to the right forward channel part 375 is transmitted as indicated by the arrow $M_R$ to the right rearward channel part 373 via right forward channel part 375 and the right redirection part 374.

Here, the right channel redirection area 372 is formed substantially in a U shape in plan view by the right rearward channel part 373, the right redirection part 374, and the right forward channel part 375. Furthermore, the right forward channel part 375 is formed in a serpentine shape by the right upstream-side guide wall 405 and the right downstream-side guide wall 406 being provided to the right forward channel part 375. Accordingly, the total length of the right intake channel 371A is increased. In this manner, the propagation distance of the air intake noise transmitted to the right intake channel 371A is increased and the air intake noise can be more advantageously reduced due to the effect of attenuation by distance.

As shown in FIG. 34A, the air intake noise transmitted as indicated by the arrow $K_L$ to the left side of the silencer lower-half chamber 384*a* is attenuated and reduced in the silencer chamber 384 in the same manner as the air intake noise transmitted as indicated by the arrow $K_R$ to the right side of the silencer lower-half chamber 384*a*.

As shown in FIG. 34B, the air intake noise attenuated in the silencer chamber 384 is transmitted as indicated by the arrow $L_L$ to the left channel redirection area 376 (specifically, the left forward channel part 379) of the left intake channel 371B in the same manner as the air intake noise transmitted to the right channel redirection area 372 of the right intake channel 371A. The air intake noise transmitted to the left forward channel part 379 is transmitted as indicated by the arrow ML to the left rearward channel part 377 via the left forward channel part 379 and the left redirection part 378.

Here, the left channel redirection area 376 is formed substantially in a U shape in plan view by the left rearward channel part 377, the left redirection part 378, and the left forward channel part 379. Furthermore, the left forward channel part 379 is formed in a serpentine shape by the left upstream-side guide wall 407 and the left downstream-side guide wall 408 being provided to the left forward channel part 379. Accordingly, the total length of the left intake channel 371B is increased. In this manner, the propagation distance of the air intake noise transmitted to the left intake channel 371B is increased and the air intake noise can be more advantageously reduced due to the effect of attenuation by distance.

Figure 35:
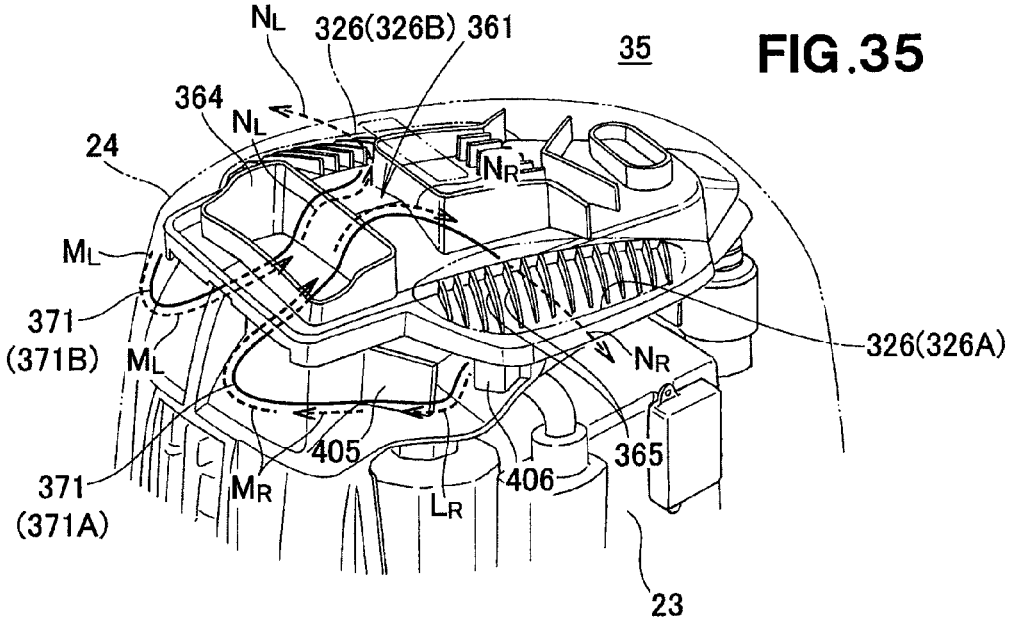
FIG. 35 is a perspective view showing an example of transmitting the intake noise, which has been reduced using the intake structure of the outboard engine unit according to the third embodiment of the present invention, to the left and right intake openings.

In this manner, further reducing the air intake noise in the right intake channel 371A and the left intake channel 371B due to the effect of attenuation by distance after the air intake noise has been reduced in the silencer 381 makes it possible to sufficiently reduce the air intake noise generated by the engine 23 (FIG. 34A). In this way, as shown in FIG. 35, the air intake noise generated by the engine 23 can be advantageously prevented from being transmitted as indicated by the arrow NR to the exterior 35 of the engine cover 24 via the right intake channel 371A and the right intake opening 326A. Similarly, the air intake noise generated by the engine 23 can be advantageously prevented from being transmitted as indicated by the arrow $N_L$ to the exterior 35 of the engine cover 24 via the left intake channel 371B and the left intake opening 326B.

The intake device of the outboard engine unit 10 of the present invention is not limited to the third embodiment described above, and may be suitably modified, improved, or otherwise adjusted. For example, the embodiment describes an example in which two guide walls 405, 406 are medially disposed in the right forward channel part 375 and two guide walls 407, 408 are medially disposed in the left forward channel part 379, but no limitation is imposed thereby, and the number of guide walls may be arbitrarily selected.

Furthermore, the shape and/or configuration of the outboard engine unit 310, the engine 23, the engine cover 24, the left and right intake openings 326B, 326A, the throttle unit 42, the left and right intake channels 371B, 371A, the left and right channel redirection areas 376, 372, the left and right redirection parts 378, 374, the silencer 381, the upper left and right inner wall parts 401, 396, the upper left and right outer wall parts 403, 398, the left and right upstream-side guide walls 407, 405, the left and right downstream-side guide walls 408, 406, and the like shown in the third embodiment are not limited to those exemplified above, and may be suitably modified.

The present invention is advantageous for use in an intake device of an outboard engine unit configured with an engine disposed in an engine cover so that air is directed to the combustion chambers of the engine via a throttle unit.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit having an engine, an engine cover covering the engine, and a throttle unit in communication with an upper space in a rear-side interior of the engine cover, wherein the outboard engine unit comprises:

a cooling opening, disposed in an upper part of the engine cover, for guiding air to an interior of the engine cover, the interior of the engine cover including a lower rear-side interior below the rear-side interior;

a first intake channel having a first inlet communicating with the cooling opening and a first outlet open to an upper front end of the engine cover, the first outlet communicating with the lower rear-side interior of the engine cover, the first intake channel and extending from the first inlet to the upper front end of the engine cover along the upper part of the engine cover;

a partition wall, disposed in a substantially vertical orientation below the first outlet, for guiding air directed out from the first outlet toward the lower rear-side interior of the engine cover;

a rear duct disposed along a rear wall of the engine cover;

a second intake channel formed by the rear duct and the rear wall of the engine cover and extending substantially vertically along the rear wall of the engine cover rearwardly of the partition wall, the second intake channel having a second inlet communicating with the lower rear-side interior and a second outlet located at an upper end of the engine unit and communicating with the upper space for guiding the air from the lower rear-side interior of the engine cover into the upper space.

2. The outboard engine unit of claim 1, wherein the second inlet of the second intake channel is located in a lower end part of the engine unit and communicates with the lower rear-side interior adjacent to the rear wall of the engine cover.

3. The outboard engine unit of claim 1, wherein the outboard engine unit comprises, in the interior of the engine cover:

a power generator disposed in front of the partition wall and below the first outlet; and an electrical component disposed behind the power generator and vertically below the partition wall.

4. An outboard engine unit having an engine, an engine cover covering the engine, an opening formed in the engine cover for introducing air into the engine cover, and a throttle unit into which air taken into an interior of the engine cover is introduced from the opening, wherein the outboard engine unit comprises:

an intake channel, disposed inside the engine cover, for guiding air directed from the opening to the throttle unit; and an interference muffler, disposed in communication with the intake channel and above the throttle unit, for reducing air intake noise transmitted from the throttle unit through the intake channel into the interference muffler, the interference muffler having an orthogonal hollow part orthogonal to and communicating with the intake channel and a parallel hollow part communicating with the orthogonal hollow part, the orthogonal hollow part and the parallel part defining a substantially L shape.

5. An outboard engine unit having an engine, an engine cover for covering the engine, a pair of openings formed in the upper two sides of the engine cover for introducing air into the engine cover, and a throttle unit into which air taken into an interior of the engine cover is introduced from the openings, wherein the outboard engine unit comprises:

a pair of intake channels, disposed in upper two sides inside the engine cover and respectively communicating with the openings, for guiding air directed from the openings to the throttle unit; and a pair of interference mufflers, respectively disposed in communication with the intake channels, for reducing air intake noise transmitted from the throttle unit through the pair of intake channels into the pair of interference mufflers, each of the interference mufflers having an orthogonal hollow part orthogonal to the pair of intake channels and a parallel hollow part communicating with the orthogonal hollow part, the orthogonal hollow part having an open end communicating with a corresponding one of the pair of intake channels, the parallel hollow part having a closed end opposite the open end, the orthogonal hollow part and the parallel hollow part defining a substantially L shape, and each of the interference mufflers being formed integrally, the pair of interference mufflers being arranged at the upper two sides of the throttle unit.

6. An outboard engine unit having an engine, an engine cover covering the engine, an opening formed in the engine cover for introducing air into the engine cover, and a throttle unit into which air taken into an interior of the engine cover is introduced from the opening, wherein the outboard engine unit comprises:

an air guide disposed inside the engine cover and below the opening, the air guide having an intake guide port communicating with the opening;

a rear duct disposed below the air guide and communicating with the intake guide port of the air guide;

a silencer connected to the rear duct and the throttle unit for reducing air intake noise;

an intake channel, disposed inside the engine cover and extending from the opening through the intake guide port of the air guide, along the rear duct, and through the silencer to the throttle unit, for guiding air directed from the opening to the throttle unit; and wherein the intake channel has channel redirection areas each located between the air guide and the rear duct, each of the channel redirection areas having a rearward channel part for guiding air directed from the opening through the intake guide port of the air guide in one direction, a redirection part for redirecting the air from the rearward channel part in a direction opposite the one direction, and a forward channel part for guiding the redirected air to the silencer.

7. The outboard engine unit of claim 6, wherein the rear duct having an upstream-side guide wall disposed in the forward channel part, and a downstream-side guide wall disposed downstream of the upstream-side guide wall and in the forward channel part, the upstream-side guide wall and the downstream-side guide wall projecting toward a center of the forward channel part so that air flows through the forward channel part in serpentine fashion.

8. An outboard engine unit having an engine, an engine cover covering the engine, a pair of openings formed in upper two sides of the engine cover for introducing air into the engine cover, and a throttle unit into which air taken into an interior of the engine cover is introduced from the openings, wherein the outboard engine unit comprises:

an air guide disposed inside the engine cover and below the openings;

a rear duct disposed below the air guide;

a silencer connected to the rear duct and the throttle unit for reducing air intake noise;

a pair of intake channels, disposed in upper lateral sides inside the engine cover and respectively extending from the openings through the air guide, along the rear duct and through the silencer to the throttle unit, for guiding air directed from the openings to the throttle unit; and wherein the pair of intake channels have channel redirection areas located between the air guide and the rear duct, the channel redirection areas having redirection parts, the channel redirection areas extending in one of forward and rearward directions to the redirection parts and extending in the other of the forward and rearward directions from the redirection parts to the silencer.

* * * * *